US011832698B2

(12) United States Patent
Wang et al.

(10) Patent No.: US 11,832,698 B2
(45) Date of Patent: Dec. 5, 2023

(54) APPARATUSES AND METHODS FOR DRYING AN OBJECT

(71) Applicant: SZ ZUVI TECHNOLOGY CO., LTD., Shenzhen (CN)

(72) Inventors: Mingyu Wang, Shenzhen (CN); Yin Tang, Shenzhen (CN); Xingwang Xu, Shenzhen (CN); Lei Zhang, Shenzhen (CN)

(73) Assignee: SZ ZUVI TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/806,947

(22) Filed: Jun. 15, 2022

(65) Prior Publication Data

US 2022/0304444 A1 Sep. 29, 2022

Related U.S. Application Data

(63) Continuation of application No. 17/482,602, filed on Sep. 23, 2021, now Pat. No. 11,464,313, which is a (Continued)

(30) Foreign Application Priority Data

May 9, 2020 (WO) ..... PCT/CN2020/089408
Jun. 9, 2020 (WO) ..... PCT/CN2020/095146

(51) Int. Cl.
*A45D 20/12* (2006.01)

(52) U.S. Cl.
CPC ..... *A45D 20/12* (2013.01); *A45D 2200/205* (2013.01)

(58) Field of Classification Search
CPC ..... A45D 20/12; A45D 2200/205
(Continued)

(56) References Cited

U.S. PATENT DOCUMENTS 1,720,302 A 7/1929 Francois
2,456,669 A 12/1948 Bauer
(Continued)

FOREIGN PATENT DOCUMENTS

AU 2014200576 A1 8/2015
CN 2063025 U 10/1990
(Continued)

OTHER PUBLICATIONS

International Search Report in PCT/CN2021/082835 dated Jun. 22, 2021, 4 pages.
(Continued)

*Primary Examiner* — Stephen M Gravini
(74) *Attorney, Agent, or Firm* — METIS IP LLC

(57) ABSTRACT

Apparatuses and methods for drying objects are provided. The apparatus can comprise a housing configured to provide an airflow channel having an airflow inlet and an airflow outlet, an airflow generating element configured to effect an airflow through the airflow channel, and one or more radiation energy sources configured to generate infrared radiation and direct the infrared radiation toward an exterior of the housing. At least a portion of at least one of the one or more radiation energy sources does not contact the airflow channel or the airflow, thereby maintaining an operating temperature of the radiation energy source within a predetermined range.

20 Claims, 39 Drawing Sheets

Related U.S. Application Data continuation of application No. PCT/CN2021/082835, filed on Mar. 24, 2021.

(58) Field of Classification Search
USPC ..... 34/95–100, 283
See application file for complete search history.

(56) References Cited

U.S. PATENT DOCUMENTS

| | | | | | |
|---|---|---|---|---|---|
| 3,006,079 | A | | 10/1961 | Ivar | |
| 3,307,529 | A | * | 3/1967 | Fannon, Jr. | F23C 99/00 431/89 |
| 3,508,338 | A | | 4/1970 | Guhl | |
| 4,053,279 | A | * | 10/1977 | Eichenlaub | F26B 25/02 126/92 C |
| 4,257,172 | A | * | 3/1981 | Townsend | F26B 3/283 219/400 |
| 4,323,761 | A | | 4/1982 | Hubner | |
| 4,382,174 | A | | 5/1983 | Barns | |
| 4,595,838 | A | * | 6/1986 | Kerschgens | A61N 5/06 250/504 R |
| 5,511,322 | A | * | 4/1996 | Fertig | A45D 20/12 34/202 |
| 5,761,824 | A | | 6/1998 | Moon et al. | |
| 5,901,462 | A | | 5/1999 | Rudd | |
| 6,088,932 | A | * | 7/2000 | Adamski | D06F 58/26 34/607 |
| 8,387,271 | B2 | | 3/2013 | Shami et al. | |
| 9,498,039 | B2 | | 11/2016 | Matsui et al. | |
| 10,021,952 | B2 | | 7/2018 | Goldman et al. | |
| 10,470,545 | B2 | | 11/2019 | Thiebaut et al. | |
| 11,000,104 | B2 | | 5/2021 | Goldman et al. | |
| 11,146,088 | B2 | | 10/2021 | Chen | |
| 11,464,313 | B2 | * | 10/2022 | Wang | A45D 20/12 |
| 2003/0152373 | A1 | | 8/2003 | Wong et al. | |
| 2003/0192194 | A1 | | 10/2003 | Evanyk | |
| 2004/0001707 | A1 | | 1/2004 | Ryu et al. | |
| 2004/0159002 | A1 | | 8/2004 | Carlucci et al. | |
| 2005/0047764 | A1 | | 3/2005 | Lo | |
| 2005/0069303 | A1 | | 3/2005 | Maione et al. | |
| 2012/0140481 | A1 | | 6/2012 | Simchak et al. | |
| 2018/0036553 | A1 | | 2/2018 | Shiibashi et al. | |
| 2020/0315313 | A1 | | 10/2020 | Friedman et al. | |
| 2021/0289907 | A1 | | 9/2021 | Jeong et al. | |
| 2021/0289908 | A1 | | 9/2021 | Lo | |
| 2021/0307473 | A1 | | 10/2021 | Conrad | |
| 2021/0315356 | A1 | | 10/2021 | Kim et al. | |
| 2021/0345751 | A1 | | 11/2021 | Nelson et al. | |
| 2022/0304444 | A1 | * | 9/2022 | Wang | A45D 20/10 |
| 2022/0378165 | A1 | * | 12/2022 | Gilsoul | A45D 20/12 |
| 2023/0001040 | A1 | * | 1/2023 | Huang | A61L 9/18 |

FOREIGN PATENT DOCUMENTS

| | | | | |
|---|---|---|---|---|
| CN | 2111677 | U | | 8/1992 |
| CN | 101128135 | A | | 2/2008 |
| CN | 202233647 | U | | 5/2012 |
| CN | 202820034 | U | | 3/2013 |
| CN | 103815644 | A | | 5/2014 |
| CN | 105286263 | A | | 2/2016 |
| CN | 205162245 | U | | 4/2016 |
| CN | 105639981 | A | | 6/2016 |
| CN | 106073111 | A | | 11/2016 |
| CN | 205696318 | U | | 11/2016 |
| CN | 106617613 | A | | 5/2017 |
| CN | 107949293 | A | | 4/2018 |
| CN | 208129714 | U | | 11/2018 |
| CN | 109527764 | A | | 3/2019 |
| CN | 208676494 | U | | 4/2019 |
| CN | 209769390 | U | | 12/2019 |
| CN | 209807381 | U | | 12/2019 |
| CN | 111093421 | A | | 5/2020 |
| CN | 111148448 | A | | 5/2020 |
| EP | 0695520 | A1 | | 2/1996 |
| FR | 2471158 | A1 | | 6/1981 |
| JP | H0265801 | A | | 3/1990 |
| JP | 2005177234 | A | | 7/2005 |
| JP | 2019050945 | A | | 4/2019 |
| JP | 2020044041 | A | | 3/2020 |
| JP | 2021181205 | A | * | 11/2021 |
| KR | 20070094041 | A | | 9/2007 |
| WO | 9926512 | A1 | | 6/1999 |
| WO | 0000055 | A2 | | 1/2000 |
| WO | 2018021309 | A1 | | 2/2018 |
| WO | 2020095515 | A1 | | 5/2020 |

OTHER PUBLICATIONS

Written Opinion in PCT/CN2021/082835 dated Jun. 22, 2021, 4 pages.
International Search Report in PCT/CN2020/089408 dated Feb. 7, 2021, 4 pages.
Written Opinion in PCT/CN2020/089408 dated Feb. 7, 2021, 4 pages.
International Search Report in PCT/CN2020/095146 dated Feb. 10, 2021, 3 pages.
Written Opinion in PCT/CN2020/095146 dated Feb. 18, 2021, 4 pages.
International Search Report in PCT/CN2021/092177 dated Aug. 5, 2021, 5 pages.
Written Opinion in PCT/CN2021/092177 dated Aug. 5, 2021, 4 pages.

* cited by examiner

Panel A

Panel B

Panel A

Panel B

Panel A

Panel B

Panel A

Panel B

Panel A

Panel B

Panel A

Panel B

Panel B

Panel A

Panel B

Panel C

Panel D

APPARATUSES AND METHODS FOR DRYING AN OBJECT

CROSS-REFERENCE TO RELATED APPLICATIONS

The present application is a continuation of U.S. application Ser. No. 17/482,602, filed on Sep. 23, 2021, which is a continuation of International Application No. PCT/CN2021/082835, filed on Mar. 24, 2021, which claims priority to International Application No. PCT/CN2020/089408, filed on May 9, 2020, and International Application No. PCT/CN2020/095146, filed on Jun. 9, 2020, the entire contents of which are hereby incorporated by reference.

TECHNICAL FIELD

The present disclosure relates generally to an apparatus for drying an object. More particularly, the present disclosure relates to a hair dryer which utilizes infrared (IR) radiation to heat and remove water from hair.

BACKGROUND

A traditional hair dryer (e.g., blow dryer) blows hot air to dry wet hair. The hair dryer extracts room temperature air in by a motor-driven impeller and heats the airflow up by a resistive heating element (e.g., nichrome wire). The hot airflow increases a temperature of the hair as well as the air surrounding the hair. An evaporation of water from wet hair is accelerated since the increased temperature facilitates individual molecules in a water droplet to overcome their attraction to one another and change from a liquid state to a gas state. Higher temperature in the air surrounding the hair also reduces the relative humidity around the wet hair which further accelerates the evaporation process.

In heating up the airflow, traditional hair dryers use a resistive heating element to transform electric energy into convective heat. However, the convective heat transfer can be low in heat transfer efficiency because only a portion of the hot airflow arrives at the hair and only a portion of heat carried by the hot airflow arriving at the hair is transferred to the hair and water on the hair (e.g., some of the heat is absorbed by the surrounding air). In addition, the convective heat used by a traditional hair dryer overexposes the hair to hot airflow in order to dry it completely. The hair is heated on the surface only, which can cause frizz and dry, damaged hair.

SUMMARY

A need exists for an improved apparatus for drying hair as well as other objects, such as fabrics, with a higher energy efficiency. Infrared (IR) radiation is utilized as a source of heat energy in the drying apparatus of the disclosure to remove water and moisture from objects. An infrared radiation energy source can emit infrared energy to provide stable and consistent heat. The infrared energy can be directed onto the object (e.g., hair), therefore heat is transferred to the object directly in a radiation heat transfer manner, which increases a heat transfer efficiency.

A need exists for management of an operating temperature in the infrared radiation energy source to prevent an overheat and consequently a shortened service life of the infrared radiation energy source. An operating temperature in the infrared radiation energy source is managed by positioning a portion of the infrared radiation energy source to contact an airflow channel or the airflow within the airflow channel, such that extra heat from the infrared radiation energy source can be transferred to the airflow channel or the airflow.

A need exists for compact and light-weight cordless apparatus for drying objects. A cordless drying apparatus of the disclosure can be powered by rechargeable and/or replaceable embedded batteries, making the drying apparatus portable and convenient. As a result of the improved heat transfer efficiency and energy efficiency of the infrared radiation energy source, an operating time of the battery powered cordless drying apparatus can be extended while maintaining a high output power density to guarantee a satisfactory drying effect.

A need also exists for an apparatus for drying hair which is capable of preventing heat damage to hair. The apparatus for drying hair can be provided with a plurality of sensors to measure parameters of the user's hair, the surrounding environment and/or operation of the apparatus. The apparatus for drying hair can give tactile feedback to the user if, for example, the user holds the apparatus too close to the hair or a malfunction is detected in the apparatus, such that the user can adjust or stop operating the apparatus.

Disclosed herein is an apparatus for drying an object. The apparatus can comprise a housing configured to provide an airflow channel having an airflow inlet and an airflow outlet; an airflow generating element contained in the housing and configured to effect an airflow through the airflow channel; one or more radiation energy sources configured to generate infrared radiation and direct the infrared radiation toward an exterior of the housing, at least one of the one or more radiation energy sources comprising a first portion that is positioned not contacting the airflow channel; and a power element configured to provide power at least to the radiation energy source and the airflow generating element. A method for drying an object is also disclosed. The method can comprise providing an airflow channel, via a housing, the airflow channel having an airflow inlet and an airflow outlet; effecting an airflow, via an airflow generating element contained in the housing, through the airflow channel; generating an infrared radiation, via one or more radiation energy sources, and directing the infrared radiation toward an exterior of the housing, at least one of the one or more radiation energy sources comprising a first portion that is positioned not contacting the airflow channel; and providing power, via a power element to at least the radiation energy source and the airflow generating element.

Also disclosed herein is an apparatus for drying an object. The apparatus can comprise a housing configured to provide an airflow channel having an airflow inlet and an airflow outlet; an airflow generating element contained in the housing and configured to effect an airflow through the airflow channel; one or more radiation energy sources contained in the housing and configured to generate an infrared radiation and direct the infrared radiation toward an exterior of the housing; a thermal coupling coupled to at least one of the one or more radiation energy sources and configured to dissipate heat from the at least one of the one or more radiation energy source; and a power element configured to provide power at least to the radiation energy sources and the airflow generating element. A method for drying an object is also disclosed. The method can comprise providing an airflow channel, via a housing, the airflow channel having an airflow inlet and an airflow outlet; effecting airflow, via an airflow generating element contained in the housing, through the airflow channel; generating infrared radiation, via one or more radiation energy sources contained in the housing, and directing the infrared radiation toward an exterior of the housing; dissipating heat, via a thermal coupling coupled to at least one of the one or more radiation energy sources, of the at least one of the one or more radiation energy source; and providing power, via a power element to at least the radiation energy source and the airflow generating element.

Also disclosed herein is an apparatus for drying an object. The apparatus can comprise a housing; one or more radiation energy sources configured to generate infrared radiation and direct the infrared radiation toward an exterior of the housing, each of the one or more radiation energy sources comprising a reflector, the reflector having an opening toward the exterior of the housing; and a power element configured to provide power at least to the radiation energy source. At least one of the reflectors of the one or more radiation energy sources can have a cut-away shape.

Also disclosed herein is a radiation energy source. The radiation energy source can comprise a radiation emitter, the radiation emitter being configured to generate an infrared radiation; and a reflector, the reflector having at least one vertex and an opening toward an exterior of the radiation energy source, the reflector being configured to direct the infrared radiation toward the exterior of the radiation energy source. The radiation emitter can be positioned and oriented such that a distal end of the radiation emitter does not point to the opening. A radiation emitter is also disclosed. The radiation emitter can comprise a radiation generating element configured to generate a radiation when powered; a radiation reflecting element positioned beneath the radiation generating element and configured to reflect at least a portion of the radiation toward an exterior of the radiation emitter; and a sealing member configured to seal the radiation generating element and the radiation reflecting element.

Also disclosed herein is an apparatus for drying an object. The apparatus can comprise a housing; one or more radiation energy sources configured to generate infrared radiation and direct the infrared radiation toward an exterior of the housing, each of the one or more radiation energy sources comprising a radiation emitter of the disclosure and a reflector, the reflector having an opening toward the exterior of the housing; and a power element configured to provide power at least to the radiation energy source.

Also disclosed herein is an apparatus for drying an object. The apparatus can comprise a housing configured to provide an airflow channel having an airflow inlet and an airflow outlet; an airflow generating element contained in the housing and configured to effect an airflow through the airflow channel, the airflow generating element comprising at least a low noise motor; a radiation energy source contained in the housing and configured to generate infrared radiation and direct the infrared radiation toward an exterior of the housing; and a power element configured to provide power at least to the radiation energy source and the airflow generating element.

Also disclosed herein is a method for drying an object. The method can comprise providing an airflow channel, via a housing, the airflow channel having an airflow inlet and an airflow outlet; effecting airflow, via an airflow generating element contained in the housing, through the airflow channel, the airflow generating element comprising at least a low noise motor; generating infrared radiation, via a radiation energy source contained in the housing, and directing the infrared radiation toward an exterior of the housing; and providing power, via a power element to at least the radiation energy source and the airflow generating element.

Additional aspects and advantages of the present disclosure will become readily apparent to those skilled in this art from the following detailed description, wherein only exemplary embodiments of the present disclosure are shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1:
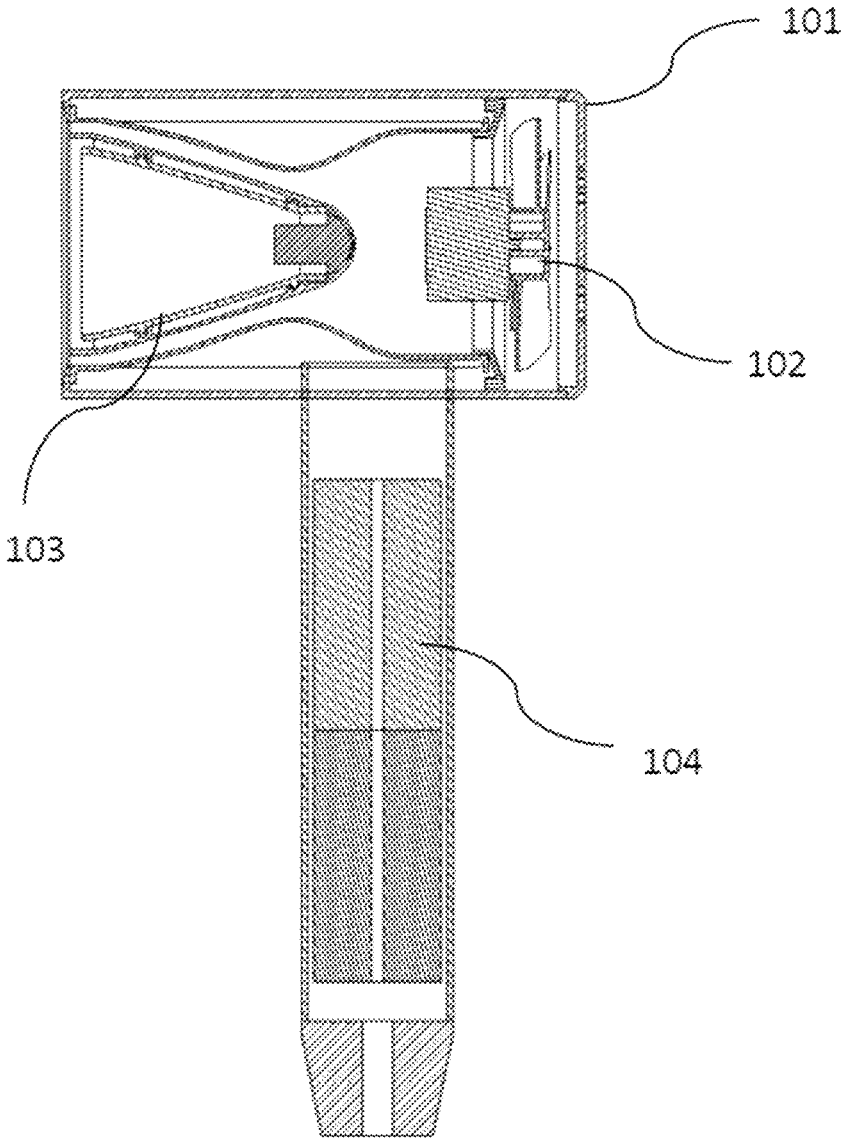
FIG. 1 is a cross-sectional view showing an exemplary hair dryer in accordance with embodiments of the disclosure.

While preferable embodiments of the invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing parameters of components, technical effects, and so forth used in the specification and claims are to be understood as being modified in all instances by the term "about" or "substantially." Accordingly, unless indicated to the contrary, the numerical parameters set forth in the following specification and attached claims are approximations that may vary depending upon the desired properties and effects sought to be obtained by the present invention. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the invention are approximations, the numerical values set forth in the specific examples are provided as precisely as possible. Any numerical value, however, inherently contains certain errors necessarily resulting from the standard deviation found in their respective testing measurements. Every numerical range given throughout this specification will include every narrower numerical range that falls within such broader numerical range, as if such narrower numerical ranges were all expressly written herein.

Apparatuses and methods for drying objects are provided. The drying apparatus of the disclosure can remove water and moisture from objects (e.g., hair, fabrics) by utilizing an infrared (IR) radiation energy source as source of heat energy. The infrared radiation energy source can emit infrared energy having predetermined wavelength range and power density to heat the object. The heat carried by the infrared energy is directly transferred to the object in a radiation heat transfer manner, such that a heat transfer efficiency is improved as compared with the conventional convective heat transfer manner (e.g., substantially no heat is absorbed by surrounding air in the radiation heat transfer manner, while a big portion of heat is absorbed by the surrounding air and then blown away in the conventional convective heat transfer manner). The infrared radiation energy source can be used in combination with an airflow generating element (e.g., a motor-driven impeller), which airflow further accelerates an evaporation of water from the object.

Another benefit of utilizing infrared radiation as source of heat energy is that the infrared heat penetrates the hair shaft down to the cortex of the hair cuticle, therefore it dries hair faster and also relaxes and softens the hair. The infrared energy is also believed to aid scalp health and stimulates hair growth by increasing blood flow of scalp. The utilization of infrared radiation energy source can enable a compact and lightweight drying apparatus because no resistive wire grid is needed to heat the airflow up. The improved heat transfer efficiency and energy efficiency of infrared radiation energy source can also enable a cordless drying apparatus, which is powered by embedded battery, to operate at an extended operating time.

FIG. 1 is a cross-sectional view showing an exemplary hair dryer in accordance with embodiments of the disclosure. The hair dryer can comprise a housing 101. Various electric, mechanical and electromechanical components, such as an airflow generating element 102, a radiation energy source 103, a control circuit (not shown) and a power adaptor (not shown), can be received in the housing 101. The radiation energy source 103 can be configured to generate radiation heat energy and direct the heat energy to the user's hair. The airflow generating element 102 can be configured to generate an airflow which facilitates an evaporation of water from user's hair. The hair dryer can comprise a power element configured to energize at least the radiation energy source and the airflow generating element.

The hair dryer can be powered with an external power source. The power element can comprise a power adapter which regulates a voltage and/or a current received from the external power source. For instance, the hair dryer can be energized by electrically connecting to an external battery or a power grid via a power cord. Additionally or alternatively, the hair dryer can be powered with an embedded power source. The power element can comprise one or more batteries which are received within the housing. The one or more batteries can be rechargeable (e.g., secondary battery) and/or replaceable. In an exemplary example, one or more batteries 104 can be received in the housing (e.g., a handle of the housing) of the hair dryer. A status of the battery (e.g., a battery charge status, a remaining power) can be provided by means of, for example, a screen or light-emitting diode (LED) indicator on the housing.

The housing can comprise a body and a handle, each of which can receive therein at least a portion of the electric, mechanical and electromechanical components. In some instances, the body and the handle can be integral. In some instances, the body and the handle can be separate components. For instance, the handle can be detachable from the body. In an exemplary example, the detachable handle can contain therein one or more batteries which are used to power the hair dryer. The housing can be made from an electrical insulating material having a high resistance to electrical flow. Examples of the electrical insulating material can include polyvinyl chloride (PVC), polyethylene terephthalate (PET), acrylonitrile-butadiene-styrene copolymer (ABS), polyester, polyolefins, polystyrene, polyurethane, thermoplastic, silicone, glass, fiberglass, resin, rubber, ceramic, nylon, and wood. The housing can also be made from a metallic material coated with an electrical insulating material or a combination of electrical insulation material and metallic material coated or not coated with electrical insulation material. For example, the electrical insulating material can form an inner layer of the housing, while the metallic material can form an outer layer of the housing.

The housing can provide one or more airflow channels therein. The airflow generated by the airflow generating element can be directed and/or regulated through an airflow channel and toward the user's hair. For instance, the airflow channel can be shaped to regulate at least a velocity, a throughput, an angle of divergence or a vorticity of the airflow exiting the hair dryer. The airflow channel can include an airflow inlet and an airflow outlet. In an exemplary example, the airflow inlet and the airflow outlet can be positioned at opposite ends of the hair dryer along a longitudinal direction thereof. The airflow inlet and the airflow outlet can each be vent that allows efficient airflow throughput. The environment air can be extracted into the airflow channel via the airflow inlet to generate the airflow, and the generated airflow can exit the airflow channel via the airflow outlet.

In some instances, one or more air filters can be provided at the airflow inlet to prevent dust or hair from entering the airflow channel. For instance, an air filter can be a mesh having appropriate mesh size. The air filter can be detachable or replaceable for cleaning and maintenance. In some instances, an airflow regulator can be provided at the airflow outlet. The airflow regulator can be a detachable nozzle, comb or curler. The airflow regulator can be configured to modulate a velocity, a throughput, an angle of divergence or a vorticity of the airflow blowing out from the airflow outlet. For instance, the airflow regulator can be shaped to converge (e.g., concentrate) the airflow at a predetermined distance in front from the airflow outlet. For instance, the airflow regulator can be shaped to diffuse the airflow exiting the airflow outlet.

Figure 2:
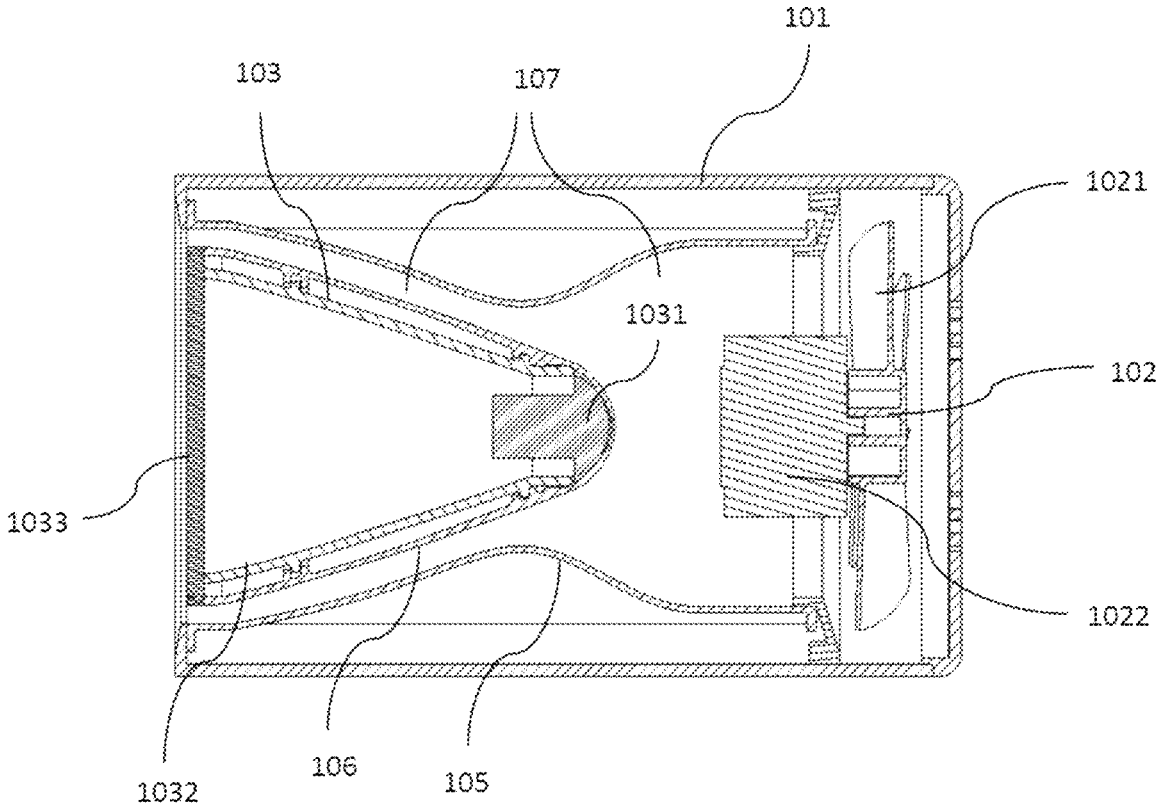
FIG. 2 is an enlarged cross-sectional view showing an airflow generating element and a radiation energy source in an exemplary hair dryer in accordance with embodiments of the disclosure.

As exemplarily illustrated in FIG. 2, which is an enlarged cross-sectional view showing the airflow generating element and the radiation energy source in an exemplary hair dryer in accordance with embodiments of the disclosure, the airflow generating element 102 can comprise an impeller 1021 driven by a motor 1022. The impeller can comprise a plurality of blades. When actuated by the motor, a rotation of the impeller can extract environment air into the airflow channel via the airflow inlet to generate the airflow, push the generated airflow through the airflow channel and eject the airflow out of the airflow outlet. The motor can be supported by a motor holder or housed in a motor shroud. The motor can be a brushless motor of which a speed of rotation can be regulated under the control of a controller (not shown). For instance, a speed of rotation of the motor can be controlled by a preset program, a user's input or a sensor data. A dimension of the motor, measured in any direction, can be in a range from 14 mm (millimeter) to 21 mm. A power output of the motor can be in a range from 35 to 80 watts (W). A maximum velocity of the airflow exiting from the airflow outlet can be at least 8 meters/second (m/s).

Though the airflow generating element 102 is illustrated in FIG. 1 and FIG. 2 as being received in the body of the housing, those skilled in the art can appreciate that it can also be positioned in the handle. For instance, a rotation of the impeller can extract air into a vent (e.g., airflow inlet) provided at the handle and push the air through the airflow channel to the airflow outlet provided at an end of the body of the housing. The airflow channel can accordingly extend through the handle and body of the housing.

The radiation energy source 103 can be configured to generate an infrared radiation and direct the infrared radiation toward an exterior of the housing. The radiation energy source can be supported by a radiation energy source holder or housed in a radiation energy source shroud. In some embodiments, the radiation energy source can be an infrared lamp which converts electric energy into infrared radiation energy. In an exemplary example, the infrared lamp can comprise a radiation emitter configured to emit a radiation having a predetermined wavelength and a reflector configured to reflect the radiation toward the outlet of the airflow channel. In another exemplary example, the infrared lamp can also be an infrared Light Emitting Diode (LED) or a laser device such as Carbon Dioxide Laser. In an exemplary example where a laser device is utilized as the infrared lamp, a reflector may not necessarily needed. An optical element can be provided to diverge the radiation from the laser device to increase an area that is radiated by the infrared radiation. The radiation energy can be directed to user's hair.

Therefore, heat is transferred to the hair in a radiation heat transfer manner, which increases a heat transfer efficiency of the hair dryer. Details of the infrared lamp will be provided in the disclosure hereinafter.

Figure 4:
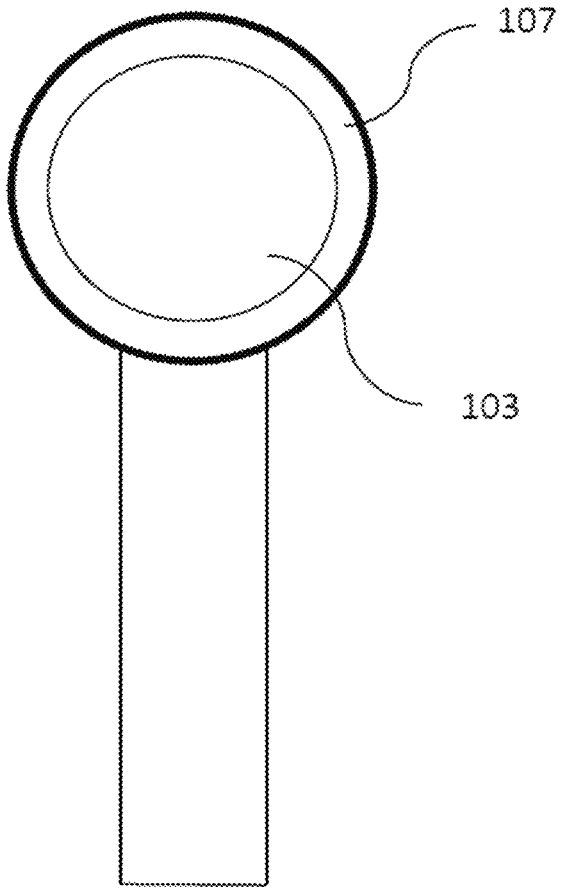
FIG. 4 is a lateral view showing an appearance of an exemplary hair dryer in accordance with embodiments of the disclosure.
Figure 5:
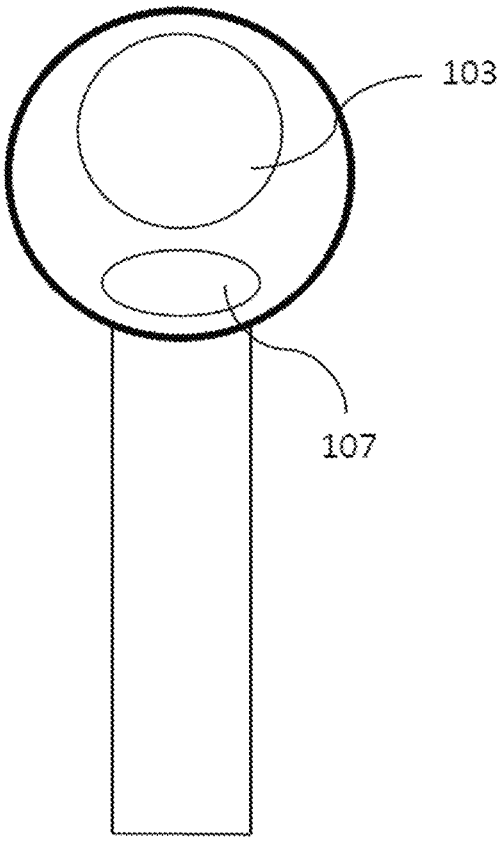
FIG. 5 is a lateral view showing an appearance of another exemplary hair dryer in accordance with embodiments of the disclosure.

In the exemplary example shown in FIG. 2, an airflow channel enclosure 105 can be provided to define the airflow channel 107 (e.g., as a boundary of the airflow channel). The airflow channel enclosure 105 can substantially extend from one longitudinal end of the hair dryer to the other longitudinal end. The motor and impeller can be positioned adjacent to an inlet end of the airflow channel enclosure. A property of the airflow (e.g., a velocity, an angle of divergence or a vorticity) can be regulated by the airflow channel enclosure. For instance, a cross-sectional shape of the airflow channel enclosure can vary along a longitudinal direction thereof to generate a desired velocity distribution and/or angle of divergence of the airflow exiting the airflow outlet. In some instances, the infrared lamp can be housed within an infrared lamp enclosure 106. The infrared lamp enclosure can serve to protect the infrared lamp. A space between an outer surface of the infrared lamp and an inner surface of the infrared lamp enclosure can be provided with a degree of vacuum. In some embodiments, the infrared lamp enclosure 106 can be positioned within the airflow channel enclosure 105. At least a portion of the airflow channel 107 can be defined by the airflow channel enclosure 105 and the infrared lamp enclosure 106, as shown in FIG. 2. A lateral view of a hair dryer having this configuration is shown in FIG. 4, where an output of the infrared lamp 103 is encompassed by the airflow outlet of the airflow channel 107. In some embodiments, the infrared lamp enclosure can be positioned external to the airflow channel enclosure (for example, the infrared lamp enclosure is not encompassed by the airflow channel enclosure). A lateral view of a hair dryer having this configuration is shown in FIG. 5, where an output of the infrared lamp 103 is separated from the airflow outlet of the airflow channel 107. Those in the art will appreciate that either the airflow channel enclosure or the infrared lamp enclosure can be optional.

Though the airflow channel is illustrated in FIG. 1 and FIG. 2 as extending from the airflow inlet at one longitudinal end of the body of the housing to the airflow outlet at the other longitudinal end of the body of the housing, those skilled in the art can appreciate that the airflow inlet and/or airflow outlet can be distributed over the housing of the hair dryer of the disclosure, and more than one airflow channel and/or branches of the airflow channel can be provided within the housing of the hair dryer. In an example, at least a portion of the airflow inlet can be positioned at the handle of the housing. In another example, at least a portion of the airflow outlet can be positioned at the handle of the housing, such that a portion of the airflow can be introduced to and flow through the one or more batteries received in the handle, thereby cooling down the one or more batteries.

Figure 3:
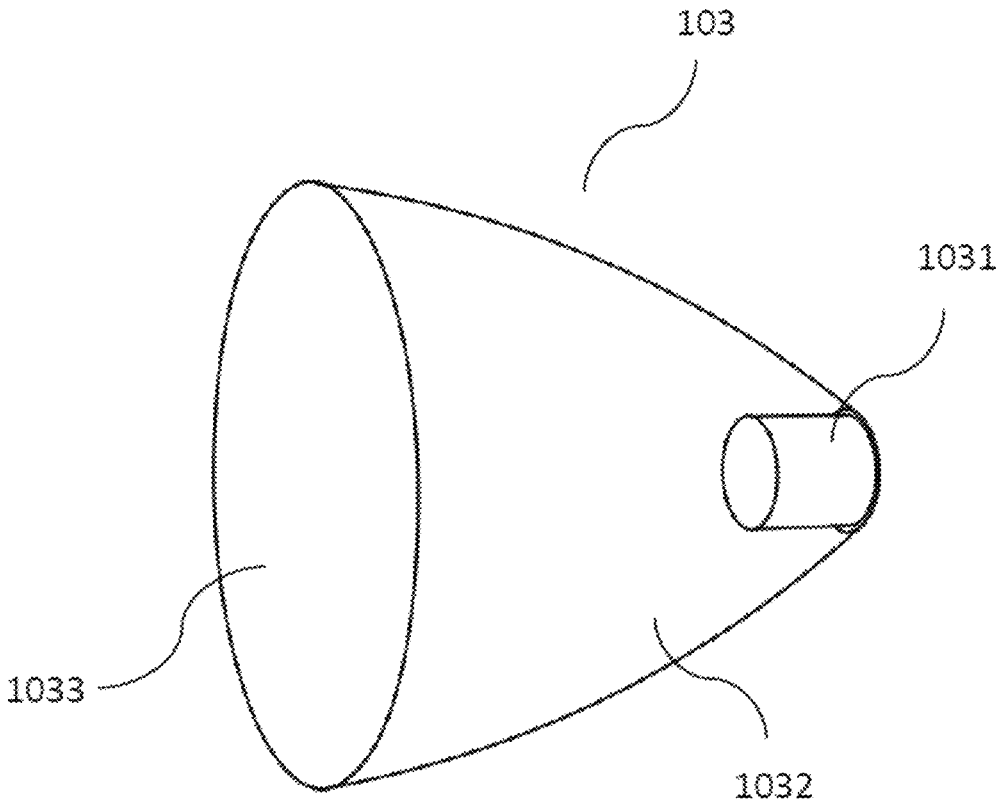
FIG. 3 is a schematic showing an exemplary radiation energy source in accordance with embodiments of the disclosure.

FIG. 3 is a schematic showing an exemplary radiation energy source in accordance with embodiments of the disclosure. In some embodiments, the radiation energy source can be an infrared lamp. The infrared lamp 103 can comprise a reflector 1032 having an opening directed to the airflow outlet of the airflow channel and a radiation emitter 1031 positioned within an interior of the reflector. The radiation emitter 1031 can be configured to emit a radiation within a predetermined wavelength range. The radiation emitted from the radiation emitter can be reflected by a reflecting surface (e.g., inner surface) of the reflector 1032 toward an exterior of the hair dryer.

The radiation emitter can be a conductive heater (e.g., a heater operated on a metal resistor or a carbon fiber) or a ceramic heater. Example of the metal resistor can include tungsten filament and Chromel (e.g., an alloy of nickel and chrome, also known as nichrome) filament. Examples of the ceramic heater can comprise a positive temperature coefficient (PTC) heater and a metal-ceramic heater (MCH). A ceramic heater includes metal heating elements buried inside the ceramics, for example tungsten inside silicon nitride or silicon carbide. The radiation emitter can be provided in a form of wire (e.g., filament). The wire can be patterned (e.g., spiral filament) to increase a length and/or surface thereof. The radiation emitter can also be provided in a form of rod. In an exemplary example, the radiation emitter can be a silicon nitride rod, a silicon carbide rod or a carbon fiber rod having a predetermine diameter and length.

In some instances, the radiation emitted by the radiation emitter can substantially cover visible spectrum from 0.4 μm to 0.7 μm and infrared spectrum above 0.7 μm. In some instances, the radiation emitted by the radiation emitter can substantially cover infrared spectrum only. In an exemplary example, the radiation emitter, when energized, can emit a radiation having a wavelength from 0.7 μm to 20 μm. A power density of radiation emitted by the radiation emitter can be at least 1 $kW/m^2$, 2 $kW/m^2$, 3 $kW/m^2$, 4 $kW/m^2$, 5 $kW/m^2$, 6 $kW/m^2$, 7 $kW/m^2$, 8 $kW/m^2$, 9 $kW/m^2$, 10 $kW/m^2$, 20 $kW/m^2$, 30 $kW/m^2$, 40 $kW/m^2$, 50 $kW/m^2$, 60 $kW/m^2$, 70 $kW/m^2$, 80 $kW/m^2$, 90 $kW/m^2$, 100 $kW/m^2$, 120 $kW/m^2$, 140 $kW/m^2$, 160 $kW/m^2$, 180 $kW/m^2$, 200 $kW/m^2$, 220 $kW/m^2$, 240 $kW/m^2$, 260 $kW/m^2$, 280 $kW/m^2$, 300 $kW/m^2$, 350 $kW/m^2$, 400 $kW/m^2$, 450 $kW/m^2$, 500 $kW/m^2$, or more.

Object will radiate in the infrared to visible wavelength range as a form of heat transfer. This heat transfer is referred to blackbody radiation. Blackbody radiation can be utilized as infrared source. Blackbody is a broadband radiation. The central wavelength as well as spectrum bandwidth decrease as the temperature increases. The total energy will be proportional to $S \times T^4$, where S refers to the surface area and T is the temperature. It is essential to raise the temperature in order to have a higher infrared emission. A temperature of the radiation emitter 1031 can be at least 500, 600, 700, 800, 900, 1000, 1100, 1200, 1300, 1400, 1500, 1600, 1700, 1800, 1900 or 2000 degrees centigrade (° C.). In an exemplary example, the temperature of the radiation emitter can be 900 to 1500 degrees centigrade. The central wavelength or range of wavelength of radiation emitted by the radiation emitter can be tunable, for example, by at least 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 9.5 or 10.0 μm. The power density of radiation emitted from the radiation emitter can be adjustable under different operation mode of the hair dryer (e.g., a rapid-dry mode, a hair-health mode, etc.), for example, by changing an electric voltage and/or current supplied thereto.

The reflector 1032 can be configured to regulate the radiation emitted from the radiation emitter. For instance, the reflector can be shaped to reduce a divergence angle of the reflected beam of radiation. In an embodiment, the reflector 1032 can have a substantially cone shape as shown in FIG. 2. For instance, a cross section of a reflecting surface of the reflector can be parabolic. The radiation emitter 1031 can be positioned at a focal point of the parabola, such that the reflected beam of radiation can be a substantially parallel beam of radiation. The radiation emitter can also be positioned offset the focal point of the parabola, such that the reflected beam of radiation can be convergent or divergent at a distance in front of the hair dryer. A position of the radiation emitter 1031 in the reflector 1032 can be adjustable, therefore, a degree of convergence and/or a direction of the output beam of radiation can be changed. The shape of the reflector and shape of the radiation emitter can be optimized and varied with respective to each other for desired heating power output at a desired position exterior to the hair dryer.

The reflecting surface of the reflector can be coated with a coating material having a high reflectivity to a wavelength or a range of wavelength of the radiation emitted by the radiation emitter. For instance, the coating material can have a high reflectivity to a wavelength in both visible spectrum and infrared light spectrum. A material having high reflectivity can have a high effectiveness in reflecting radiant energy. Examples of the coating material can include metallic material and dielectric material. The metallic material can include, for example, gold, silver and aluminum. The dielectric coating can have layers of alternating dielectric materials such as magnesium fluoride and calcium fluoride. The reflectivity of the coated reflecting surface of the reflector can be at least 90% (e.g., 90% of the incident radiation is reflected by the reflecting surface of the reflector), 90.5%, 91%, 91.5%, 92%, 92.5%, 93%, 93.5%, 94%, 94.5%, 95%, 95.5%, 96%, 96.5%, 97%, 97.5%, 98%, 98.5%, 99%, 99.5%, 99.6%, 99.7%, 99.8%, 99.9% or higher. In some instances, the reflectivity of the coated reflecting surface of the reflector can be substantially 100%, meaning that substantially all the radiation emitted by the radiation emitter can be reflected toward an exterior of the hair dryer. As a result, a temperature on an surface of the reflector is substantially not increased by the radiation emitted from the radiation emitter, even if a temperature of the radiation emitter is high.

An optical element 1033 can be provided at the opening of the reflector. The optical element can abut against the opening of the reflector in an air-tight manner. The optical element can include lens, reflector, prism, grating, beam splitter, filter or a combination thereof that modifies or redirects light. In some embodiments, the optical element can be a lens. In some embodiments, the optical element can be a Fresnel lens.

The interior of the reflector can be configured to have a degree of vacuum. A pressure within the interior of the reflector can be less than 0.9 standard atmosphere (atm), 0.8 atm, 0.7 atm, 0.6 atm, 0.5 atm, 0.4 atm, 0.3 atm, 0.2 atm, 0.1 atm, 0.05 atm, 0.01 atm, 0.001 atm, 0.0001 atm or less. In an exemplary example, the pressure within the interior of the reflector can be about 0.001 atm or less. The vacuum can suppress an evaporation and/or oxidation of the radiation emitter 1031 and expand a life span of the infrared lamp. The vacuum can also prevent a thermal convection or a thermal conduction between the radiation emitter and the optical element and/or reflector. In some instances, the interior of the reflector can be filled with an amount of non-oxidizing gas while still maintaining a certain level of vacuum to reduce an increase in a temperature of the air inside the space formed by the inner surface of optical element and coated reflector, which increase in temperature being caused by thermal convection and conduction though minimal. Examples of the non-oxidizing gas can include nitrogen ($N_2$), helium (He), argon (Ar), neon (Ne), krypton (Kr), xenon (Xe), radon (Rn), and nitrogen ($N_2$). The existence of inert gas can further protect the material of the radiation emitter from oxidation and evaporation.

The optical element can be made from a material having a high infrared transmissivity. Examples of the material for optical element can include oxides (e.g., silicon dioxide), metal fluorides (e.g., calcium fluoride, barium fluoride), metal sulfide or metal selenide (e.g., zinc sulfide, zinc selenide), and crystals (e.g., crystalline silicon, crystalline germanium). Additionally or alternatively, either or both sides of the optical element can be coated with a material absorbing visible spectrum and ultraviolet spectrum, such that only wavelength in infrared range can pass through the optical element. The radiation not in the infrared spectrum can be filtered out (e.g., absorbed) by the optical element. The infrared transmissivity of the optical element can be at least 95% (e.g., 95% of the incident radiation in infrared spectrum transmits through the optical element), 95.5%, 96.0%, 96.5%, 97.0%, 97.5%, 98.0%, 98.5%, 99%, 99.1%, 99.2%, 99.3%, 99.4%, 99.5%, 99.6%, 99.7%, 99.8%, 99.9% or higher. In an exemplary example, the infrared transmissivity of the optical element can be 99%.

The optical element can filter out (e.g., absorb) a radiation having a particular wavelength or a radiation having a predetermined range of wavelength from the radiation reflected by the reflector. For instance, the optical element can selectively remove visible light spectrum and/or ultraviolet spectrum from the arriving radiation, such that only radiation in the infrared spectrum can be directed to the user's hair. In an exemplary example, the radiation emitter can emit a radiation having a wavelength from 0.4 μm to 20 μm, the reflector can reflect all the radiation toward the optical element (e.g., no radiation is absorbed at the reflecting surface), and the optical element can filter out any visible spectrum wavelength of 0.4 μm to 0.7 μm from the reflected radiation, leaving only radiation in infrared spectrum exiting the infrared lamp.

The optical element can be shaped to converge or diverge the arriving radiation in a predetermined direction or to reduce a divergence angle of the arriving radiation beam. The optical element can be a convex lens, a concave lens, a set of convex lenses and/or concave lenses, or a Fresnel lens. For instance, if a conductive resistor, a ceramic heater or an LED is used as the radiation emitter, the optical element can be configured to converge the reflected radiation in a predetermined direction with a predetermined convergency angle to form a radiation spot having a predetermined shape and a predetermined size at a predetermined distance in front of the hair dryer. For instance, if a laser device is used as the radiation emitter, the optical element can be configured to diverge the generated radiation beam in a predetermined direction with a predetermined divergency angle to increase an area on the user's hair that is radiated by the infrared radiation.

A temperature increase at the optical element can be minor. A content of visible spectrum and ultraviolet spectrum in the radiation emitted by the radiation emitter 1031 can be low. Depending on the material of the radiation emitter 1031, energy carried by radiation in visible spectrum and ultraviolet spectrum can account for less than 5%, 4.5%, 4%, 3.5%, 3%, 2.5%, 2%, 1.5%, 1%, 0.5%, 0.4%, 0.3%, 0.2% or 0.1% of total energy in the radiation emitted by the radiation emitter. In other words, only a minor fraction of radiation energy (e.g., the energy carried by radiation in visible spectrum and ultraviolet spectrum) emitted by the radiation emitter 1031 can be absorbed by the optical element to cause a temperature increase. A temperature increase at the optical element can be further suppressed by the vacuum in the interior of the reflector (e.g., the space enclosed by the optical element and the reflecting surface of the reflector), which vacuum prevents a thermal convection or a thermal conduction between the radiation emitter and the optical element. In some instances, a portion of the airflow can be introduced from the airflow channel onto an outer surface of the optical element (e.g., blowing across the optical element), such that a temperature of the optical element and a surrounding area can be maintained substantially unchanged during an operation of the infrared lamp. As a result, an increase in temperature of the optical element can be minor even if a temperature of the radiation emitter is high.

A thermal insulating material (e.g., fiberglass, mineral wool, cellulose, polyurethane foam, or polystyrene) can be interposed between the radiation emitter and the reflector, such that the radiation emitter is thermally insulated from the reflector. The thermal insulation can keep a temperature of the reflector not increase even if a temperature of the radiation emitter is high. A thermal insulating material can also be interposed between a periphery of the optical element and the reflector, such that the optical element is thermally insulated from the reflector.

As discussed hereinabove, the temperature on the external surface of the reflector is substantially not increased by the radiation generated by the radiation emitter even if the radiation emitter is energized. The suppression of temperature increase on the external surface of the reflector can be achieved by a high reflectivity of coating material on the reflecting surface of the reflector, a vacuum within the interior of the reflector, a high infrared transmissivity of the optical element, a thermal insulation between the radiation emitter and the reflector as well as between the optical element and the reflector, or a combination thereof. As a result, the airflow is substantially not heated by the infrared lamp while traveling through the airflow channel and exiting the hair dryer. An increase in temperature of the airflow caused by the infrared lamp can be less than 5 degrees centigrade (° C.), 4.5° C., 4.0° C., 3.5° C., 3.0° C., 2.5° C., 2.0° C., 1.5° C., 1.0° C., 0.5° C., 0.1° C. or less. In an exemplary example, an increase in temperature of the airflow caused by the infrared lamp can be less than 3° C. In other words, the radiation generated at the infrared lamp does not substantially account for the increase in temperature of the airflow.

Those skilled in the art can appreciate that, a temperature of the airflow may be inevitably increased to some extent by electric components in the hair dryer such as circuits, electrical wires, power leads, power adaptor and controller. For instance, an increase in temperature of the airflow traveling through the entire airflow channel can be no more than 20° C., 19° C., 18° C., 17° C., 16° C., 15° C., 14.5° C., 14.0° C., 13.5° C., 13.0° C., 12.5° C., 12.0° C., 11.5° C., 11.0° C., 10.5° C., 10.0° C., 9.5° C., 9.0° C., 8.5° C., 8.0° C., 7.5° C., 7.0° C., 6.5° C., 6.0° C., 5.5° C., 5.0° C. or less. In an exemplary example, the room temperature is 25° C., and an increase in temperature of the airflow travelling through the entire airflow channel of the hair dryer of the disclosure is at most 15° C., resulting in a temperature of airflow at the airflow outlet at most 40° C., which is much lower than the temperature of the airflow blowing out of a conventional hot air-based hair dryer. In a comparative example, the temperature of the airflow blowing out of a conventional hair dryer No. 1 (Dyson® HD01) is about 140° C. In another comparative example, the temperature of the airflow blowing out of a conventional hair dryer No. 2 (Panasonic® EH-JNA9C) is about 105° C. In the comparative example, if cutting off a power supply to the nichrome wire heater, the temperature of the airflow blowing out of the conventional hair dryer No. 1 is about 36° C. in a condition of the room temperature being 27° C. (e.g., the airflow is heated up by about 9° C. by those electric components other than the nichrome wire heater).

The temperature of airflow arriving at the user's hair can be lower than the temperature measured at the airflow outlet of the hair dryer due to a heat dissipation in the air. In an exemplary example, the airflow temperature at 10 cm in front of the airflow outlet of the hair dryer of the disclosure is about 28° C. under a condition that the room temperature being 25° C. and the temperature of airflow at the airflow outlet being about 40° C. In the comparative example, the airflow temperature at 10 cm in front of the airflow outlet of the conventional hair dryer No. 1 is about 74.4° C. under a condition that the room temperature being 25° C. and the temperature of airflow at the airflow outlet being about 140° C.

The relative cool airflow (e.g., at room temperature) can be beneficial in drying and styling user's hair. For instance, frizz, dry and damaged hair can be avoided, which otherwise may occur with conventional hair dryer blowing a hot airflow. Another benefit of the cool airflow is that, the hair dryer can be equipped with various sensors which otherwise do not work under a high temperature. The sensors can comprise a temperature sensor, a proximity/range-finding sensor and/or a humidity sensor. The sensors can be positioned, for example, at an airflow outlet side of the housing to monitor a status the user's hair (e.g., degree of humidity). An area within which the airflow being applied onto the hair can substantially encompass an area of infrared radiation on the hair (e.g., the radiation spot). The airflow can accelerate an evaporation of the heated water from the hair by blowing away the humid air surrounding the hair. The airflow can also decrease a temperature of the hair radiated by the infrared radiation to avoid a hair damage. A temperature of the hair and water on the hair has to be maintained at an appropriate range to accelerate an evaporation of water from hair while keeping the hair not too hot. The appropriate temperature range can be 50 to 60 degrees centigrade. A velocity of the airflow blowing onto the hair can be regulated to maintain the temperature of the hair within the appropriate temperature range, for example by blowing away heated water and excess heat. A proximity/range-finding sensor and a temperature sensor can operate collectively to determine the temperature of the hair and regulate the velocity of the airflow via a feedback loop control to maintain a constant or programmed temperature of the hair.

Figure 6:
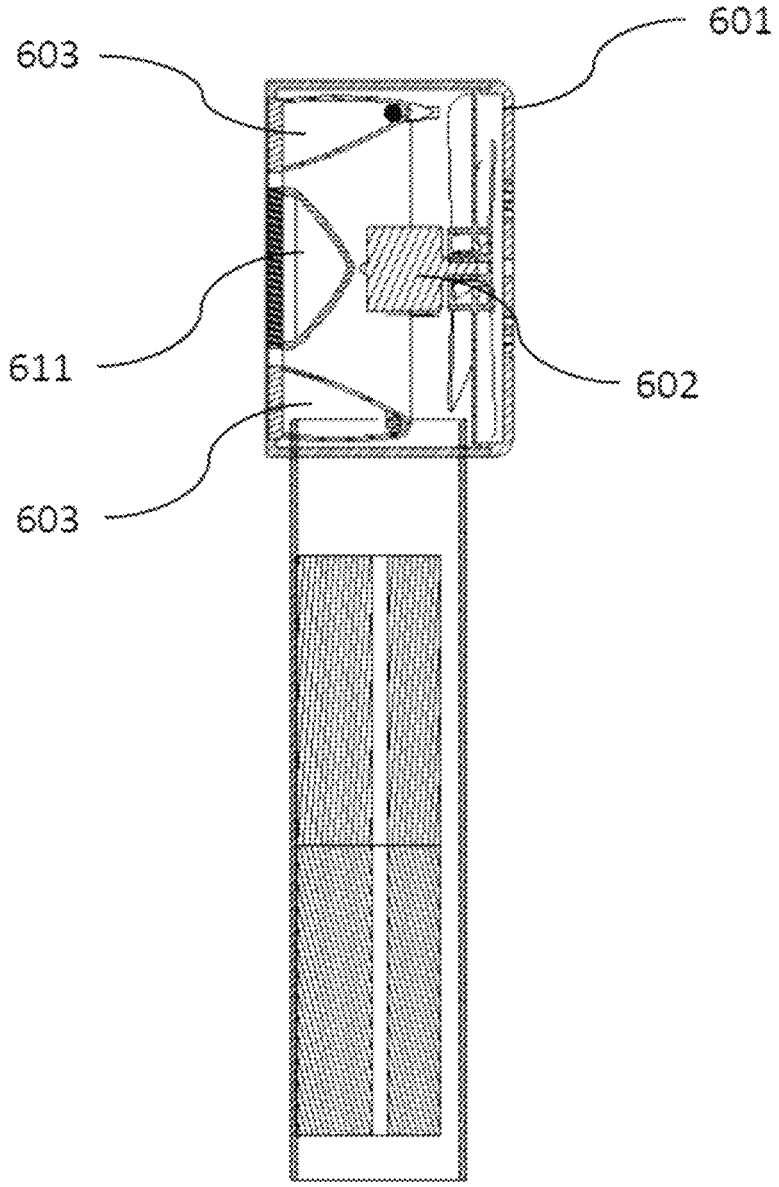
FIG. 6 is a cross-sectional view showing another exemplary hair dryer in accordance with embodiments of the disclosure.
Figure 7:
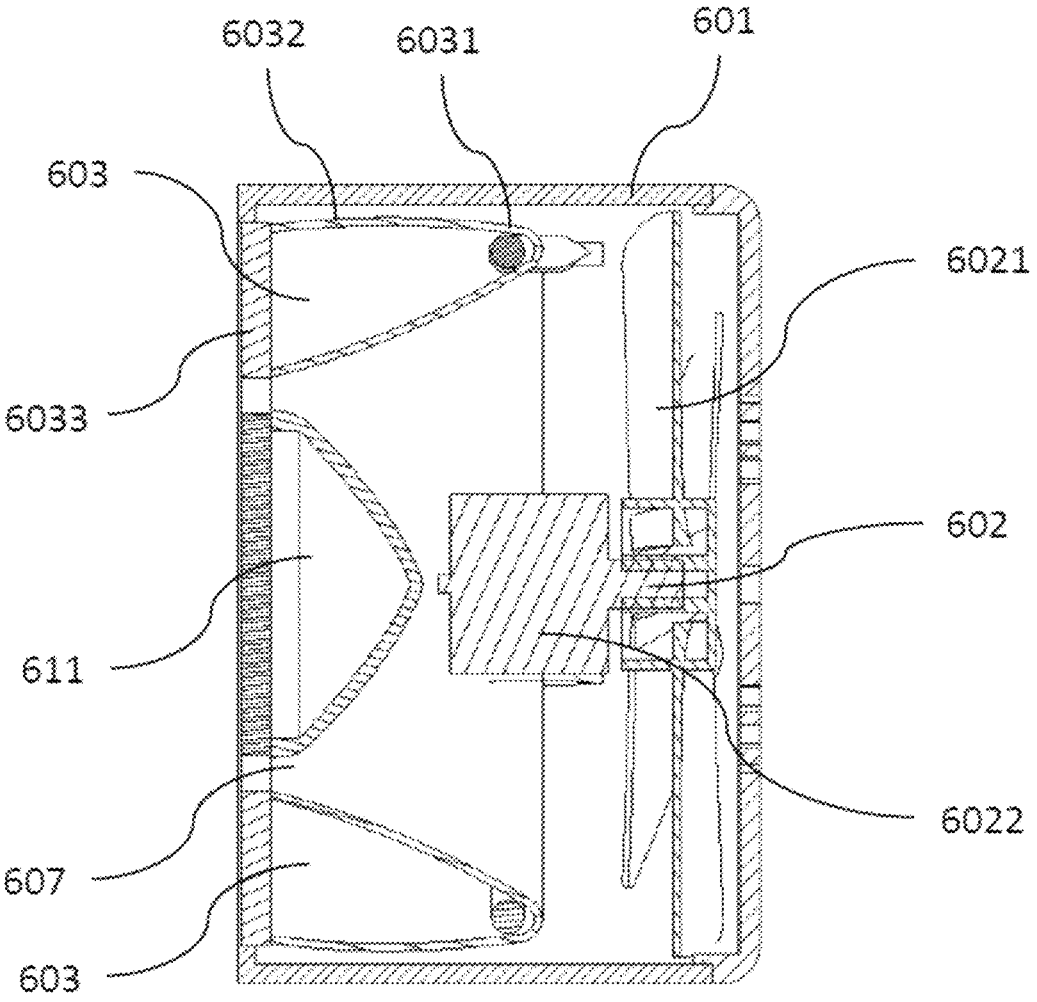
FIG. 7 is an enlarged cross-sectional view showing an airflow generating element and a radiation energy source in another exemplary hair dryer in accordance with embodiments of the disclosure.

FIG. 6 is a cross-sectional view showing another exemplary hair dryer in accordance with embodiments of the disclosure. FIG. 7 is an enlarged cross-sectional view showing body of the hair dryer of FIG. 6. The hair dryer can be powered by an external power source and/or embedded batteries. The hair dryer can comprise a housing 601. The housing can include a body and a handle. An airflow generating element 602, a radiation energy source 603 and various other electric and mechanical components can be received in the housing. The radiation energy source 603 can be configured to generate and direct heat energy toward user's hair. The airflow generating element 602 can be configured to generate an airflow passing through an airflow channel provided in the housing.

Figure 8:
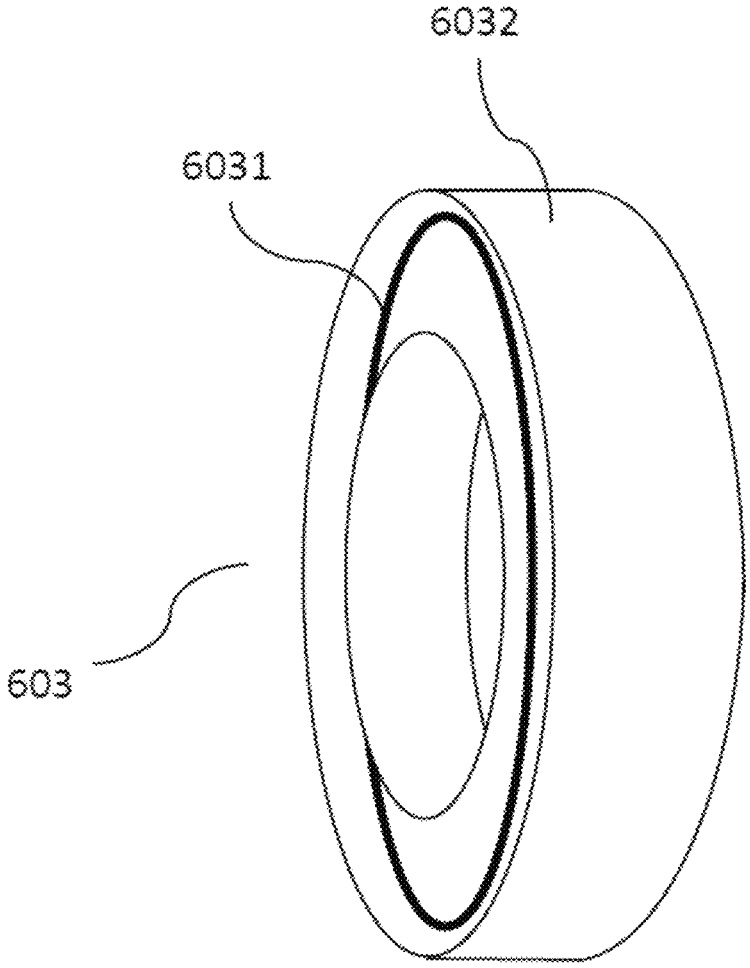
FIG. 8 is a schematic showing another exemplary radiation energy source in accordance with embodiments of the disclosure.

The airflow generating element 602 can comprise an impeller 6021 driven by a motor 6022. The generated airflow can be pushed through the airflow channel 607 to an exterior of the hair dryer. The radiation energy source 603 can be an infrared lamp having a substantially ring shape. As schematically shown in FIG. 8, the ring-shaped radiation energy source 603 can comprise a substantially ring-shaped reflector 6032 and a substantially ring-shaped radiation emitter 6031 positioned within an interior of the reflector. The radiation emitter can be a filament having a substantially ring shape. The radiation emitter 6031 can also comprises a plurality of sections which collectively form a substantially ring shape. The radiation emitter can be configured to emit a radiation within a predetermined wavelength range. In some instances, the radiation emitted by the radiation emitter can substantially cover visible spectrum and infrared spectrum. The reflector 6032 can have an opening directed to an exterior of the hair dryer.

The radiation emitted from the radiation emitter can be reflected by a reflecting surface (e.g., inner surface) of the reflector 6032 toward user's hair. A divergency angle of the reflected radiation beam can be reduced by the reflecting surface to concentrate the reflected radiation energy within a radiation spot having a predetermined shape and a predetermined size at a predetermined distance in front of the hair dryer. A cross section of the reflecting surface of the reflector can be parabolic. The radiation emitter 6031 can be positioned at a focal point of the parabolic reflecting surface of the reflector (e.g., parabola) or offset the focal point of the parabola. A position of the radiation emitter in the reflector can be adjustable by a movement of the radiation emitter with respect to the reflector. The reflecting surface of the reflector can be coated with a coating material having a high reflectivity to a wavelength range of radiation generated by the radiation emitter, such that substantially all the radiation emitted by the radiation emitter can be reflected toward the user's hair. As a result, a temperature on an external surface of the reflector is substantially not increased by the radiation from the radiation emitter because substantially no energy is absorbed by the reflecting surface of the reflector.

A substantially ring-shaped optical element 6033 can be provided at the opening of the reflector. The optical element can remove (e.g., absorb) a radiation having a predetermined range of wavelength from the radiation reflected by the reflector. For instance, the optical element can selectively remove visible light spectrum and/or ultraviolet spectrum from the reflected radiation, such that only radiation in the infrared spectrum can be directed to the user's hair. The interior of the reflector can be configured to have a degree of vacuum to prevent a thermal convection or a thermal conduction between the radiation emitter and the optical element and/or reflector. In some instance, the interior of the reflector can be filled with an amount of inert gas to prevent the radiation emitter from oxidation and/or evaporation. As discussed hereinabove, a temperature of the airflow is substantially not increased by the infrared lamp while traveling through the airflow channel, and the relative cool airflow can be beneficial in drying and styling user's hair.

As illustrated in FIG. 6 and FIG. 7, a dimension of the housing in an axial direction (e.g., the direction from the airflow generating element to the opening of the infrared lamp, which is shown in FIG. 6 and FIG. 7 as a horizontal direction) can be further reduced as a result of the ring-shaped infrared lamp configuration. For instance, at least a portion of the airflow generating element can be received in a space encompassed by the ring-shaped infrared lamp, resulting in a shortened airflow channel in the axial direction. A chamber 611 can be positioned in the space encompassed by the infrared lamp. An opening of the chamber can direct toward the user's hair. The opening can be covered by a transparent sealing member (e.g., $SiO_2$ glass). The opening can be covered by a colored sealing member (e.g., a coated $SiO_2$ glass) for an aesthetic appearance. The chamber can be provided to accommodate various components such as sensors. Examples of the sensors can comprise a temperature sensor, a proximity/range-finding sensor, and a humidity sensor. A wall of the chamber can be made from electrically and/or thermal insulting material. A temperature in the chamber can be maintained at room temperature to improve an accuracy in measurement of the sensors, since the airflow flowing through the airflow channel is substantially not heated by the infrared lamp, as discussed herein above.

Figure 9:
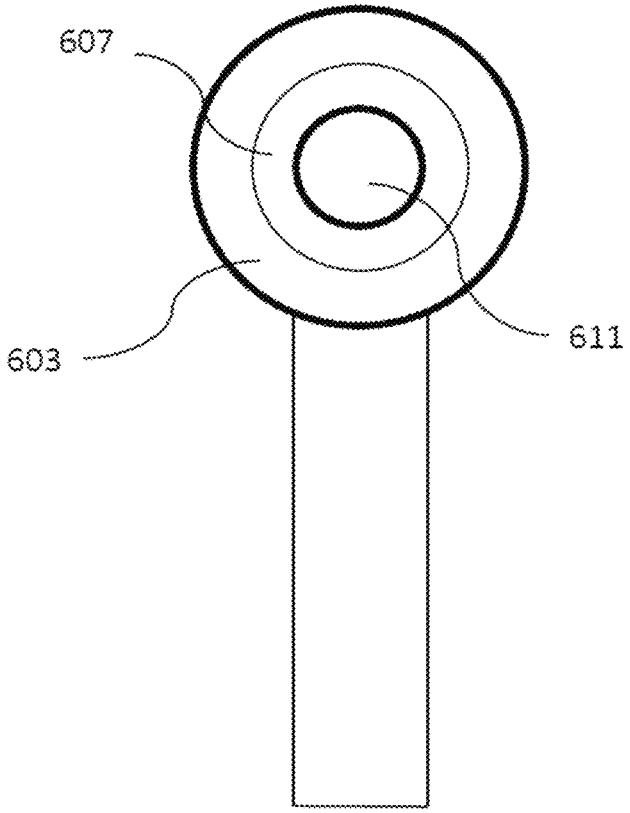
FIG. 9 is a lateral view showing an appearance of another exemplary hair dryer in accordance with embodiments of the disclosure.

In the exemplary example shown in FIG. 6 and FIG. 7, the airflow outlet of the airflow channel 607 can be positioned between the infrared lamp 603 and the chamber 611. FIG. 9 shows a lateral view of the hair dryer of FIG. 6 and FIG. 7, where the chamber is centrally positioned while the airflow outlet of the airflow channel 607 is encompassed by the infrared lamp 603. Though not shown, in alternative embodiments, the airflow outlet of the airflow channel 607 can be positioned between the housing 601 and the infrared lamp 603 to form a configuration where the infrared lamp is encompassed by the airflow outlet of the airflow channel.

Figure 10:
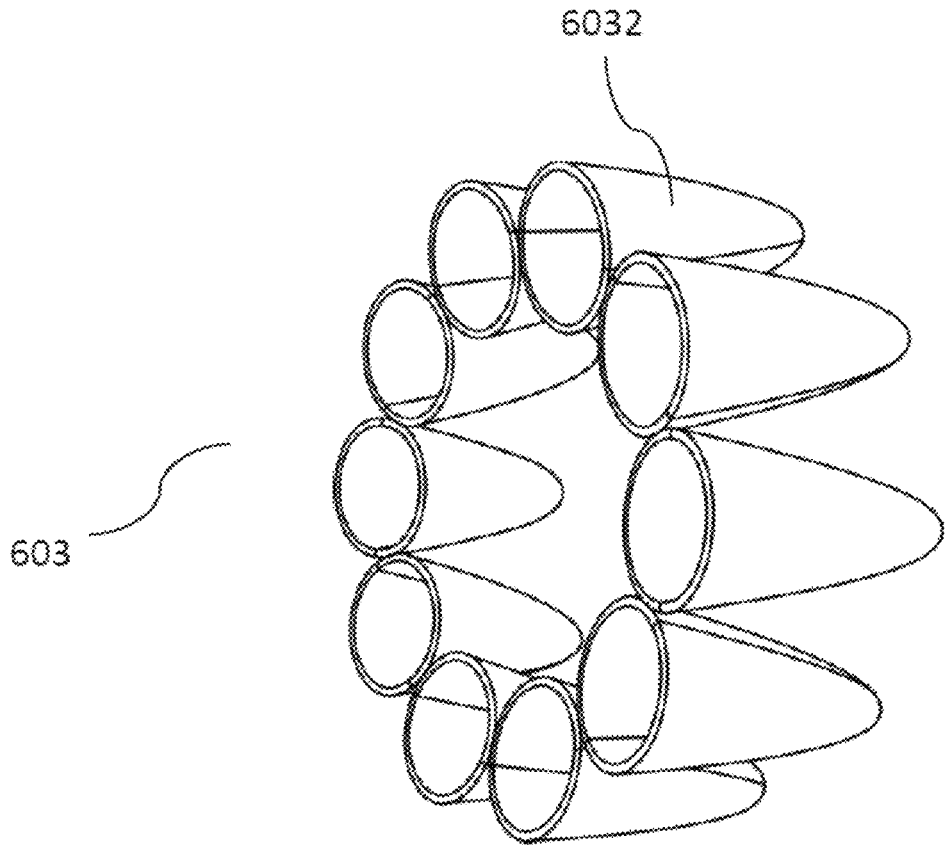
FIG. 10 is a schematic showing still another exemplary radiation energy source in accordance with embodiments of the disclosure.
Figure 11:
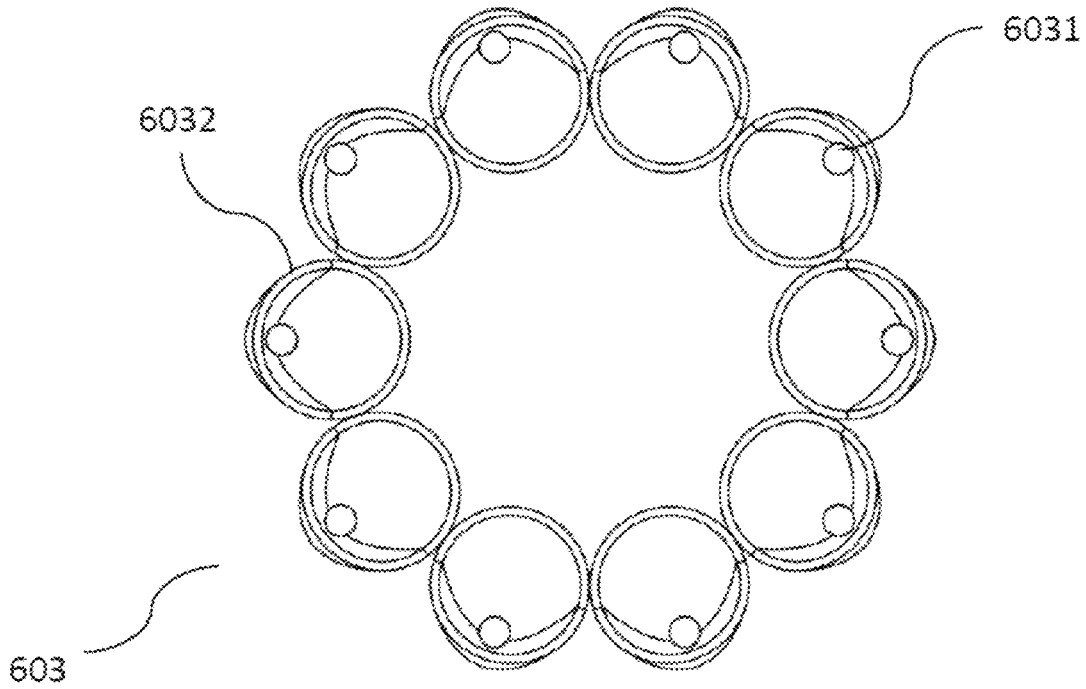
FIG. 11 is a cross-sectional view showing the exemplary radiation energy source of FIG. 10 in accordance with embodiments of the disclosure.

The radiation energy source 603 in FIG. 6 and FIG. 7 can alternatively or additionally comprise a plurality of infrared lamps. The plurality of infrared lamps can be arranged along a contour of any geometry, such as a ring, a triangle, a square or a sector. FIG. 10 and FIG. 11 schematically illustrate the radiation energy source 603 having a plurality of infrared lamps arranged along a ring. Each of the plurality of infrared lamps can have substantially the same configuration as described hereinabove with reference to FIG. 3. For instance, each of the plurality of infrared lamps can comprise a reflector 6032 having an opening directed to an exterior of the hair dryer, an optical element which abuts against an opening of the reflector, and a radiation emitter 6031 positioned within an interior of the reflector. The reflecting surface of the reflector can be coated with a coating material having a high reflectivity to the wavelength range of radiation generated by the radiation emitter. The optical element can remove radiation having a predetermined wavelength or wavelength range, such as radiation in visible light spectrum and/or ultraviolet spectrum.

Figure 12:
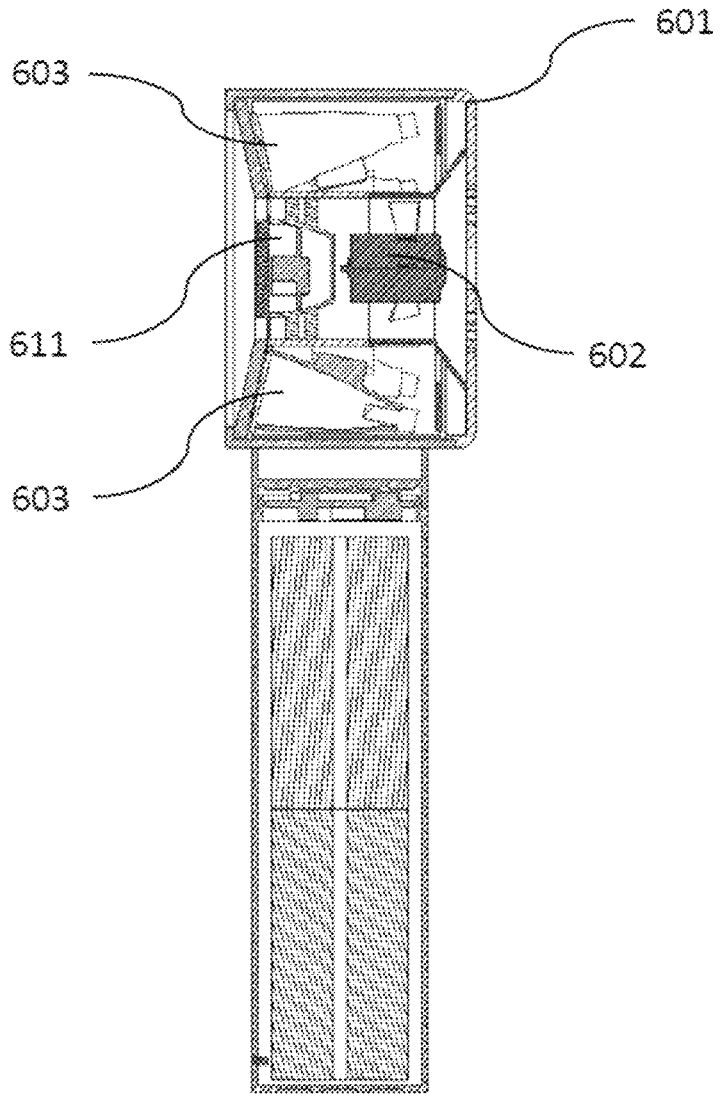
FIG. 12 is a cross-sectional view showing still another exemplary hair dryer in accordance with embodiments of the disclosure.

A cross section of a reflecting surface of each reflector can be parabolic. A divergence angle of the reflected beam of radiation can be reduced by the parabolic reflector of each infrared lamp. A shape of the radiation emitter and a shape of the reflector can be optimized using an optical simulation software to maximize the radiation output at a desired distance exterior to the hair dryer. An axis of the respective parabolic reflecting surface of the reflector in the plurality of infrared lamps can be substantially parallel with each other. The axis of a parabola can refer to an axis of symmetry of the parabola that is a vertical line passing through the vertex of the parabola and dividing the parabola into two congruent halves. An axis of the respective parabolic reflecting surface of the reflector in the plurality infrared lamps can also intersect with each other, as shown in FIG. 11 in combination with FIG. 12. The angle of intersection between the axis of the respective parabolic reflecting surface of the reflector in the plurality of infrared lamps can be adjustable, for example by changing a tilting angle of one or more infrared lamps with respect to axial direction of the housing of the hair dryer. In the exemplary example illustrated, the airflow can be thermally isolated from the plurality of infrared lamps. The airflow is not heated by the radiation generated by the infrared lamps.

The infrared radiation exiting the plurality of infrared lamps can at least partially overlap at a predetermined distance in front of the hair dryer, such that a radiation spot having a predetermined shape and size can be formed. The radiation spot can have, for example, a circular shape. In an exemplary example, a circular spot having a diameter of about 10 centimeters can be formed at a distance of about 10 centimeters in front of the hair dryer. The shape and/or size of the radiation spot at a certain distance in front of the hair dryer can be adjusted by regulating at least one of a size (e.g., diameter) of respective infrared lamp, an offset of radiation emitter from the focal point of the respective reflector, an angle of intersection between the axis of the respective reflector, and an optical property of the optical element of respective infrared lamp. The radiation spot can accounts for at least 50%, 55%, 60%, 65%, 70%, 75%, 80%, 85%, 90%, 95% or more of the total energy carried by the infrared radiation emitted from respective one of the plurality of infrared lamps. An average power density in the radiation spot can be at least $1\times10^3$, $2\times10^3$, $3\times10^3$, $4\times10^3$, $5\times10^3$, $6\times10^3$, $7\times10^3$, $8\times10^3$, $9\times10^3$, $1\times10^4$, $2\times10^4$, $3\times10^4$, $4\times10^4$, $5\times10^4$, $6\times10^4$, $7\times10^4$, $8\times10^4$, $9\times10^4$, $1\times10^5$ watt per square meter ($W/m^2$) or more.

Though not shown, the plurality of infrared lamps can also be arranged in an array of any shape. The plurality of infrared lamps arranged in an array can be coplanar or not. For instance, the plurality of infrared lamps can also be arranged to cover an area having any geometry such as a circle, a triangle, a square or a sector. An offset of the radiation emitter from the focal point of respective reflector and an angle of intersection between the axis of the respective reflector in the arrayed plurality of infrared lamps can have substantially same configuration as those described hereinabove with reference to FIG. 10 and FIG. 11. For instance, the infrared radiation emitted from respective one of the arrayed infrared lamps can overlap at a predetermined distance in front of the hair dryer to form a radiation spot having a desired size and power density. The plurality of infrared lamps, either arranged as a ring or an array, are not necessarily positioned continuously. For example, it is also possible to replace any one of the plurality of infrared lamps shown with a sensor or other component or leave some position along the ring or in the array blank, as long as a radiation spot having desired average energy density is generated at the hair.

The plurality of infrared lamps can be positioned at either an inner side or an outer side of the ring-shaped airflow outlet of the airflow channel. For instance, the plurality of infrared lamps can be positioned to encompass the airflow outlet or to be encompassed by the airflow outlet when viewed from a lateral side of the hair dryer. The plurality of infrared lamps can also be positioned apart from the airflow outlet of the airflow channel. For instance, an area covered by the plurality of infrared lamps may not overlap with an area covered by the airflow outlet when viewed from a lateral side of the hair dryer. A chamber can be provided, for example, in the space encompassed by the infrared lamp. A transparent sealing member can cover an opening of the chamber, which opening directing to an exterior of the hair dryer. The chamber can be provided to receive therein various components such as sensors. A temperature in the chamber can be maintained at room temperature to improve an accuracy in measurement of the sensors, since the airflow flowing through the airflow channel is substantially not heated by the infrared lamp.

The hair dryer of the disclosure can have a reduced dimension at least in an axial direction (e.g., the horizontal direction shown in FIG. 1 and FIG. 6) as compared with conventional designs. In an example, an infrared lamp having a compact size can be utilized as the radiation energy source. Therefore, a conventional heater cavity receiving a grid of nichrome wire is not provided in the hair dryer of the disclosure. By utilizing the ring-shaped infrared lamp or the plurality of infrared lamps arranged along a ring, a dimension of the hair dryer in the axial direction can be further reduced as described hereinabove. The hair dryer can comprise a housing having a body and a handle. The body can have a dimension no more than 25, 24, 23, 22, 21, 20, 19, 18, 17, 16, 15, 14, 13, 12, 11, 10, 9, 8, 7, 6, 5 or 4 centimeters in at least one direction thereof, for example an axial direction and a radial direction (e.g., the direction perpendicular to the plane of FIG. 1 and FIG. 6). In an exemplary example, the body can have a dimension no more than 10 centimeter in at least one direction. In a further exemplary example, the body can have a dimension no more than 8 centimeters in at least one direction. In a further exemplary example, the body can have a dimension no more than 6.5 centimeters in at least one direction. The body can have a dimension no more than 25, 24, 23, 22, 21, 20, 19, 18, 17, 16, 15, 14, 13, 12, 11, 10, 9, 8, 7, 6, or 5 centimeters in any direction thereof. In an exemplary example, the body can have a dimension no more than 8 centimeters in any direction thereof. In another exemplary example, the body can have a dimension no more than 6.5 centimeters in any direction thereof.

The hair dryer of the disclosure can have a reduced weight. A radiation energy source having a light weight can be utilized as the source of heat energy, instead of the conventional heavy nichrome wires or rods. The hair dryer can comprise a housing having a body and a handle. The hair dryer can be operated by either one or more batteries received within the handle or an external power source. The handle can be detachable from the body of the housing. The hair dryer, including the one or more batteries, can have a weight no more than 1500, 1450, 1400, 1350, 1300, 1250, 1200, 1150, 1100, 1050, 1000, 950, 900, 850, 800, 750, 700, 650, 600, 550, 500, 450, 400, 350 or 300 grams. In an exemplary example, the hair dryer, including the one or more batteries, can have a weight no more than 800 grams. In an exemplary example, the hair dryer, including the one or more batteries, can have a weight no more than 600 grams. In a further exemplary example, the body of hair dryer, excluding the handle, can have a weight no more than 300 grams. In a still further exemplary example, the body of hair dryer, excluding the handle, can have a weight no more than 250 grams. The user can therefore easily hold and operate the hair dryer during the process of drying the hair.

The hair dryer of the disclosure can have a reduced power consumption. A radiation energy source such as an infrared lamp can be utilized as the source of heat energy in the hair dryer of the disclosure. A ratio of effective energy transferred to the user's hair and water on the hair in the total radiation energy generated by the infrared lamp can be at least 80% because a majority of the radiation generated by the infrared lamp is in the infrared spectrum, as discussed hereinabove. In addition, the heat carried by the infrared energy can be directly transferred and applied to the hair and water on the hair in a radiation heat transfer manner, resulting in an improved heat transfer efficiency. In an exemplary example, about 90% of the radiation generated by the infrared lamp is in the infrared spectrum. A small percentage of the infrared energy may be lost at the reflector and the optical element, while most of the infrared energy arrives at the user's hair in a heat radiation manner, resulting in a ratio of effective energy more than 80%. In the conventional nichrome wire-based hair dryer where a convective heat transfer is utilized, however, the ratio of effective energy and heat transfer efficiency is much lower, because most of the heat is absorbed by surrounding air prior to arriving at the user's hair. In a testing experiment with conventional hair dryer No. 1 (Dyson® HD01), the air temperature at airflow outlet is around 140° C., however the temperature of airflow drops to 74° C. at a distance of 10 cm from the hair dryer, and 60° C. at a distance of 20 cm from the hair dryer. The rapid drop in temperature of airflow in the convective heat transfer manner is caused by the fact that some of the heat is absorbed by the surrounding air prior to arriving at the hair. If the room temperature is 25° C., then at least 50% of the energy carried by the hot airflow is lost before reaching the hair. After reaching the hair, a portion of hot air is reflected to various directions without contributing in heating the hair or water on the hair, leading to a low ratio of effective energy and heat transfer efficiency.

In an exemplary example, the hair dryer of the disclosure can be operated with one or more embedded batteries. The battery can have a total capacity of at least 50, 55, 60, 65, 70, 75, 80, 85, 90 Watt-hour (Wh, for example, 100 Watt-hour battery can deliver 100 watt power for 1 hour or 20 watt power for 5 hours). In a testing experiment, the battery having a total capacity of 66.6 Wh can effect a continuous operation of the hair dryer about 20 minutes at a total power output (e.g., the total power output of all electricity-consuming components, including the motor, the infrared lamp and any circuits) of 200 W or 13 minutes at a total power output of 350 W, which operation time is sufficient to dry a user's hair completely.

The hair dryer of the disclosure can provide a strong airflow which accelerates an evaporation of water from the hair. As compared with conventional nichrome wire-based hair dryers, the airflow generated by the airflow generating element can travel along the airflow channel without passing through the grid of nichrome wire and thus not being decelerated, resulting in an output airflow having an increased velocity blowing out of the hair dryer. A velocity of the output airflow can be at least 10, 11, 12, 13, 14, 15, 16, 17, 18, 19, 20, 21, 22, 23, 24 or 25 m/s. In an exemplary example, the velocity of the output airflow can be at least 18 m/s. The airflow blowing onto the hair can decrease the temperature of hair and water on the hair by removing excessive heat; otherwise, the hair can be damaged under a high temperature caused by the infrared radiation. As discussed hereinabove, an evaporation of water from hair can depend on both a temperature of hair and water on the hair and a relative humidity of air surrounding the hair. An appropriate temperature range for drying the hair is 50 to 60 degrees centigrade, in which range a water evaporation and a hair health can be balanced. The velocity of the output airflow blowing onto the hair can be regulated to maintain the temperature of the hair and water on the hair within the appropriate temperature range to induce a water evaporation, and in the meantime, the airflow takes away excessive heat from the hair, which can create a local environment surrounding the hair with lower relative humidity to accelerate the evaporation.

In passing through the airflow channel, the temperature of the airflow is substantially not increased by the radiation generated at the infrared lamp, as discussed hereinabove. The relative cool airflow can be beneficial to a health of hair in drying and styling user's hair. In addition, the hair dryer can be equipped with various sensors which otherwise do not work under a high temperature.

Figure 13:
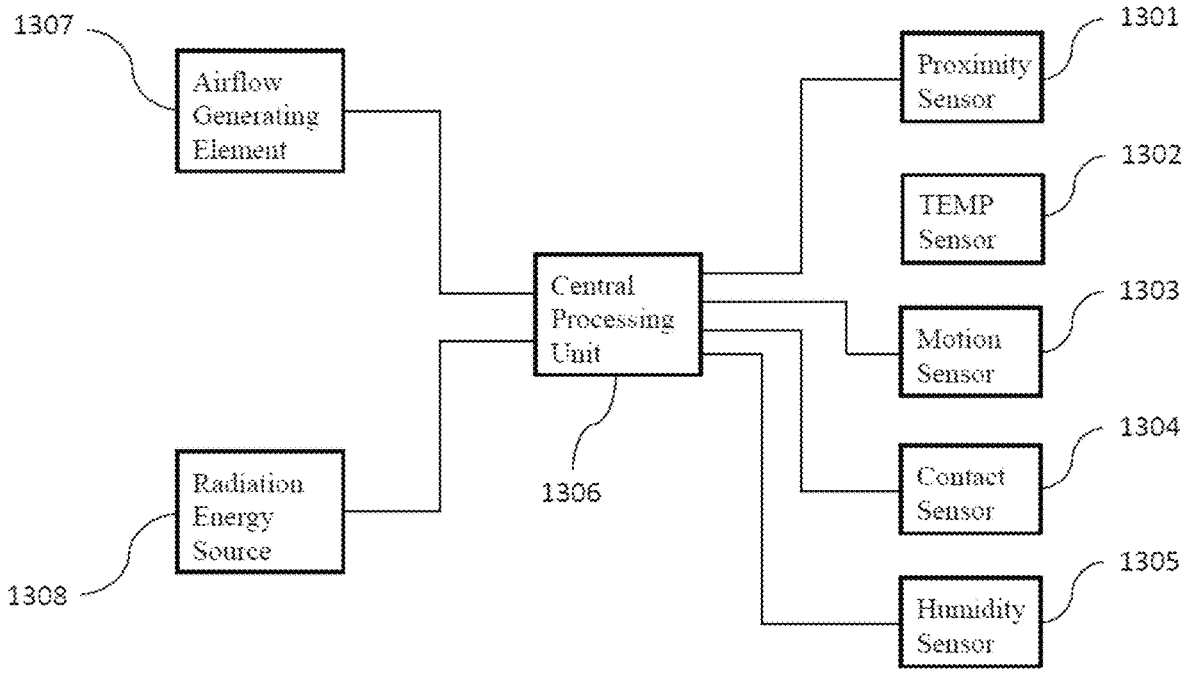
FIG. 13 is a schematic showing a sensor configuration in the hair dryer in accordance with embodiments of the disclosure.

The hair dryer of the disclosure can be provided with one or more sensors configured to measure at least one of a parameter of the hair, an operation of the hair dryer, and/or a surrounding environment in which the hair dryer operates. A central processing unit can be provided either onboard the hair dryer or offboard the hair dryer (e.g., remote device, on the cloud) to regulate an operation of the hair dryer. Examples of regulating an operation of the hair dryer may include regulating an operation of one or more of the airflow generating element and the radiation energy source based on a measurement received from the one or more sensors. Examples of the sensors can include, but not limited to, a proximity sensor, a temperature sensor, an optical sensor, a motion sensor, a contact sensor, and a humidity sensor. The sensors can be positioned at the housing of the hair dryer, embedded into the housing of the hair dryer, disposed on a circuit of the hair dryer, provided within the hair dryer (e.g., within the chamber which is be positioned in the space encompassed by the infrared lamps, as described elsewhere in the disclosure). As shown in FIG. 13 which is a schematic showing a sensor configuration in the hair dryer in accordance with embodiments of the disclosure, the sensors 1301-1305 can be in communication with the central processing unit 1306 via a wired or wireless link. The central processing unit can also be in communication with other components of the hair dryer, for example the airflow generating element 1307 and the radiation energy source 1308, such that a regulation on operation of the component based on sensor measurement can be implemented.

In an exemplary embodiment, the one or more sensors can include a proximity sensor configured to measure a proximity of the hair dryer to the user's hair being radiated with the infrared radiation. In an example, the proximity sensor can be an infrared Time-of-Flight (TOF) sensor that measures a time interval for an emitted infrared light to return to the sensor and determines the distance between the sensor and the target object based on time interval. A spectrum of the infrared TOF sensor can be different from that of the infrared radiation emitted from the radiation energy source. In another example, the proximity sensor can be an ultrasonic sensor that measures a distance to the target object by emitting an ultrasonic pulse. In still another example, the proximity sensor can be an millimeter-wave radar. In still another example, the proximity sensor can be implemented with a binocular or monocular camera that determines a distance to a target object by a distance measurement algorithm. The proximity sensor can be provided at the housing of the hair dryer, for example in proximity to the airflow outlet of the airflow channel. The proximity sensor can also be provided in a space encompassed by the plurality of infrared lamps, as shown in FIG. 10 and FIG. 11. The proximity sensor can be configured to measure a distance of 1 cm, 2 cm, 3 cm, 4 cm, 5 cm, 6 cm, 7 cm, 8 cm, 9 cm, 10 cm, 11 cm, 12 cm, 13 cm, 14 cm, 15 cm, 16 cm, 17 cm, 18 cm, 19 cm, 20 cm, 22 cm, 24 cm, 26 cm, 28 cm, 30 cm, 35 cm, 40 cm, 45 cm, 50 cm, 60 cm, 70 cm, 80 cm, 90 cm, or 100 cm from the hair dryer to the hair with an error of less than 5%, 4%, 3%, 2%, or 1%. In an example, the proximity sensor can measure 10 cm distance from the hair dryer to the hair an accuracy/precision of ±0.1 cm. A measurement accuracy/precision of the proximity sensor may not be adversely affected by the airflow generated by the airflow generating element since the airflow is substantially not heated by the radiation energy source, as discussed hereinabove in the disclosure.

In the exemplary embodiment, the measurement received from the one or more sensors can be indicative of a proximity of the hair dryer to the hair radiated with the radiation energy source being less than a predetermined distance. As discussed hereinabove in the disclosure, a radiation spot can be formed on the user's hair with the infrared radiation from the radiation energy source. The radiation spot can have a predetermined size at a predetermined distance in front of the hair dryer as a result of a divergence of the infrared radiation. For instance, a size of the radiation spot can be smaller and an average power density in the radiation spot can be higher if the hair dryer is getting closer to the user's hair. A higher average power density in the radiation spot can result in a higher hair temperature within the radiation spot. However, an unreasonably high temperature can damage the hair and therefore shall be avoided. The central processing unit can be configured to send an alert to the user, decrease a total power output of the radiation energy source and/or increase a velocity of airflow from the airflow generating element if a proximity of the hair dryer to the hair is detected less than a predetermined distance (e.g., 10 cm), such that a heat damage of the hair can be prevented. In an exemplary example where the radiation energy source comprise a plurality of infrared lamps as shown in FIG. 10 and FIG. 11, decreasing a total power output of the radiation energy source can comprise switching off one or more infrared lamps in the plurality of infrared lamps.

The measurement received from the one or more sensors can also be indicative of a proximity of the hair dryer to the hair radiated with the radiation energy source being more than a predetermined distance. An optimal distance from the hair dryer to the hair can be determined based at least on an output power of the radiation energy source, a power of the airflow generating element and/or an attribute of the hair (e.g., long or short, wetness, curl or straight, etc). An efficiency in drying the hair can be optimal if the distance from the hair dryer to the hair is maintained at the optimal distance. The central processing unit can be configured to increase a total power output of the radiation energy source and/or decrease a velocity of airflow from the airflow generating element if a proximity of the hair dryer to the hair is detected more than a predetermined optimal distance, such that an effectiveness in drying the hair can be optimized.

In another exemplary embodiment, the one or more sensors can include a temperature sensor. A temperature sensor can be provided to various components of the hair dryer to measure an operating temperature of the components. A temperature sensor can also be provided to measure the temperature of the hair. A temperature sensor can also be provided to measure the temperature of the surrounding environment. In an exemplary embodiment, the temperature sensor can be thermally coupled to the exterior surface of the radiation energy source. For instance, the temperature sensor can be positioned at or in proximity to an exterior surface of the radiation energy source. The temperature sensor can be either a negative temperature coefficient (NTC) thermistor, a resistance temperature detector (RTD), a thermocouple, or a semiconductor-based sensor. The measurement received from the one or more sensors can be indicative of an operation status of the hair dryer. In an example, the measurement received from the one or more sensors can be indicative of a malfunction of the radiation energy source. As discussed in the disclosure, a space between an outer surface of the infrared lamp and an inner surface of the infrared lamp enclosure as well as an interior of the infrared lamp can be maintained with a degree of vacuum. A temperature at the exterior surface of the infrared lamp can increase rapidly if the vacuum is not correctly maintained due to, for example, a leakage of air through a failed sealing member. The malfunction of the infrared lamp can include a temperature at or in proximity to an exterior surface of the infrared lamp being higher than a predetermined temperature, an increase in temperature at or in proximity to an exterior surface of the infrared lamp being larger than a predetermined value, or a rate in temperature increase at or in proximity to an exterior surface of the infrared lamp being larger than a predetermined rate. The central processing unit can be configured to send an alert to the user and/or switch off the radiation energy source if a malfunction is detected at the radiation energy source. In an example, a multi-stage warning mechanism can be provided where an alert is first sent to the user if the temperature at the exterior surface of the infrared lamp exceeds a first threshold, and the infrared lamp is switched off if the temperature at the exterior surface of the infrared lamp exceeds a second threshold which is higher than the first threshold.

In still another exemplary embodiment, the one or more sensors can include a temperature sensor that is thermally coupled to the airflow generating element. For instance, a temperature sensor can be coupled to the motor which drives the impeller. The temperature sensor can be coupled to either an exterior surface or a rotor of the motor to detect an operating temperature of the motor. The temperature sensor can also be provided at an outlet of the airflow channel to measure a temperature of the airflow. For instance, an abnormally highly temperature at the motor or the airflow can indicate a malfunction of the motor. In the exemplary embodiment, the measurement received from the one or more sensors can be indicative of a temperature of the motor being higher than a predetermined temperature. The central processing unit can be configured to send an alert to the user, decrease a total power output of the airflow generating element and/or switch off the airflow generating element if a temperature of the motor is higher than a predetermined temperature. In an example, a multi-stage warning mechanism can be provided where a total power output of the motor is decreased (e.g., decreasing a rotating speed of the motor) if the temperature at the motor exceeds a first threshold, and the motor is switched off if the temperature at the motor exceeds a second threshold which is higher than the first threshold.

In still another exemplary embodiment, the one or more sensors can include an Inertial Measurement Unit (IMU) which is configured to measure a movement and/or an attitude/orientation of the hair dryer. In some instances, exposing an object or a portion of an object to the infrared radiation shall be avoided to prevent a damage to the object or a safety issue. For instance, the hair temperature can increase rapidly if the hair is subject to continuous exposure to infrared radiation and water on the hair is already removed, which high temperature may cause heat damage to the hair. For instance, the hair dryer can often be used to dry objects other than hair, for example a cloth. In drying a cloth, the hair dryer can often be placed stationary with respect to a supporting member. Therefore, it would be desirable to switch off the hair dryer if the hair dryer is maintained stationary over a predetermined time duration. In the exemplary embodiment, the measurement received from the one or more sensors can be indicative of an attitude of the apparatus being maintained unchanged for a time duration more than a predetermined duration threshold. The central processing unit can be configured to send an alert to a user of the hair dryer, increase a velocity of airflow from the airflow generating element, decrease an output power of the radiation energy source, and/or switch off the radiation energy source. In an example, a multi-stage warning mechanism can be provided where an alert can be sent to the user if an attitude of the hair dryer is maintained unchanged for a first duration threshold, a velocity of airflow from the airflow generating element is increased and/or an output power of the radiation energy source is decreased if an attitude of the hair dryer is maintained unchanged for a second duration threshold which is larger than the first duration threshold, and the radiation energy source is switched off if an attitude of the hair dryer is maintained unchanged for a third duration threshold which is larger than the second duration threshold.

In still another exemplary embodiment, the one or more sensors can include a sensor which is configured to determine the user's contact on the hair dryer (e.g., user holding the handle). In an example, a proximity sensor can be provide to the hair dryer, for example at the handle thereof. A signal can be generated to confirm the user's contact if the user holds the handle and touches the proximity sensor. The hair dryer may not operate if the user does not properly hold the handle. In the exemplary embodiment, the measurement received from the one or more sensors can be indicative of the hair dryer not being held by a user. The central processing unit can be configured to send an alert to the user, increase a velocity of airflow from the airflow generating element, decrease an output power of the radiation energy source, and/or switch off the radiation energy source and/or the airflow generating element.

In still another exemplary embodiment, the one or more sensors can include a hair temperature sensor configured to measure a temperature of user's hair being radiated with the infrared radiation from the radiation energy source. In an example, the hair temperature sensor can be an infrared temperature sensor. The hair temperature sensor can be provided at the housing of the hair dryer, for example in proximity to the airflow outlet of the airflow channel. The hair temperature sensor can also be provided in a space encompassed by the plurality of infrared lamps, as shown in FIG. 10 and FIG. 11. In the exemplary embodiment, the measurement received from the one or more sensors can be indicative of the temperature of the hair being higher than a predetermined temperature. The central processing unit can be configured to send an alert to a user, decrease a total power output of the radiation energy source, and/or increase a velocity of airflow from the airflow generating element, such that a heat damage of the user's hair can be prevented.

In still another exemplary embodiment, the one or more sensors can include a humidity sensor configured to measure a humidity of a surrounding environment in which the hair dryer is operated. In some instances, in order to effectively dry the hair, the power output of the radiation energy source can be increased and/or a velocity of airflow from the airflow generating element can be decreased if a humidity of a surrounding environment is high. The humidity sensor can be provided at the housing of the hair dryer, for example at the inlet of the airflow channel. In the exemplary embodiment, the measurement received from the one or more sensors can be indicative of the humidity of surrounding environment being higher than a predetermined humidity. The central processing unit can be configured to increase a total power output of the radiation energy source and/or decrease a velocity of airflow from the airflow generating element.

The sensors discussed hereinabove can be employed individually or collectively. The measurement from two or more sensors can be combined or fused. Data from one or more sensors can be processed within the context of one another. Data from one or more sensors may be weighted based on precision and/or reliability, etc.

Sensor data, which may include individual sensor data or combined sensor data, can be provided to the central processing unit which regulates an operation of the hair dryer. For instance, the central processing unit can be configured to determine a total output power of the radiation energy source and/or a velocity of the airflow from the airflow generating element based on at least one of the proximity of the hair dryer to the hair, the temperature of the hair being radiated with the infrared radiation, and the humidity of the surrounding environment. The central processing unit can determine parameters of the radiation energy source and/or the airflow generating element by searching a predetermined lookup table. In an example, sensor measurement from the proximity sensor indicates the user is holding the hair dryer too close to the hair and sensor measurement from the hair temperature sensor indicates the hair temperature is greater than a predetermined healthy temperature, then the central processing unit can determine to decrease an output power of the radiation energy source and increase a velocity of the airflow from the airflow generating element, such that the hair temperature can be lowered to a value which is safe and healthy to hair. In another example, sensor measurement from the hair temperature sensor indicates the hair temperature is greater than a predetermined temperature and sensor measurement from the IMU indicates the hair dryer is stationery for a time longer than a predetermined time duration, then the central processing unit can determine to first send an alert to the user, and switch off the radiation energy source if the user does not move the hair dryer in a predetermined time duration.

The measurement from the one or more sensors can be stored in a data storage device which is a either onboard the hair dryer or at a remote cloud. The data storage device can be a flash memory which retains data in the absence of a power supply. The data storage device can also store therein any system error data which can be read by an external device through a wired or wireless manner. In an example, a communication interface can be provided at the housing of the hair dryer (for example at the handle) to facilitate a reading out of the data from the data storage device. The sensor measurement and system error data, which is stored in the data storage device, can enable a maintenance personnel to locate any malfunctional component. The hair dryer can be prohibited to operate unless any error code in the data storage device is cleared by an authorized maintenance personnel.

The hair dryer of the disclosure can be provided with a feedback element configured to provide a tactile feedback based on a measurement received from the one or more sensors. The tactile feedback can include at least one of a visual, an auditory and a haptic feedback. In an example, the feedback element can include a light indicator, for example, one or more light emitting diodes (LED). The LEDs can be arranged in a ring at the housing (e.g., the handle or the body) of the hair dryer. The LEDs can provide various lighting pattern to indicate different status of the hair dryer. The lighting pattern can include at least one of a lighting frequency, a color, and a number of LED being switched on. For instance, the LEDs can flash at a first frequency to indicate a status where the hair dryer is not held by the user, and flash at a second and higher frequency to indicate a status where the hair dryer is maintained stationery for a time duration more than a predetermined duration threshold. In an example, the feedback element can include a vibrator. The vibrator can vibrate at different frequency and/or strength to indicate different status of the hair dryer. In an example, the feedback element can include a speaker or buzzer. In an example, no dedicate feedback element is provided to the hair dryer, however the motor (e.g., the airflow generating element) can drive the impeller at different speed or with different pattern to indicate different status of the hair dryer. For instance, in case the measurement from the proximity sensor indicates the user is holding the hair dryer too close to the hair, the motor can switch the rotating speed thereof between a first high speed to a second low speed at a predetermined frequency, such that a vibrating-like effect can be generated to notify the user.

Figure 14A:
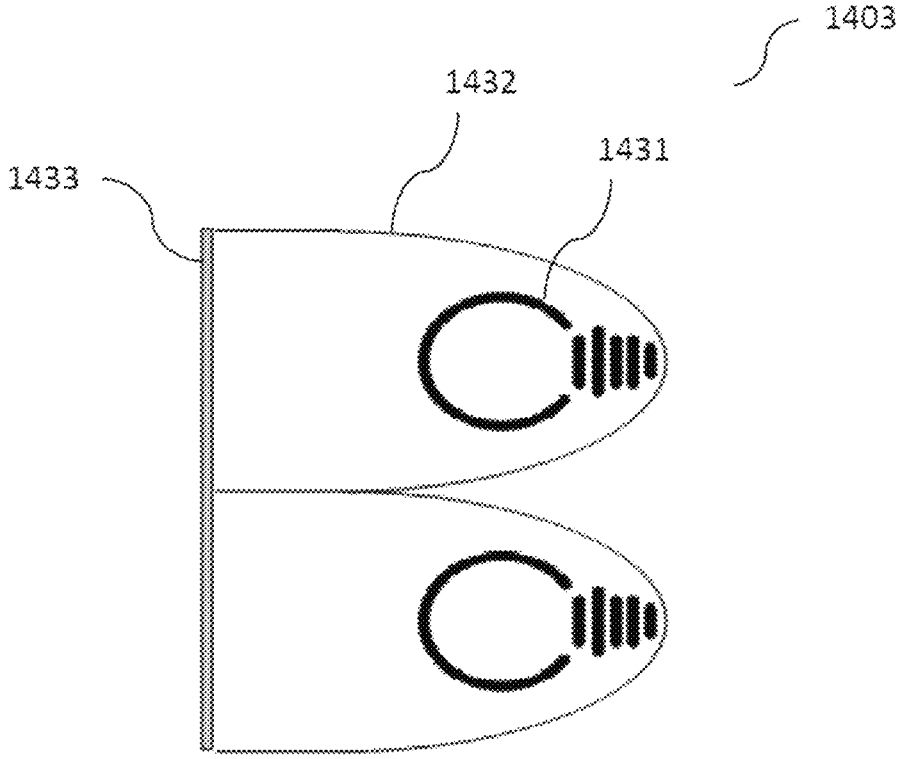
FIG. 14A are cross-sectional views showing exemplary configuration of the radiation energy source in accordance with embodiments of the disclosure.

FIG. 14A show cross-sectional views showing exemplary configuration of the radiation energy source which are used in the hair dryer of the disclosure. A respective radiation energy source 1403 can have a reflector 1432 and a radiation emitter 1431 that is positioned within the reflector. An axial cross section (e.g., a cross section along an axis) and/or a radial cross section (e.g., a cross section perpendicular to an axis) of the reflector can be provided as a parabolic or polynomial shape. In some instances, a profile of the axial cross-section and/or the radial cross section can be a polynomial having multiple segments. For example, a first segment of the profile can be expressed by a polynomial of a first set of parameters, and a second segment of the profile can be expressed by a polynomial of a second set of parameters.

FIG. 14A provides an example of the radiation energy source in which the radiation emitter is a tungsten lamp which contains a filament and a glass bulb. In an exemplary configuration, the tungsten lamp can maintain a certain degree of vacuum. The vacuum can suppress an evaporation and/or oxidation of the filament and expand a life span of the tungsten lamp. The vacuum can also prevent a thermal convection or a thermal conduction between the filament and the glass bulb. In another exemplary configuration, the radiation emitter is a tungsten halogen lamp which contains a filament and a glass bulb. Halogen, inert gas or a mixture thereof can be filled in the tungsten halogen lamp to prevent the evaporation and/or oxidation of the filament and expand a life span of the tungsten halogen lamp. An optical element 1433 can be provided at an opening of the reflector. The optical element can include lens, reflector, prism, grating, beam splitter, filter or a combination thereof. In an exemplary configuration, one single optical element can be provided to the opening of a plurality of the radiation energy sources. The glass bulb of the lamp absorbs a certain frequency range of infrared radiation emitted by the filament inside the lamp and hence heat is accumulated at the glass bulb. Moreover, heat conduction and convection also happen between the filament and the glass bulb. In a configuration where an interior of the reflector is not an absolute vacuum, heat generated at the radiation emitter can be partially transferred to the reflector. At least a portion of the emitted radiation can be absorbed by the inner wall of the reflector. Therefore, a temperature at the reflector can be increased when the radiation energy source is powered. There is a need to manage the operating temperature of the radiation energy source within a predetermined temperature range to expand the life span of the radiation emitter and the reflector, and in the meantime, to avoid adverse effect to the radiation efficiency (e.g., at a temperature lower than the predetermined operating temperature range). For example, excessive heat dissipation from the radiation energy source can cause the operating temperature of the radiation energy source lower than the predetermined operating temperature range, which requires more electrical energy to be converted into thermal energy to maintain the temperature required for black body radiation of the radiation emitter. The disclosure provides a configuration for controlled heat dissipation and operating temperature management of the radiation energy source, where at least one of the one or more radiation energy sources comprise a first portion that is positioned not contacting the airflow channel or the airflow within the airflow channel. The controlled heat dissipation and operating temperature management of the radiation energy source can result in an improved power efficiency which increases an operating duration of the apparatus (e.g., a handheld apparatus powered by battery) after a charging.

Figure 14B:
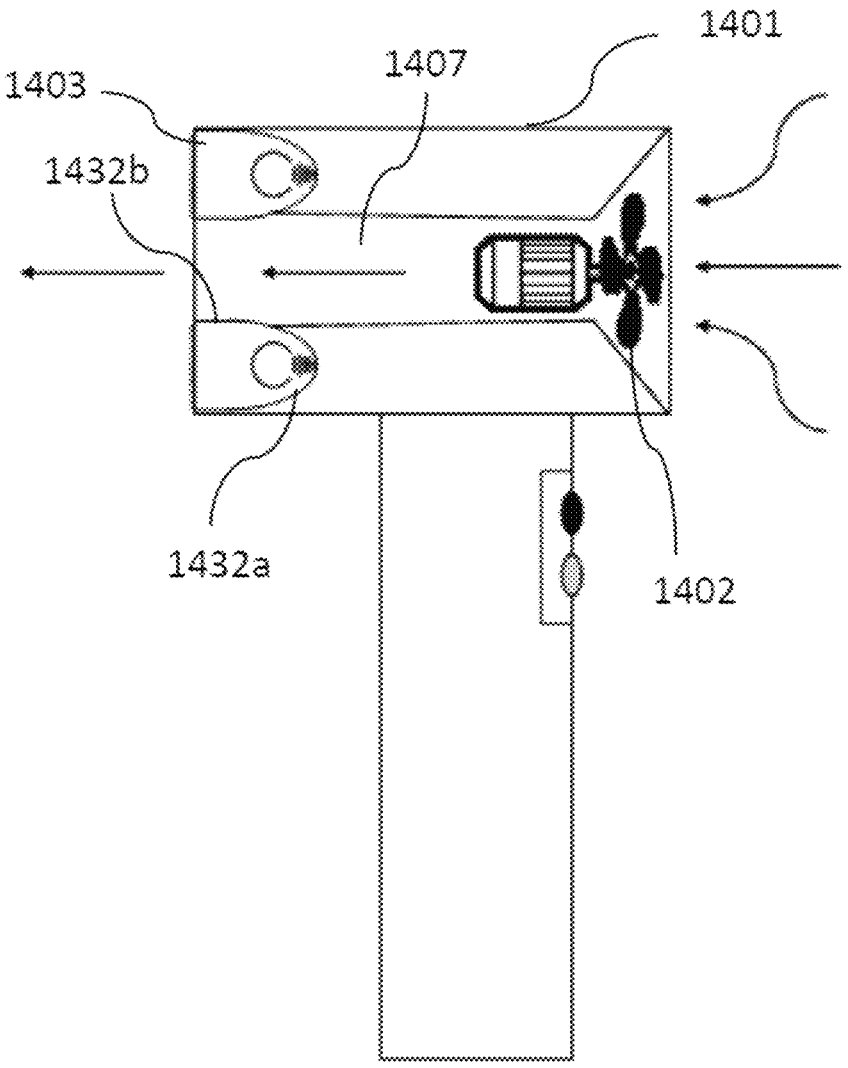
FIG. 14B is a cross-sectional view showing another exemplary hair dryer in accordance with embodiments of the disclosure.

FIG. 14B is a cross-sectional view showing another exemplary hair dryer in accordance with embodiments of the disclosure. The hair dryer can comprise a housing 1401. The housing can include a body and a handle. The housing can be configured to provide an airflow channel 1407 having an airflow inlet and an airflow outlet. An airflow generating element 1402, a radiation energy source 1403 and various other electric and mechanical components can be received in the housing. The airflow generating element can be contained in the housing and configured to effect an airflow through the airflow channel. The one or more radiation energy sources can be configured to generate infrared radiation and direct the infrared radiation toward an exterior of the housing. Examples of the radiation energy sources can include infrared lamp as described in the disclosure. The hair dryer can be powered by a power element (e.g., embedded batteries and/or an external power source) that is configured to provide power at least to the radiation energy source and the airflow generating element. The apparatus can further comprise a controller in connection with the power element and optionally coupled to the one or more radiation energy sources. In some instances, no additional heat source other than the one or more radiation energy sources can be provided to the apparatus.

In some embodiments, at least one of the one or more radiation energy sources can comprise a first portion 1432*a* that is positioned not contacting the airflow channel or the airflow within the airflow channel. The first portion of the radiation energy source can be a portion of an exterior wall of the reflector in the radiation energy source. In some instances, the at least one of the one or more radiation energy sources does not comprise a portion that is positioned to contact the airflow channel or the airflow within the airflow channel. In some embodiments, the at least one of the one or more radiation energy sources can further comprise a second portion 1432*b* that is positioned to contact the airflow channel or the airflow within the airflow channel.

Heat can be transferred from the second portion of the radiation energy source to the airflow channel and/or the airflow within the airflow channel, such that a temperature of the radiation energy source is decreased, and in the meantime, a temperature of the airflow is increased. The radiation energy source having a decreased operating temperature can reduce thermal stress on components of the radiation energy source, resulting in expanded service life of the radiation energy source. Here, the decreased operating temperature can be maintained within a temperature range that does not adversely affect the generation of radiation by the radiation energy source (e.g., a temperature range maintaining the black body radiation of the radiation emitter). Further, the radiation energy source having a decreased operating temperature can avoid the housing of the hair dryer from being over-heated to thereby improve user experience of the hair dryer. The controlled operating temperature of the radiation energy source can also extend the running time of a cordless, battery operated hair dryer. On the other hand, the airflow having increased temperature (e.g., 1 to 3 degrees) can contribute to evaporation of water from wet object and reduce the relative humidity around the object, which further accelerates the evaporation of water from the object.

As used here, the term "contact" can mean physically contact (e.g., directing coupling, engaging, touching or otherwise associated with) or thermally contact (e.g., transferring heat via a thermal coupling therebetween). The first portion of the radiation energy source not contacting the airflow channel or the airflow can mean the first portion does not substantially affect, exert influence on or change a parameter of the airflow in the airflow channel. The second portion of the radiation energy source contacting the airflow channel or the airflow can mean the second portion substantially affect, exert influence on or change a parameter of the airflow in the airflow channel. The parameter of the airflow can include, but not limited to, a temperature, a volume, a velocity, a velocity distribution, a field area, a resistance, a pressure, a direction, a vortex, and a divergence of the airflow.

The second portion of the at least one of the one or more radiation energy sources can contact the airflow channel via a physical coupling. In some instances, the second portion of the radiation energy source can directly contact an outer or inner wall of the airflow channel, form at least a portion of the airflow channel, be integral with at least a portion of the airflow channel, or be a portion of the airflow channel. A surface of the second portion can follow a contour of the outer or inner wall of the airflow channel. In some instances, the second portion of the radiation energy source can contact the airflow channel via a thermal coupling. Heat can transfer from the radiation energy source to the airflow channel and/or airflow within the airflow channel via the physical contact or the thermal coupling. In an example, the first portion can have a larger surface area than the second portion, or vice versa. Additionally or alternatively, the second portion can partially protrude into the airflow channel. For instance, a protruding member (e.g., a fin) can extend from the second portion of the radiation energy source into an interior of the airflow channel, in which configuration the second portion of the radiation energy source either physically connects a wall of the airflow channel or not. The protruding member can be made of a material having a high thermal conductivity, thereby transferring heat from the radiation energy source to the airflow channel and/or airflow within the airflow channel. The material having a high thermal conductivity can include, for example, silver, copper, gold, aluminum Nitride, silicon carbide, aluminum, tungsten, graphite or Zinc.

Aspects of the disclosure also provides a method for drying an object. The method can comprise providing an airflow channel, via a housing, the airflow channel having an airflow inlet and an airflow outlet; effecting an airflow, via an airflow generating element contained in the housing, through the airflow channel; generating an infrared radiation, via one or more radiation energy sources, and directing the infrared radiation toward an exterior of the housing; and providing power, via a power element to at least the radiation energy source and the airflow generating element. In some embodiments, at least one of the one or more radiation energy sources can comprise a first portion that is positioned not contacting the airflow channel.

Figure 15A:
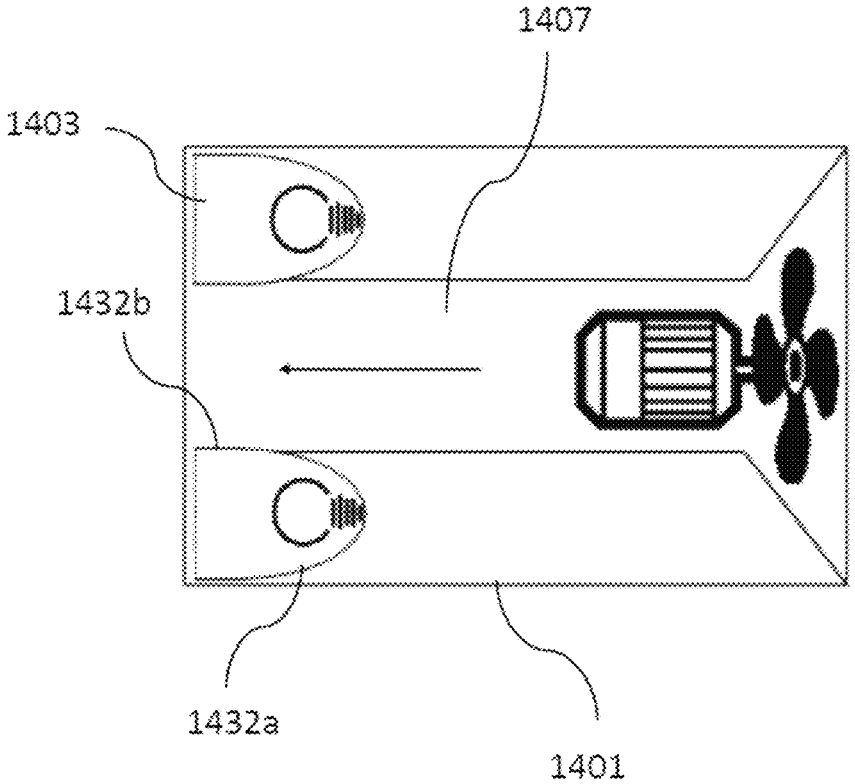
FIG. 15A to FIG. 15C are views showing exemplary configuration of the radiation energy source(s) with respect to the airflow channel in accordance with some embodiments of the disclosure.
Figure 15A:
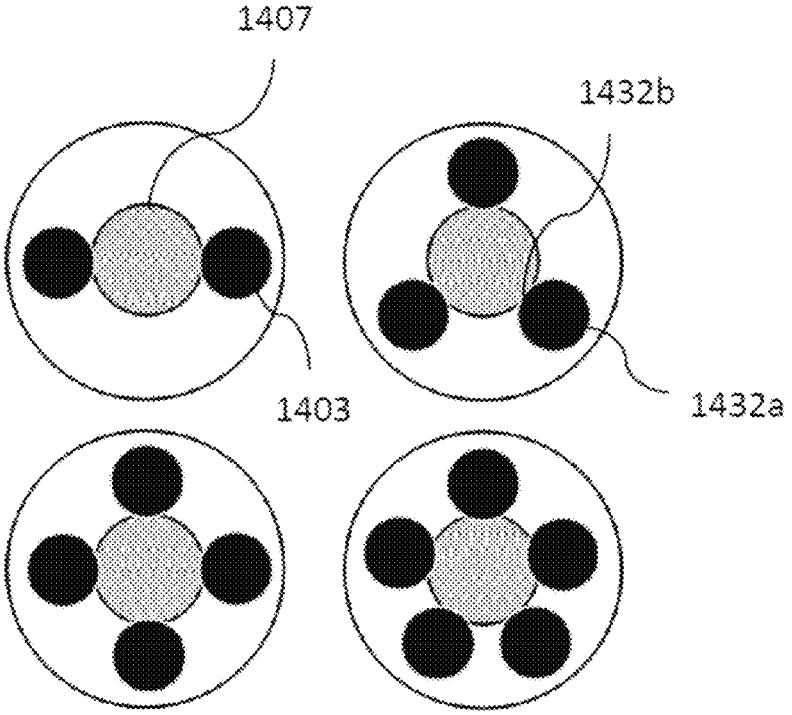
Figure 15B:
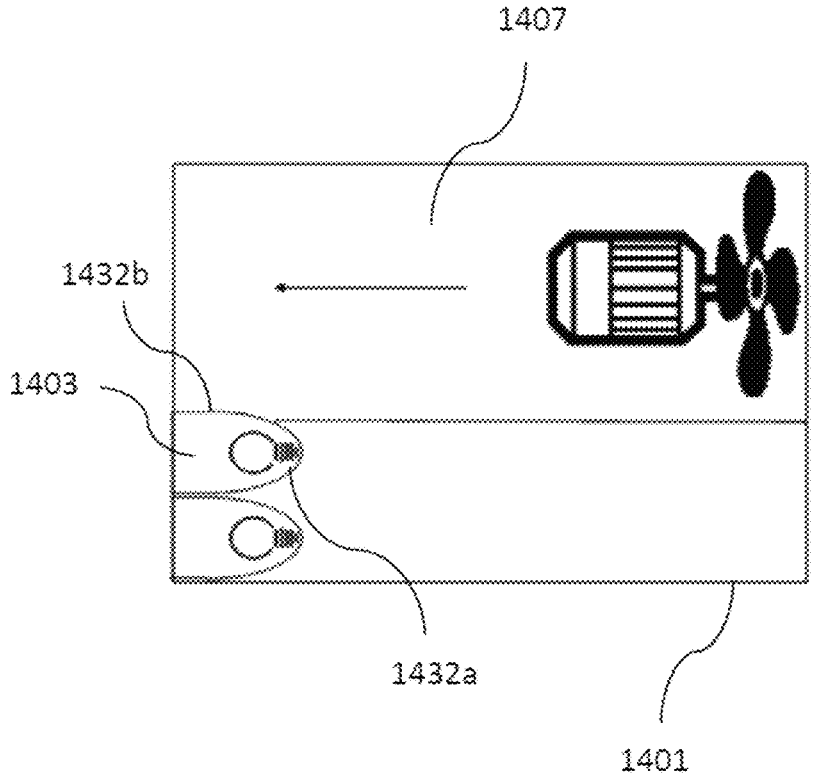
Figure 15B:
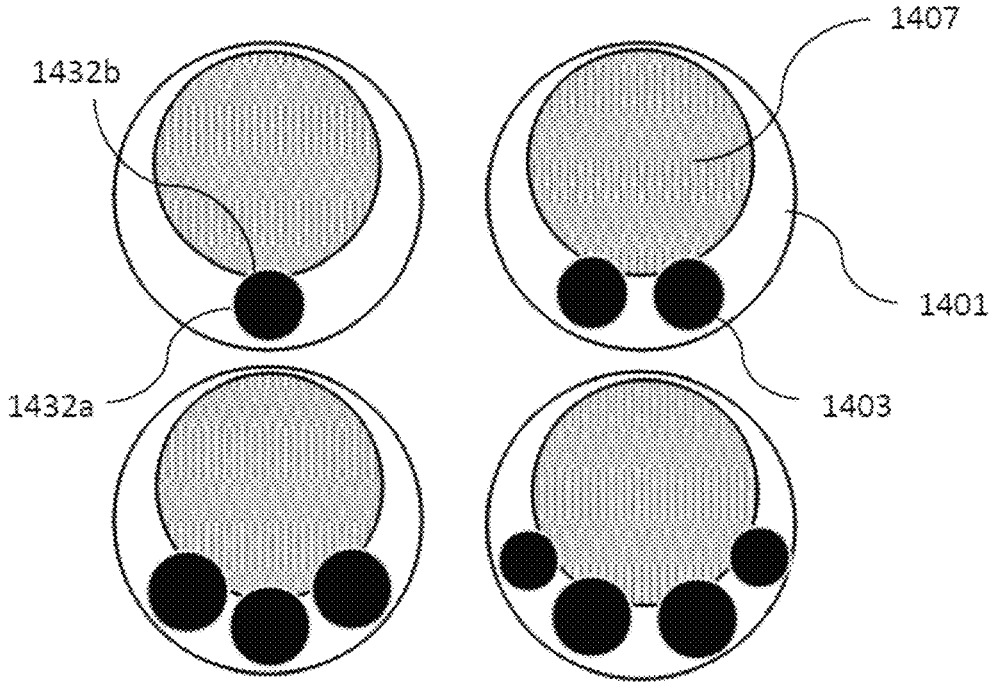
Figure 15C:
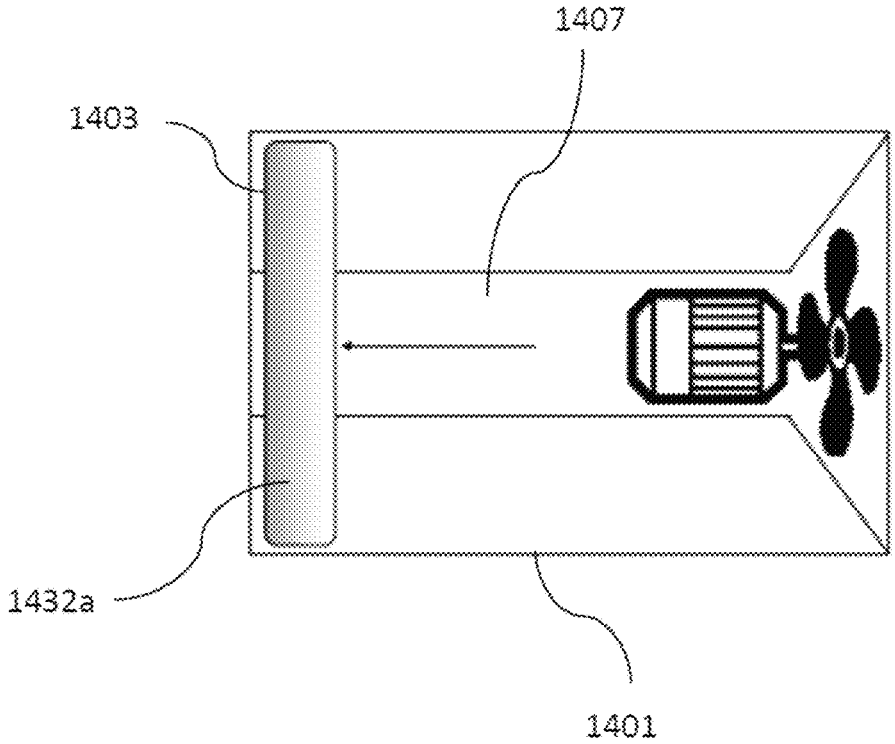
Figure 15C:
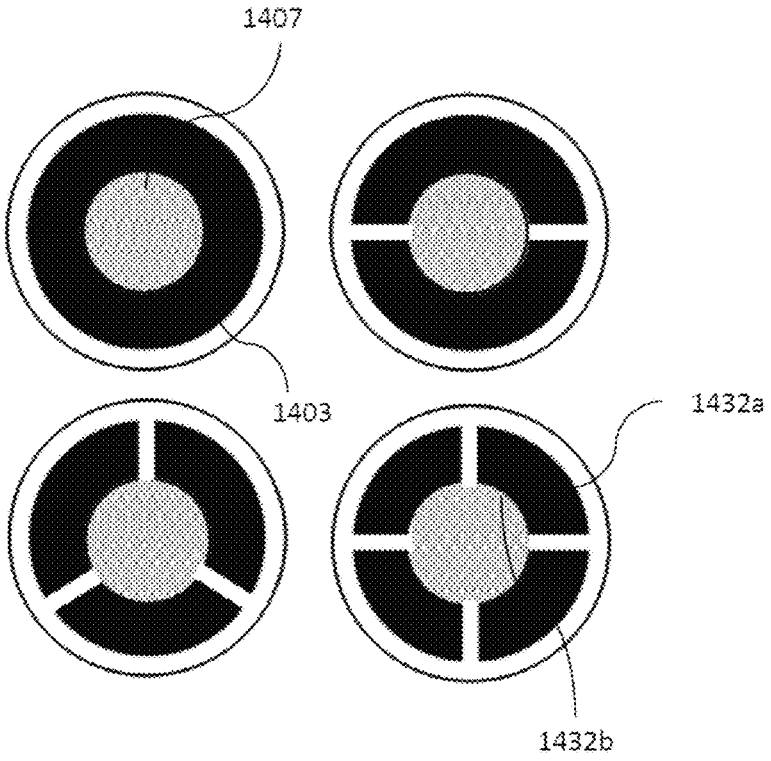

FIG. 15A to FIG. 15C show exemplary configuration of the radiation energy source(s) with respect to the airflow channel in which at least one of the one or more radiation energy sources 1403 is positioned between the airflow channel 1407 and the housing 1401. Panels A are schematic views, and panels B are various exemplary cross-sectional view of panels A. The one or more radiation energy sources can be positioned in various configuration with respect to the airflow channel. For instance, panel B in FIG. 15A shows the radiation energy sources positioned along an outer peripheral of the airflow channel. In an example, the one or more radiation energy sources can be positioned along an outer peripheral of the airflow outlet. For instance, panel B in FIG. 15B shows the one or more radiation energy sources positioned in juxtaposition to the airflow channel. In an example, the one or more radiation energy sources can be positioned in juxtaposition to the airflow outlet. The one or more radiation energy sources can be arranged in an array. The one or more radiation energy sources can be provided in various shapes such as a circular shape, a ring shape or an arc shape. Panel B in FIG. 15C shows the radiation energy sources in a ring shape or arc shapes (e.g., a central angle substantially 180 degrees, 120 degrees or 90 degrees). A controller in connection with the power element can be positioned along a peripheral of the airflow channel. A contour (e.g., inner surface) of the controller follows a contour of the airflow channel. For instance, the controller (e.g., a circuit board) can be provided as a circular band which wraps around an outer wall of the airflow channel.

At least one of the one or more radiation energy sources 1403 can comprise a first portion 1432*a* that is positioned not contacting the airflow channel or the airflow within the airflow channel. In the exemplary embodiments of FIG. 15A to FIG. 15C, the first portion can be a portion facing away from the airflow channel or being positioned closer to the housing than to the airflow channel. In some embodiments, the at least one of the one or more radiation energy sources does not have a portion that is positioned contacting the airflow channel or the airflow. For instance, at least one radiation energy sources from among the radiation energy sources that are positioned in juxtaposition to the airflow channel does not have a portion that is positioned contacting the airflow channel. In some embodiments, the at least one radiation energy source can further comprise a second portion 1432*b* that is positioned to contact the airflow channel or the airflow within the airflow channel. Note that in FIG. 15C, the second portion can be a side of the radiation energy sources 1403 that is opposite to the first portion 1432*a*, which second portion is not seen in panel A of FIG. 15C. In an example, the second portion can physically contact an outer wall of the airflow channel. In another example, the second portion can be formed integral with an outer wall of the airflow channel. In yet another example, the second portion can form at least a portion of an outer wall of the airflow channel. In still another example, the second portion can be thermally coupled to an outer wall of the airflow channel while the second portion not physically contacts the airflow channel. The thermal coupling can be effected by a thermal coupling member connecting the second portion and the airflow channel. Heat can therefore transfer from the second portion 1432*b* of the at least one radiation energy source to maintain or decrease an operating temperature of the radiation energy source within a predetermined range.

Figure 16A:
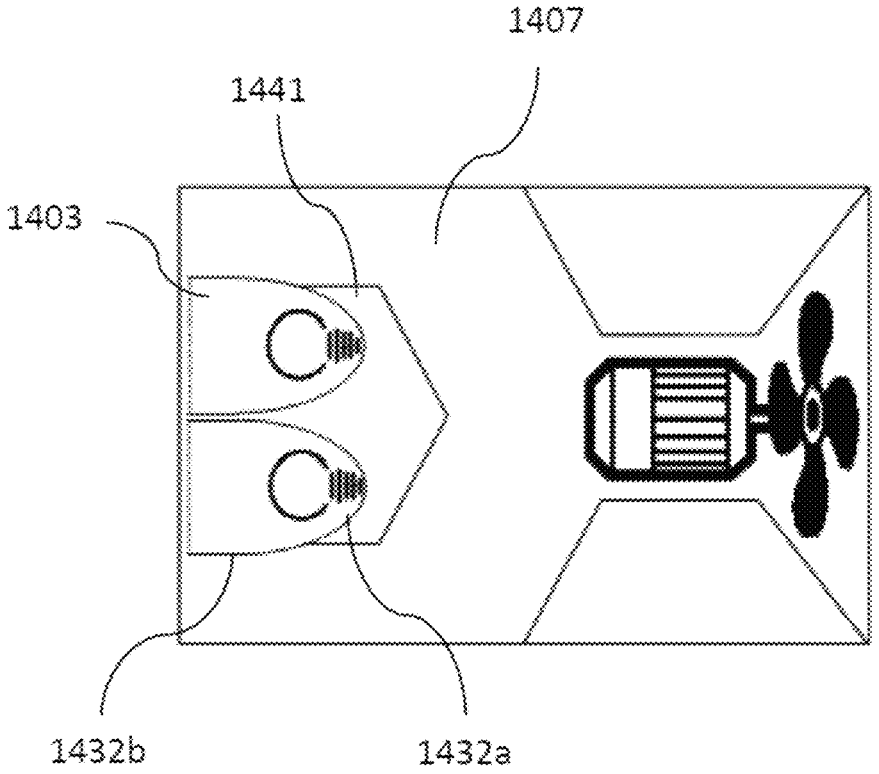
FIG. 16A to FIG. 16C are views showing exemplary configuration of the radiation energy source(s) with respect to the airflow channel in accordance with other embodiments of the disclosure.
Figure 16A:
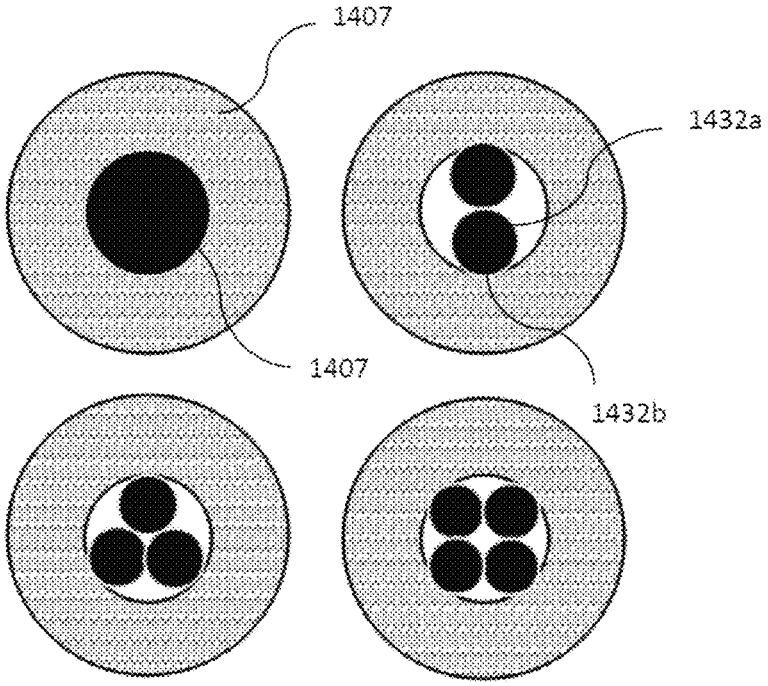
Figure 16B:
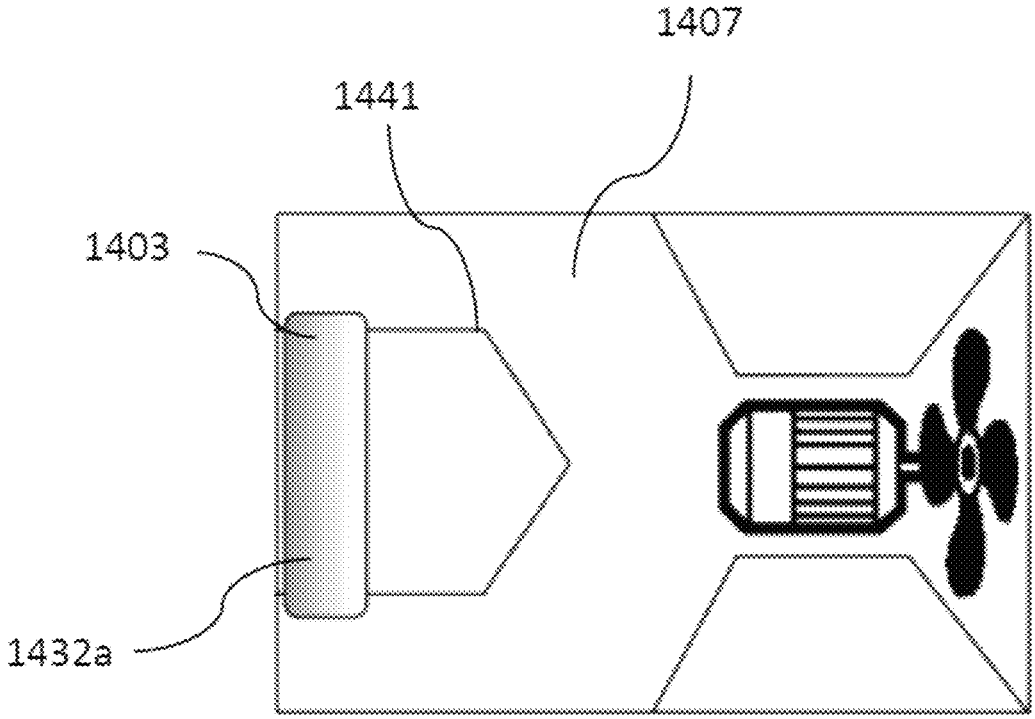
Figure 16B:
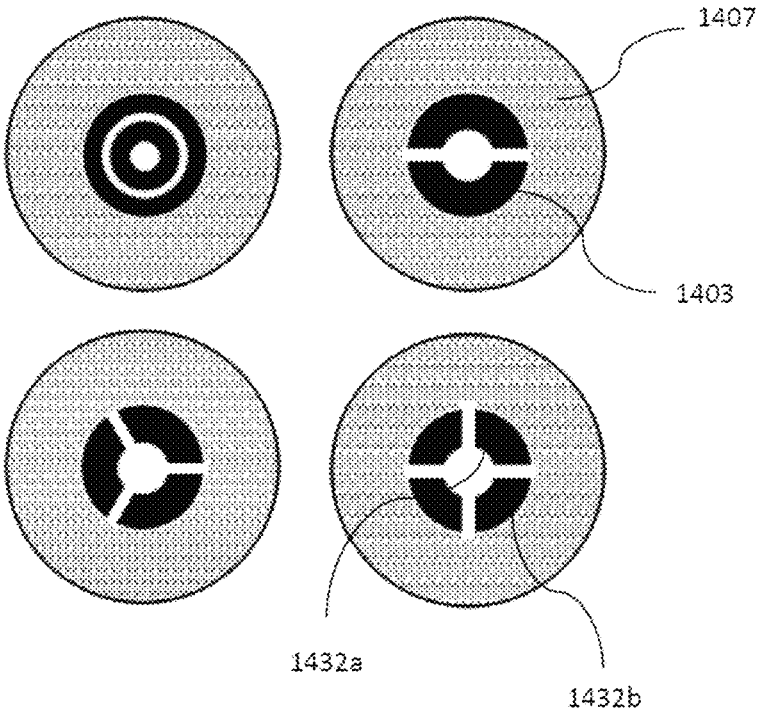
Figure 16C:
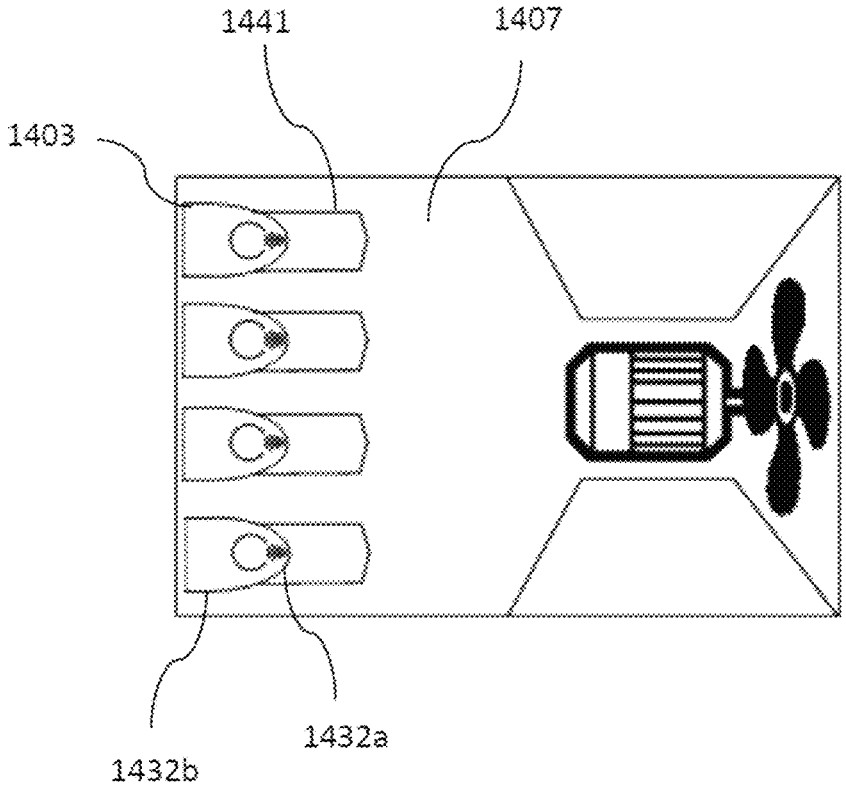
Figure 16C:
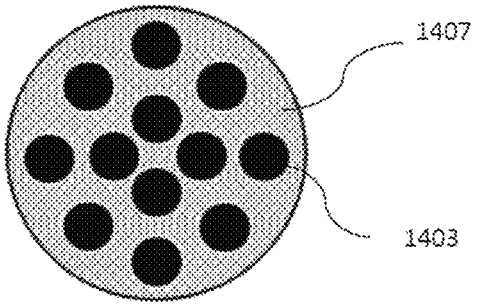
Figure 16C:
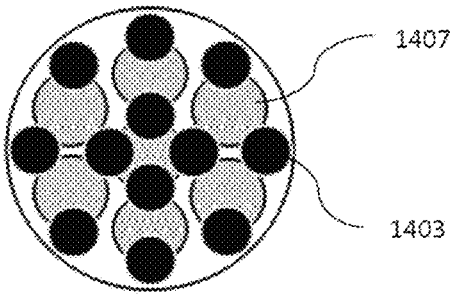

FIG. 16A to FIG. 16C show exemplary configuration of the radiation energy source(s) with respect to the airflow channel in which at least one of the one or more radiation energy sources 1403 is positioned within the airflow channel 1407. Panels A are schematic views, and panels B and C are various exemplary cross-sectional views of panels A. As used here, the term "positioned within" can mean at least one of the one or more radiation energy sources is within an area of the airflow channel as viewed in a cross sectional view of the hair dryer. The one or more radiation energy sources can be provided in various shapes such as a circular shape (e.g., as shown in FIG. 16A or FIG. 16C), a ring shape or an arc shape (as shown in FIG. 16B).

In an exemplary configuration, one airflow channel can be provided in the housing. The one or more radiation energy sources can be positioned within an area of the airflow channel. For instance, the one or more radiation energy sources can be positioned substantially at a geometrical center of the airflow channel, as shown in FIG. 16A and FIG. 16B. For instance, the plurality of radiation energy sources can be distributed within an area of the airflow channel, as shown in panel B in FIG. 16C. In another exemplary configuration, as shown in panel C of FIG. 16C, a plurality of airflow channels can be provided in the housing, one of the airflow channels being apart from another. An area of one radiation energy source can at least partially overlay with an area of one airflow outlet.

The at least one radiation energy source can be at least partially contained in a chamber 1441, thereby at least a first portion 1432*a* of the at least one radiation energy source is positioned within the chamber and thus does not contact the airflow within the airflow channel. In the examples shown in FIG. 16A and FIG. 16B, the plurality of radiation energy sources can be collectively enclosed at least in part within a common chamber. In the example shown in FIG. 16C, the plurality of radiation energy sources can each be enclosed at least in part within a separate chamber. In some embodiments, the at least one radiation energy source can be entirely contained in the chamber, thereby no portion of the radiation energy source contacts the airflow. In some embodiments, a second portion 1432*b* of the at least one radiation energy source can be positioned not enclosed by the chamber, thereby contacting the airflow within the airflow channel.

The chamber can have at least one opening towards an exterior of the apparatus. The chamber can be configured to isolate at least a portion of the radiation energy sources. The chamber can further receive a portion of at least one of a controller, the power element or a sensor. The controller, which is in connection with the power element and the radiation energy sources, can also be positioned in the airflow channel, in which case a contour of an outer wall of the controller can follows a contour of an inner wall of the airflow channel. The airflow can flow through a passage between the airflow channel and the chamber. At least a portion of the chamber contacting the airflow can be streamlined to reduce a resistance of airflow. The chamber can comprise a cooling element configured to dissipate heat generated by the radiation energy source that is partially or entirely contained therein. For instance, one or more fins can protrude from an exterior of the chamber and transfer heat from the radiation energy source into the airflow, thereby decrease or maintain an operating temperature of the radiation energy source within a predetermined range.

The chamber can be positioned within the airflow channel by a supporting structure. The supporting structure can include arms extending from an internal wall of the apparatus housing to support the chamber in a predetermined position within an interior of the airflow channel. The chamber can be coupled to at least one of the housing or the airflow channel by an airflow guiding member. The airflow guiding member can be configured to guide the airflow in the airflow channel.

Aspects of the disclosure provides an apparatus for drying an object having a thermal coupling that is configured to dissipate heat from the radiation energy source. The apparatus can comprise a housing configured to provide an airflow channel having an airflow inlet and an airflow outlet; an airflow generating element contained in the housing and configured to effect an airflow through the airflow channel; one or more radiation energy sources contained in the housing and configured to generate an infrared radiation and direct the infrared radiation toward an exterior of the housing; a thermal coupling coupled to at least one of the one or more radiation energy sources and configured to dissipate heat from the at least one of the one or more radiation energy source; and a power element configured to provide power at least to the radiation energy sources and the airflow generating element.

The thermal coupling can effect heat dissipation from the at least one of the one or more radiation energy sources to which the thermal coupling is coupled. In some instances, the radiation energy source can physically contact either an outer or inner wall of the airflow channel, the housing of the apparatus and/or the airflow generating element. The thermal coupling can comprise a portion of the radiation energy source which physically contact the airflow channel, the housing of the apparatus or the airflow generating element. In some instances, the radiation energy source does not physically contact either one of the airflow channel, the housing of the apparatus or the airflow generating element. The thermal coupling can comprise a thermal coupling member which is coupled to or integral with the radiation energy source and either one of the airflow channel, the housing of the apparatus or the airflow generating element. In an example, the thermal coupling can be made of the same material with the airflow generating element, the housing or the airflow channel and/or have the same thermal expansion property with the airflow generating element, the housing or the airflow channel. In an example, the thermal coupling can be coupled to a support that is connected to the airflow generating element, the housing or the airflow channel. In an example, the thermal coupling can dissipate heat by at least one of a heat conduction or a heat convection.

Aspects of the disclosure also provides a method for drying an object. The method can comprise providing an airflow channel, via a housing, the airflow channel having an airflow inlet and an airflow outlet; effecting airflow, via an airflow generating element contained in the housing, through the airflow channel; generating infrared radiation, via one or more radiation energy sources contained in the housing, and directing the infrared radiation toward an exterior of the housing; dissipating heat, via a thermal coupling coupled to at least one of the one or more radiation energy sources, of the at least one of the one or more radiation energy source; and providing power, via a power element to at least the radiation energy source and the airflow generating element.

Figure 17:
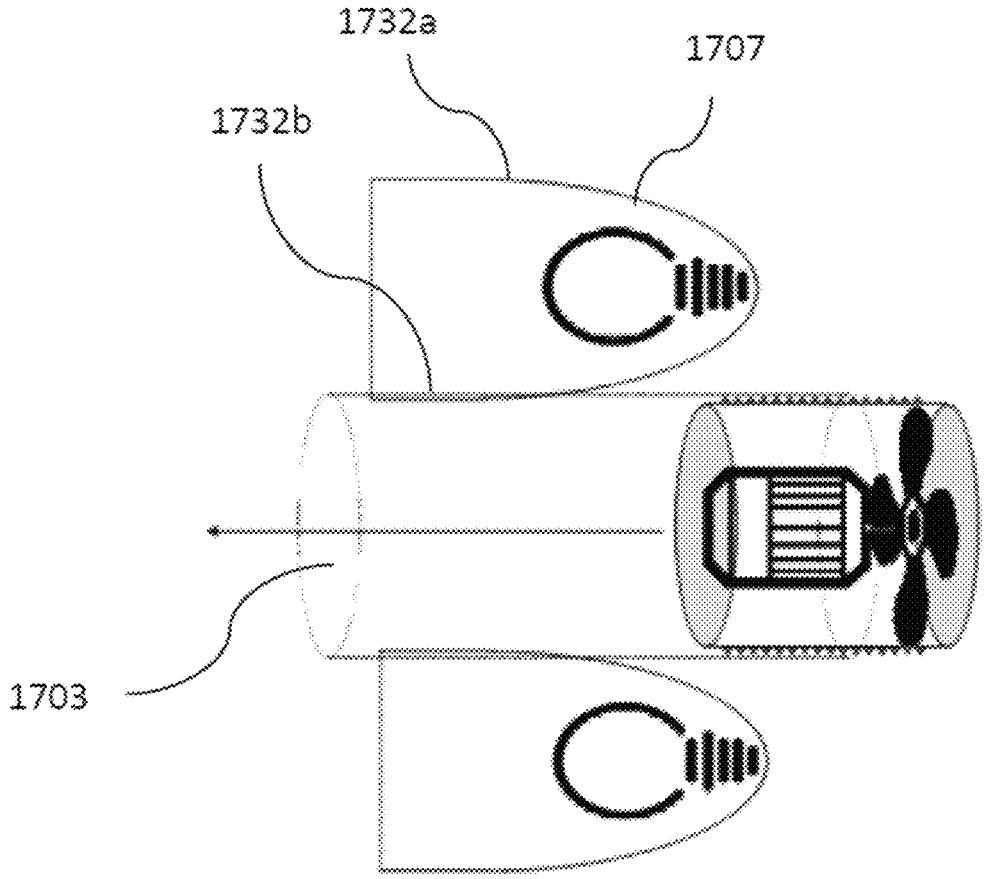
FIG. 17 is a schematic view showing exemplary configuration of an apparatus having a thermal coupling in accordance with some embodiments of the disclosure.

FIG. 17 shows an exemplary configuration of an apparatus in which the thermal coupling comprises a second portion 1732*b* of the at least one of the one or more radiation energy sources 1707 that is positioned to contact the airflow channel 1703. The second portion can be an area of the radiation energy source at which the radiation energy source is coupled to an outer wall (e.g., the radiation energy source is positioned between the airflow channel and the housing of the apparatus) or an inner wall (e.g., the radiation energy source is positioned in an interior of the airflow channel) of the airflow channel. In some instances, the radiation energy source can be welded or adhered or otherwise affixed to the airflow channel at the second portion. In some instances, at least a part of the second portion can form a portion of either the outer wall or inner wall of the airflow channel. In some instances, the second portion can at least partially protrude into the airflow channel. The protruding part of the second portion can comprise an airflow guide that is configured to regulate a property (e.g., direction, volume, velocity, a velocity distribution, a field area, a resistance, a direction, a vortex, pressure, and a divergence, etc.) of the airflow. In an example, the protruding part of the second portion can be in proximity to the airflow outlet. Heat can be dissipate from the radiation energy source to the airflow channel and/or the airflow in the airflow channel by a heat conduction, thereby decreasing or maintaining an operating temperature of the radiation energy source within a predetermined temperature range and/or increasing a temperature of the airflow in the airflow channel. An area of the second portion can be determined by a heat dissipation efficiency and an operating temperature of the radiation energy source. Though the radiation energy source is coupled to airflow channel in the example of FIG. 17, the radiation energy source can be coupled to either the housing of the apparatus or the airflow generating element at the second portion, such that heat can be transferred from the radiation energy source to the housing of the apparatus or the airflow generating element.

Figure 18A:
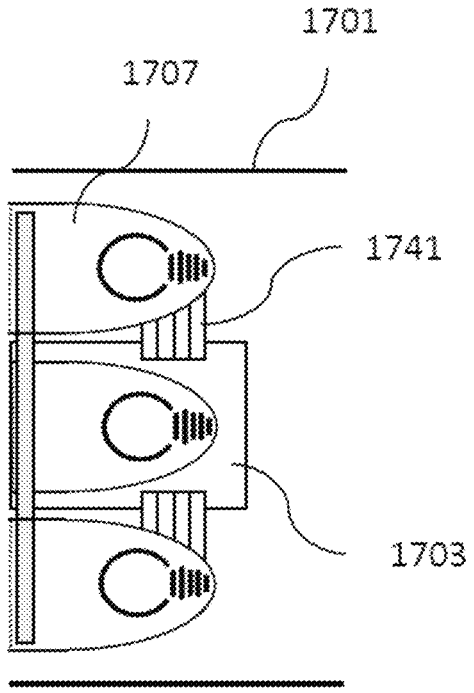
FIG. 18A to FIG. 18D are views showing exemplary configuration of an apparatus having a thermal coupling in accordance with other embodiments of the disclosure.
Figure 18B:
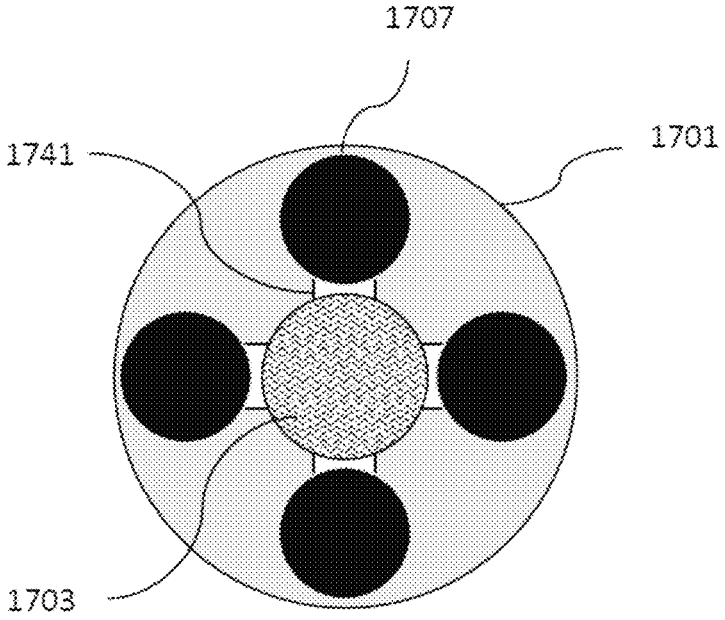

FIG. 18A is a cutaway lateral view, and FIG. 18B is a cross-sectional view of FIG. 18A, showing an exemplary configuration of an apparatus in which the thermal coupling comprises a thermal coupling member. In some instances, the thermal coupling member 1741 can be an integral part of the at least one of the one or more radiation energy sources and thermally coupled with the airflow channel 1703, the airflow generating element or the housing of the apparatus. In some instances, the thermal coupling member 1741 can be an integral part of the airflow channel, the airflow generating element and/or the housing of the apparatus and thermally coupled with the radiation energy source. Heat can be transferred from the radiation energy source to the airflow channel, the airflow generating element and/or the housing of the apparatus by heat conduction, thereby decreasing or maintaining an operating temperature of the radiation energy source and/or increasing a temperature of the airflow. The thermal coupling member can comprise a material with a thermal conductivity of at least 20, 50, 100, 150, 200, 250, 300, 350, 400, 450, 500 watts per meter-kelvin (W/(mK)) or higher. The material having a high thermal conductivity can include, for example, silver, copper, gold, aluminum Nitride, silicon carbide, aluminum, tungsten, graphite or Zinc. In some instances, the thermal coupling member can be a cooling member or a heat sink.

In some embodiments, the at least one of the one or more radiation energy sources can physically not contact the airflow channel, the airflow generating element and/or the housing of the apparatus. In other words, the radiation energy source does not comprise a portion that is positioned to contact the airflow channel, the airflow generating element and/or the housing of the apparatus. The thermal coupling member can be coupled between arbitrary portion of the radiation energy source and the airflow channel, the airflow generating element and/or the housing of the apparatus. More than one thermal coupling member can be coupled to one radiation energy source. In some embodiments, the at least one of the one or more radiation energy sources can partially contact the airflow channel, the airflow generating element and/or the housing of the apparatus. In other words, the at least one of the one or more radiation energy sources can have a first portion that is positioned not contacting the airflow channel, the airflow generating element and/or the housing of the apparatus and a second portion that contacts the airflow channel, the airflow generating element and/or the housing of the apparatus. The thermal coupling member can be coupled between the first portion of the radiation energy source and the airflow channel, the airflow generating element and/or the housing of the apparatus.

In the example in FIG. 18A and FIG. 18B, the at least one of the one or more radiation energy sources 1707 can be positioned between the apparatus housing 1701 and the airflow channel 1703. The thermal coupling member or cooling member 1741 can be thermally coupled between at least one of the one or more radiation energy sources 1707 and at least one of an out wall of the airflow channel 1703 and the housing 1701 of the apparatus, and configured to dissipate heat from the at least one of the one or more radiation energy sources. In other examples, the at least one radiation energy source can be positioned in the airflow channel (e.g., the radiation energy source is at least partially enclosed in a chamber, as discussed in FIG. 16A to FIG. 16C). In such configuration, the thermal coupling member can be provided as long as a portion thereof contacts the airflow, such that the heat from the at least one radiation energy source can be dissipated. The thermal coupling member can be optionally thermally coupled between the at least one radiation energy source and at least one of an inner wall of the airflow channel, the chamber wall or the chamber, thereby conducting heat from the at least one radiation energy source to the least one of an inner wall of the airflow channel, the chamber wall or the chamber. Though the example in FIG. 18A and FIG. 18B shows the at least one radiation energy source does not physically contact the airflow channel, in some other examples, the at least one radiation energy source can physically contact the airflow channel at a second portion thereof, and the thermal coupling member or cooling member can be a thermal coupling in addition to the second portion of the at least one radiation energy source.

Figure 18C:
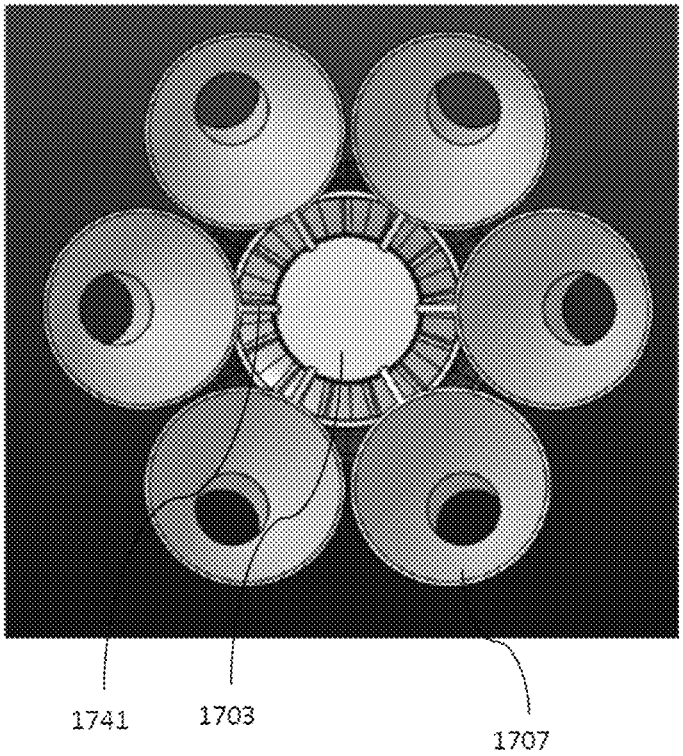
Figure 18D:
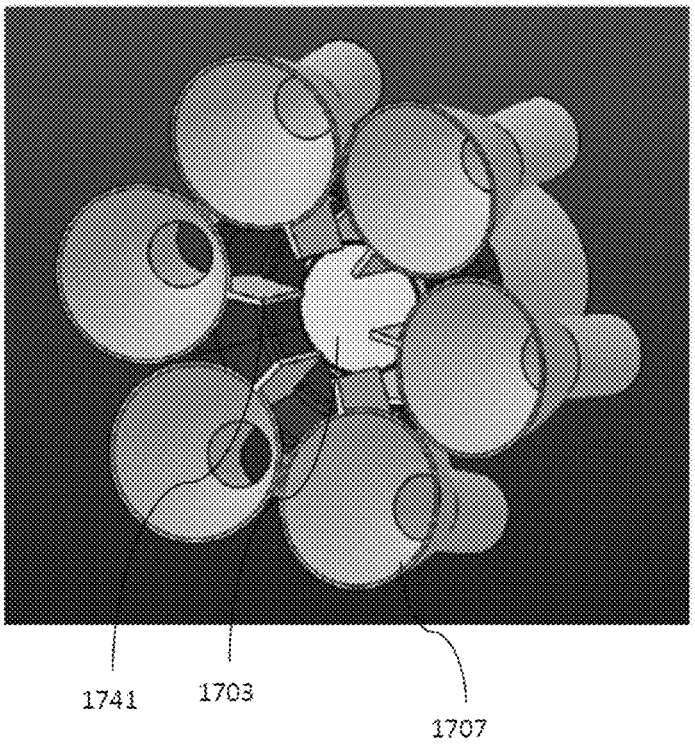

In the example of FIG. 18C and FIG. 18D, the thermal coupling member 1741 can at least partially protrudes into the airflow channel 1703. The protruding part of the thermal coupling member can comprise an airflow guide, such as a fin. The airflow guide can be configured to regulate a property (e.g., a volume, a velocity, a velocity distribution, a field area, a resistance, a pressure, a direction, a vortex, and a divergence, etc.) of the airflow. In some instances, the protruding part of the thermal coupling member can be positioned at a downstream of the airflow with respect to the airflow generating element. The axis of the respective parabolic or polynomial reflector in the plurality of radiation energy sources can intersect with each other, thereby radiation exiting the plurality of radiation energy sources can at least partially overlap at a predetermined distance in front of the apparatus.

Figure 19A:
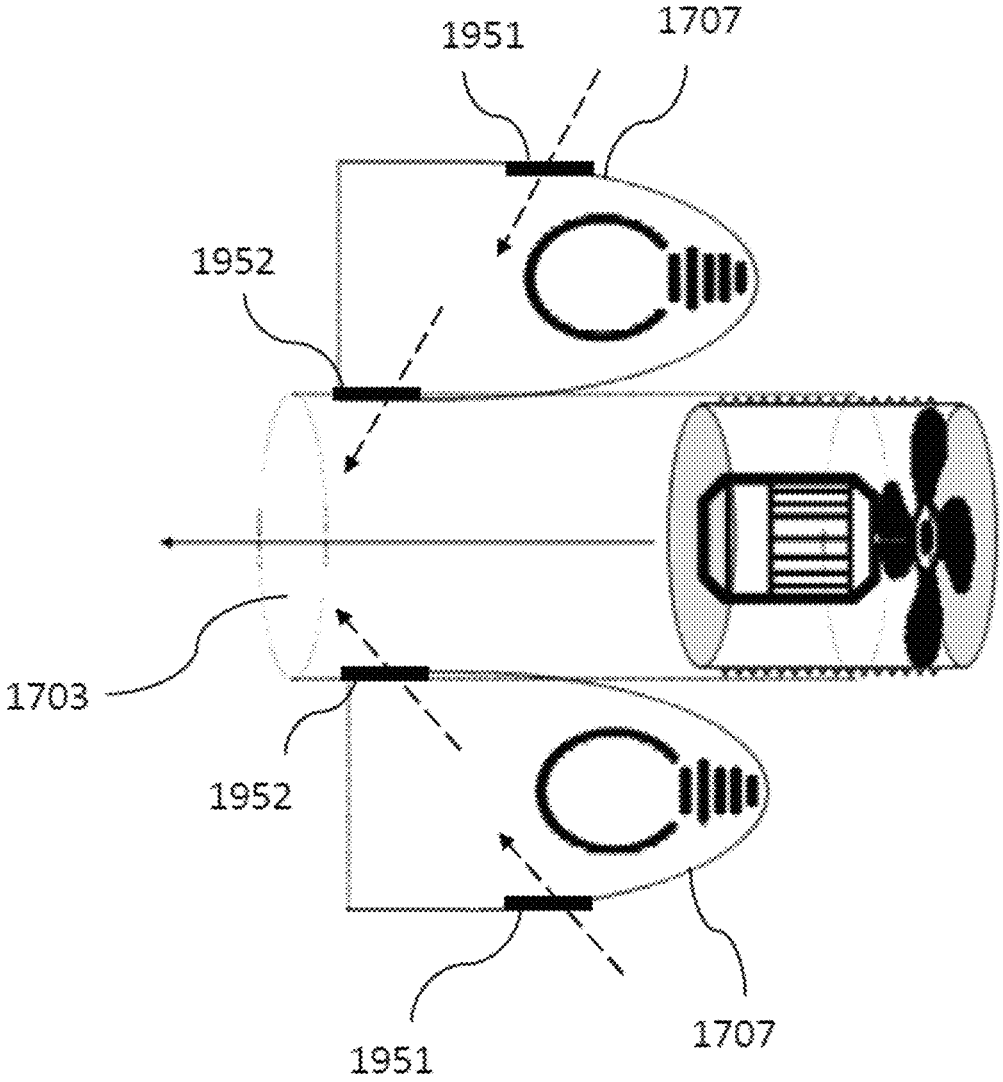
FIG. 19A to FIG. 19C are schematic views showing exemplary configuration of an apparatus having a thermal coupling in accordance with still other embodiments of the disclosure.
Figure 19B:
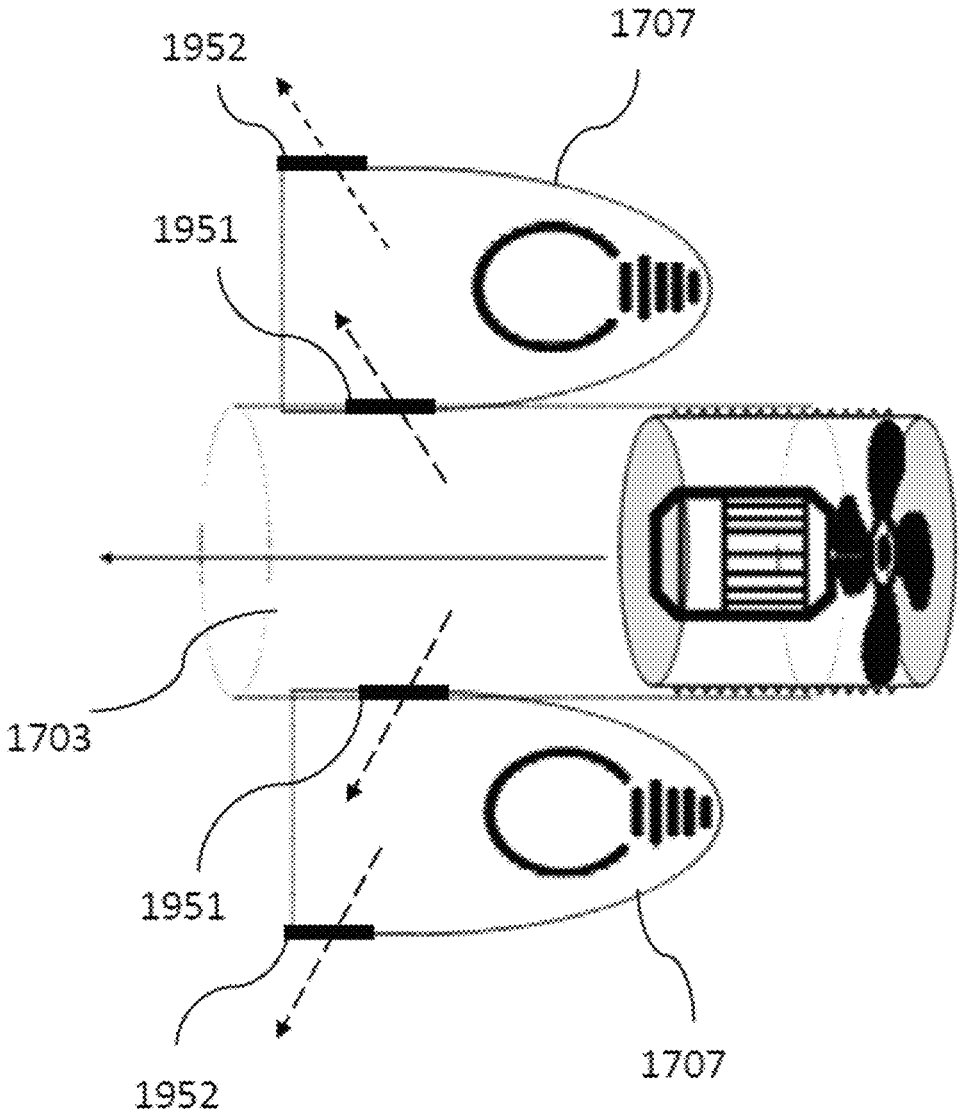
Figure 19C:
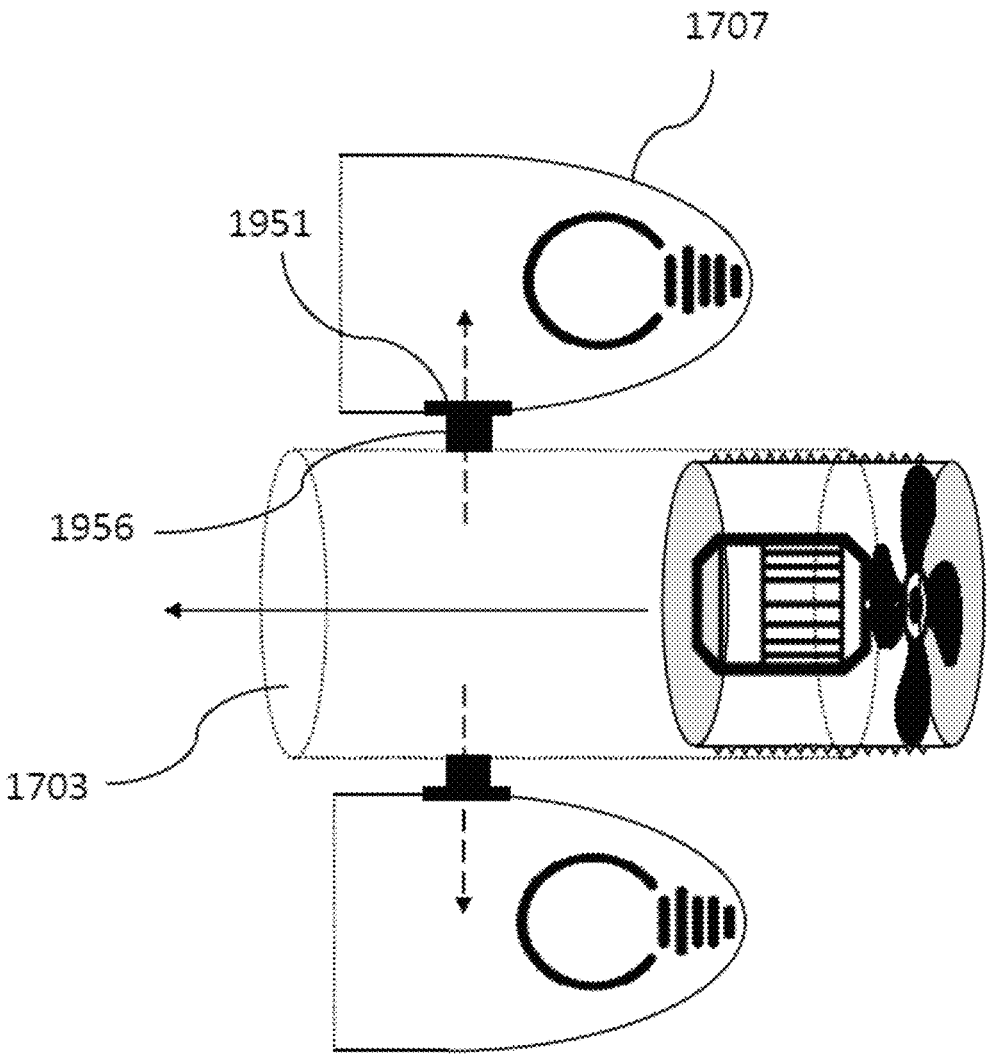
Figure 20A:
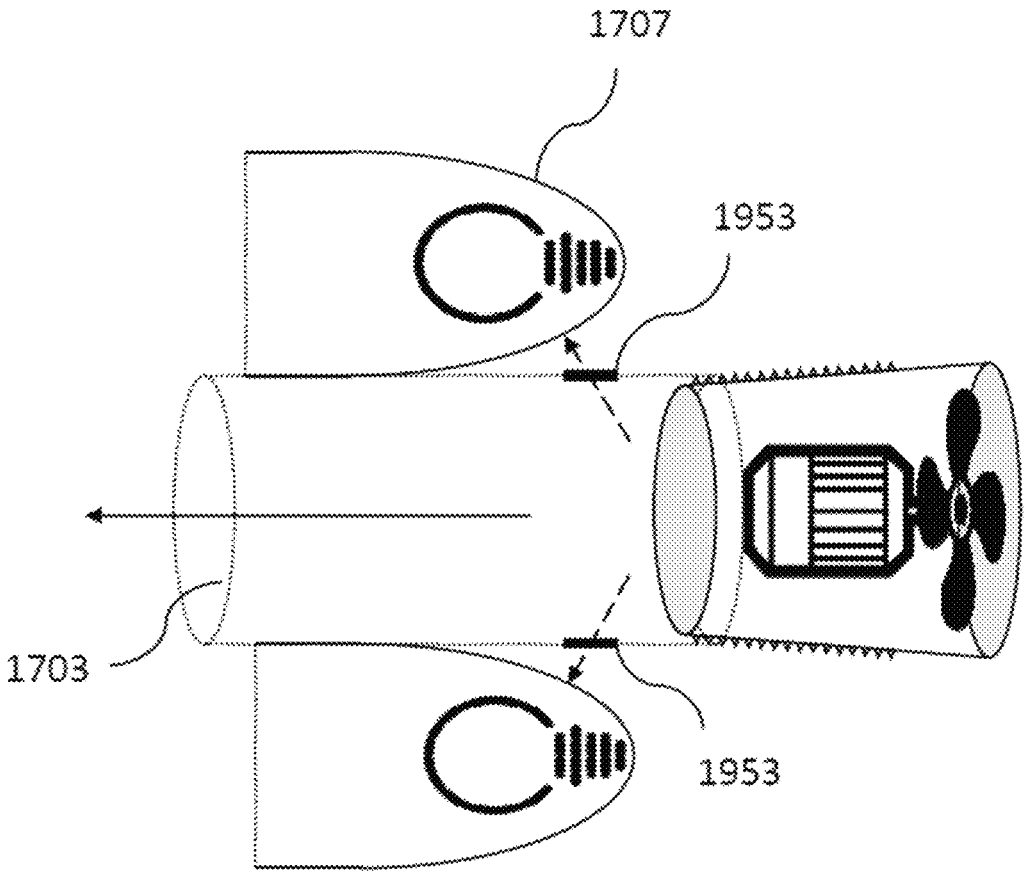
FIG. 20A to FIG. 20D are schematic views showing exemplary configuration of an apparatus having a thermal coupling in accordance with yet other embodiments of the disclosure.
Figure 20B:
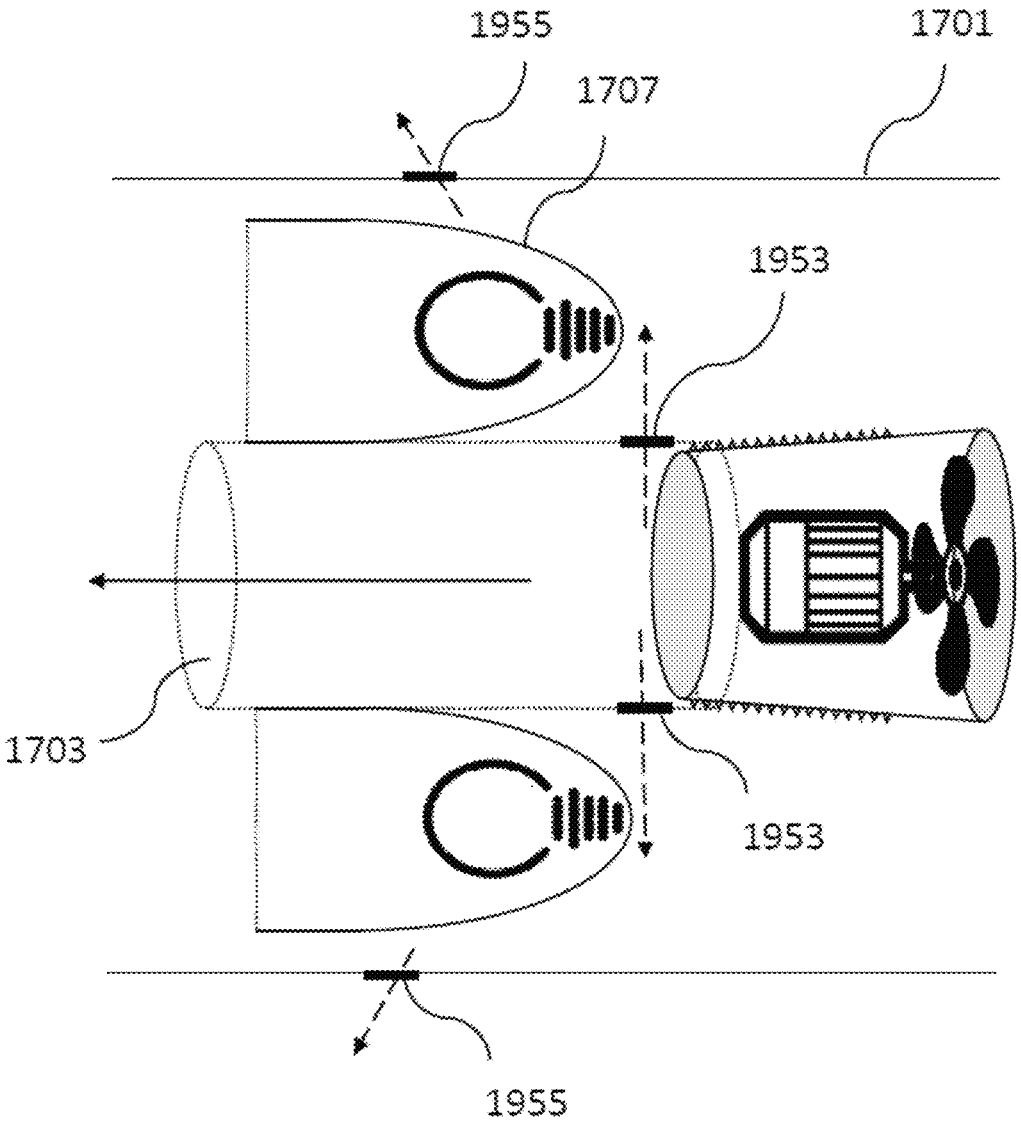
Figure 20C:
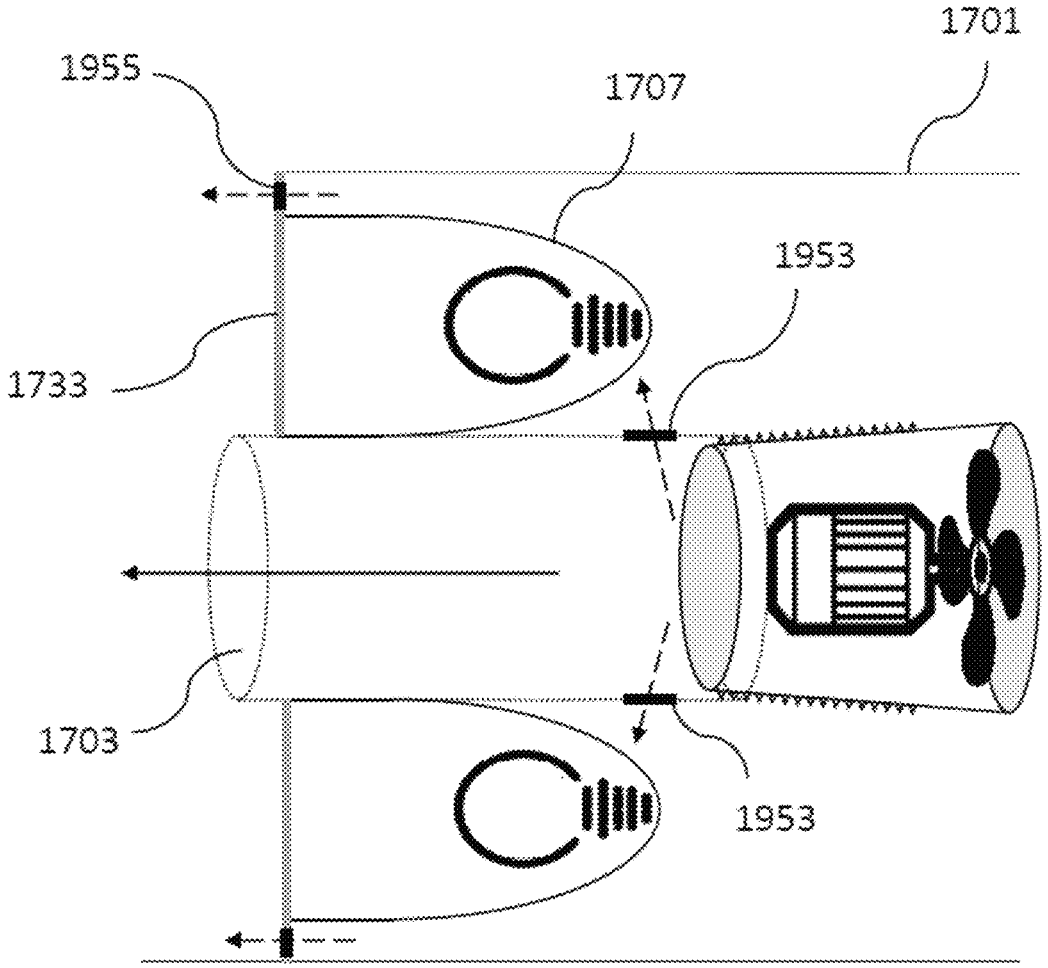
Figure 20D:
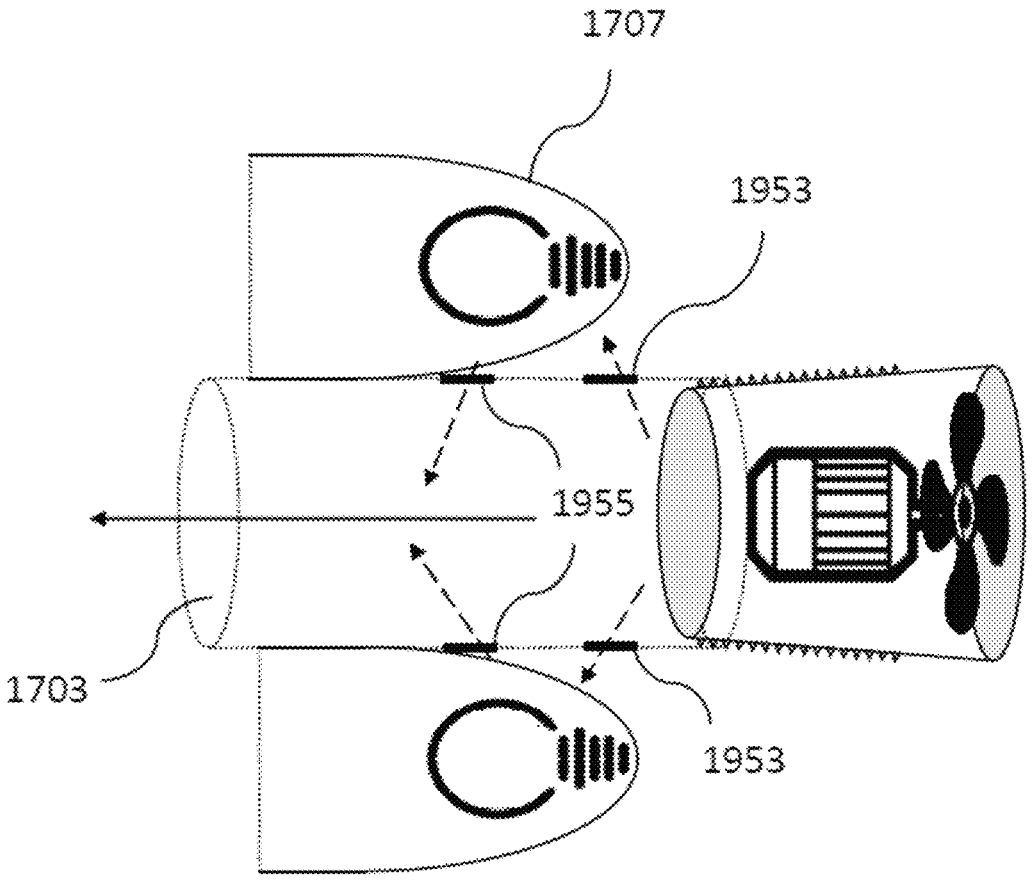

FIG. 19A to FIG. 19C show exemplary configuration of an apparatus in which the thermal coupling comprises a first through-hole 1951 that is in communication with an interior of the at least one of the one or more radiation energy sources 1707. The first through-hole can be configured to introduce airflow into the interior of the least one of the one or more radiation energy sources, thereby decreasing or maintaining an operating temperature of the radiation energy source by heat convection. In some instances, the first through-hole 1951 can be positioned at a first portion of the radiation energy source, which first portion does not contacts the airflow channel 1703, as illustrated in FIG. 19A. Air from exterior of the airflow channel (e.g., air from exterior of the apparatus) can enter the interior of the radiation energy source through the first through-hole. In some instances, the first through-hole 1951 can be positioned at a second portion of the at least one of the one or more radiation energy sources, which second portion contacts the airflow channel 1703, as illustrated in FIG. 19B. Air from interior of the airflow channel can enter the interior of the radiation energy source through the first through-hole.

In some embodiments, the thermal coupling can further comprise a second through-hole 1952 which is configured to exit air from the interior of the least one of the one or more radiation energy sources. In some instances, the second through-hole can be positioned at an exit of the infrared radiation (e.g., the opening of the reflector of the radiation energy source). In a configuration where the opening of the reflector is cover by an optical element, the second through-hole can be provided at the optical element. In some instances, the second through-hole can be positioned at a portion of the at least one radiation energy source. In an example, the portion of the at least one radiation energy source can be at a second portion of the at least one radiation energy source, which second portion contacts the airflow channel, as shown in FIG. 19A. Air can be introduced from an exterior of the radiation energy source (e.g., an exterior of the apparatus via a vent on the housing of the apparatus) into the interior of the radiation energy source, and exited from the interior of the radiation energy source into the air channel. In another example, the portion of the at least one radiation energy source can be at a first portion of the at least one radiation energy source, which first portion does not contact the airflow channel, as shown in FIG. 19B. Air can be introduced from the air channel into the interior of the radiation energy source, and exited from the interior of the radiation energy source into exterior of the apparatus (e.g., via vent on the housing of the apparatus). In yet another example, both the first through-hole and the second through-hole can be provided at the first portion of the at least one radiation energy source. Air can be introduced from the exterior of the apparatus into the interior of the radiation energy source via vent on the housing, and exited from the interior of the radiation energy source back to exterior of the apparatus via the vent. In still another example, both the first through-hole and the second through-hole can be provided at the second portion of the at least one radiation energy source. Air can be introduced from the air channel into the interior of the radiation energy source, and exited from the interior of the radiation energy source back into the air channel.

FIG. 19C shows an exemplary configuration of an apparatus in which the at least one of the one or more radiation energy sources does not physically contact the airflow channel 1703. The thermal coupling can comprise an air duct 1956 that is in communication with the first through-hole 1951. The air duct can be further in communication with either the airflow in the airflow channel or an exterior of the housing. The air duct can be made of a thermal conductive material. A second through-hole configured to exist air from the interior of the radiation energy source can be additionally provided to the configuration in FIG. 19C, and an air duct can be provided to the second through-hole. The first or second through-hole can be provided at either the first or second portion of the radiation energy source, as discussed in FIG. 19A and FIG. 19B. Though the examples in FIG. 19A to FIG. 19C are shown with the one or more radiation energy sources being positioned external to the airflow channel, the one or more radiation energy sources can also be positioned within the airflow channel while the first and second through-holes effecting an introducing and existing of the air into and from the interior of the radiation energy source.

FIG. 20A to FIG. 20D show exemplary configuration of an apparatus in which the thermal coupling comprises a third through-hole 1953 that is in communication with the airflow in the airflow channel. The third through-hole can be provided at the wall of the airflow channel. In some instances, as shown in FIG. 20A to FIG. 20D, the third through-hole can be configured to direct air from the airflow channel 1703 to at least an exterior surface of the at least one of the one or more radiation energy sources 1707. Air introduced from the airflow channel and blown onto at least the exterior surface of the at least one radiation energy source take at least a portion of the heat away from the exterior surface of the radiation energy source, thereby lower the temperature of the radiation energy source.

The thermal coupling can further comprise a fourth through-hole which is configured to exit the air, which is introduced from the airflow channel, to an exterior of the apparatus or back into the airflow channel. The circulating air from the third through-hole to the fourth through-hole can facilitate a removal of heat from the radiation energy source and thereby lower a temperature of the radiation energy source. In the example shown in FIG. 20B, the fourth through-hole 1955 can be provided at a housing 1701 of the apparatus. Air introduced from the airflow channel can flow through at least a portion of exterior surface of the radiation energy source and exit from the fourth through-hole to an exterior of the apparatus. In the example shown in FIG. 20C, an optical element 1733 can be provided to cover the opening of the reflector of the radiation energy source and a gap between a rim of the opening of the reflector and the housing 1701 of apparatus. The fourth through-hole 1955 can be provided at a part of the optical element that covers the gap. Air introduced from the airflow channel can flow through at least a portion of exterior surface of the radiation energy source and exit from the fourth through-hole to an exterior of the apparatus. In the example shown in FIG. 20D, the fourth through-hole 1955 can be provided at the wall of the airflow channel 1703. Air introduced from the airflow channel can flow through at least a portion of exterior surface of the radiation energy source and enter back into the airflow channel via the fourth through-hole. It is apparent that more than one fourth through-hole can be provided at the housing of the apparatus, the optical element of the radiation energy source and/or the wall of the airflow channel.

The disclosure also provides a configurations of an apparatus for drying an object in which a reflector of the one or more radiation energy sources has a cut-away shape. In a compact apparatus containing a plurality of radiation energy sources (e.g., infrared radiation lamp) having parabolic or polynomial reflectors, the reflectors may occupy an interior space of the apparatus and thus affect a configuration and/or arrangement of the airflow channel, which in turn affect a property of the airflow. For instance, the velocity and volume of the airflow can affect the efficiency of drying the object, and an increased noise can be generated by an increased airflow resistance. On the other hand, an infrared radiation lamp having a reflector with reduced size may result in an attenuated radiation efficiency. In addition, due to existence of internal installation and/or positioning components in the reflector, a size of the reflector (e.g., a diameter of the opening, a longitudinal length from the opening to the vertex) may not be largely reduced. Therefore, there is a need to provide a radiation energy sources having a reflector which balances a radiation efficiency, airflow property (e.g., a volume, a velocity, a velocity distribution, a field area, a resistance, a pressure, a direction, a vortex, and a divergence, etc.), a functionality and spatial efficiency.

Figure 21:
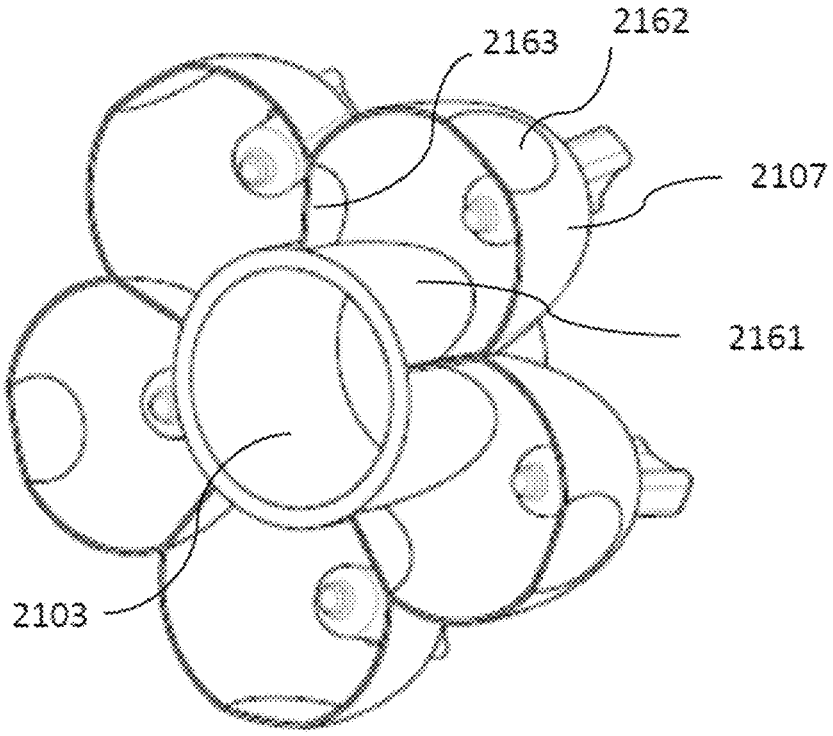
FIG. 21 is a schematic view showing exemplary configuration of an apparatus for drying an object in which a reflector of the one or more radiation energy sources has a cut-away shape in accordance with other embodiments of the disclosure.
Figure 21:
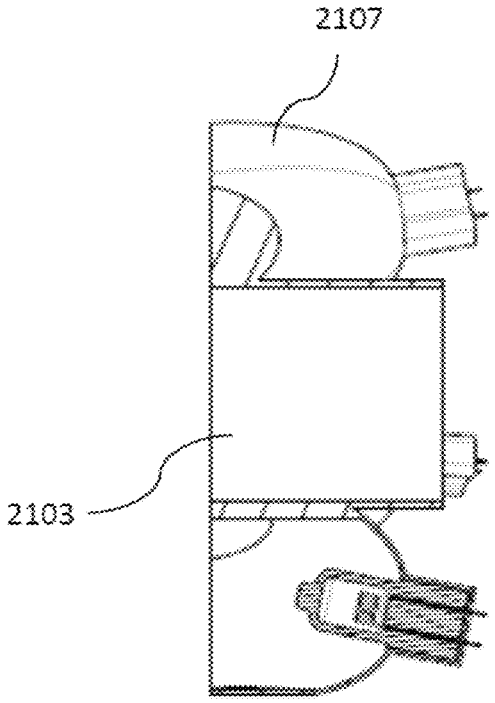
Figure 21:
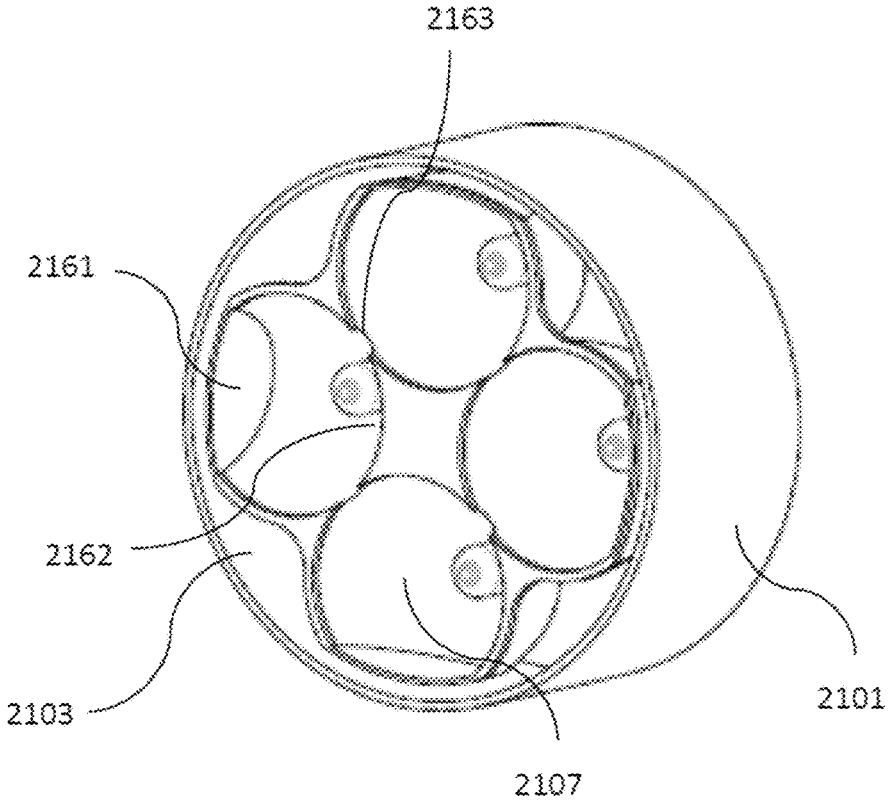
Figure 21:
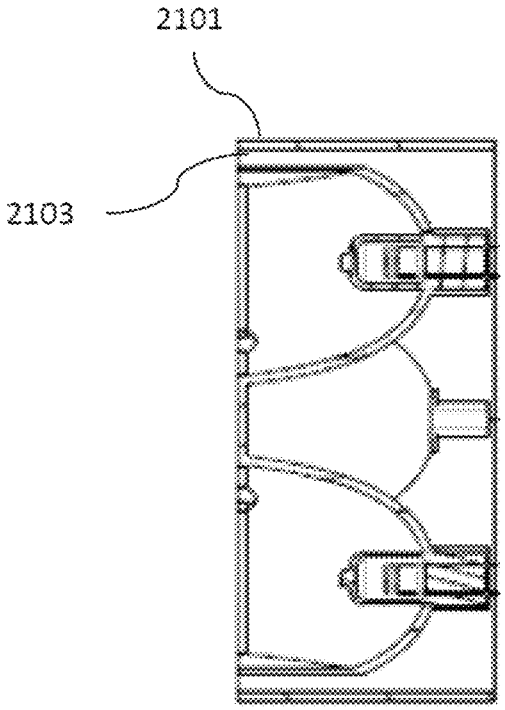

FIG. 21 is a schematic view showing an exemplary configuration of an apparatus for drying an object in which a reflector of the one or more radiation energy sources has a cut-away shape. Panel B is a lateral view of the schematic view of panel A. The apparatus for drying an object can comprise a housing, one or more radiation energy sources configured to generate infrared radiation and direct the infrared radiation toward an exterior of the housing, and a power element configured to provide power at least to the radiation energy source. Each of the one or more radiation energy sources can comprise a reflector. The reflector can have an opening toward the exterior of the housing. A radial cross section (e.g., a cross section perpendicular to an axis) of the reflector can be a portion of a curve. In some instances, a profile of the axial cross-section and/or a radial cross section of the reflector can be a polynomial having multiple segments. For example, a first segment of the profile can be expressed by a polynomial of a first set of parameters, and a second segment of the profile can be expressed by a polynomial of a second set of parameters. The axis of the respective parabolic reflecting surface of the reflector in the plurality of radial energy sources can intersect with each other, thereby radiation exiting the plurality of radiation energy sources can at least partially overlap at a predetermined distance in front of the apparatus.

In the example shown in FIG. 21, the one or more radiation energy sources can be positioned between the airflow channel and the housing of the apparatus. At least one of the reflectors of the one or more radiation energy sources can have a cut-away shape. As used here, the term "cut-away shape" can refer to a three dimensional shape that is not an intact cone, truncated-cone, cylinder shape, sphere or spheroid. In a cut-away shape, at least a portion of a circumference of the three dimensional shape is removed. As shown in panel A of FIG. 21, at least one of the cut-away shaped reflector of the radiation energy source can comprise at least a first part 2161 that is coupled to, integral with or form the outer wall of the airflow channel 2103. In the disclosure, the first part is described as a part of the cut-away shaped reflector. However, it is apparent for those in the art that the first part can also be considered a part of the wall of the airflow channel or a shared or joined part of the reflector and the airflow channel. The first part can contact the airflow within the airflow channel. The first part can be configured to transfer heat generated at the radiation energy source to the airflow channel by heat conduction. The first part of the cut-away shaped reflector can follow the contour of the airflow channel. A shape of the first part of the cut-away shaped reflector can have a curvature. In some instances, the curvature can be concave relative to a geometric center of the apparatus, as shown in FIG. 21. A radial cross section of the reflector can be a portion of a curve. In some instances, the radial cross section can vary along an axis of the reflector.

In an exemplary embodiment, the at least one of the cut-away shaped reflector can further comprise a second part 2162 that is located at a side of the reflector opposing the first part 2161. The second part can have a substantially same or different curvature from that of the first part. The second part can be positioned to not contact the airflow channel. In some instances, the second part can comprise a portion that is coupled to the housing of the apparatus. In an exemplary embodiment, the at least one of the cutaway shaped reflector can further comprise a third part 2163 connecting the first and the second parts. The third part of the cut-away shaped reflector can be coupled to the third part of an adjacent cut-away shaped reflector, as shown in FIG. 21. The material of the first part 2161 can be different from the second part and/or the third part, for example with higher thermal conductivity.

Panels C and D in FIG. 21 provide schematic views showing exemplary configuration of an apparatus for drying an object in which a reflector of the one or more radiation energy sources has a cut-away shape in accordance with other embodiments of the disclosure. Panel D is a cutaway lateral view of the schematic view of panel C. In the example shown in Panels C and D of FIG. 21, the airflow channel 2103 can be provided between the housing 2101 of the apparatus and the one or more radiation energy sources 2107. At least one of the reflectors of the one or more radiation energy sources can have a cut-away shape. As shown in panel C of FIG. 21, at least one of the cut-away shaped reflector of the radiation energy source can comprise at least a first part 2161 that follows a contour of the housing. The first part can comprise a portion that is coupled to the inner surface of the housing. In some instances, the at least one of the cut-away shaped reflector can further comprise a second part 2162 that is located at a side of the reflector opposing the first part 2161. In some instances, the at least one of the cutaway shaped reflector can further comprise a third part 2163 connecting the first and the second parts. The third part of the cut-away shaped reflector can be coupled to the third part of an adjacent cut-away shaped reflector, as shown in panels C and D in FIG. 21.

Figure 22:
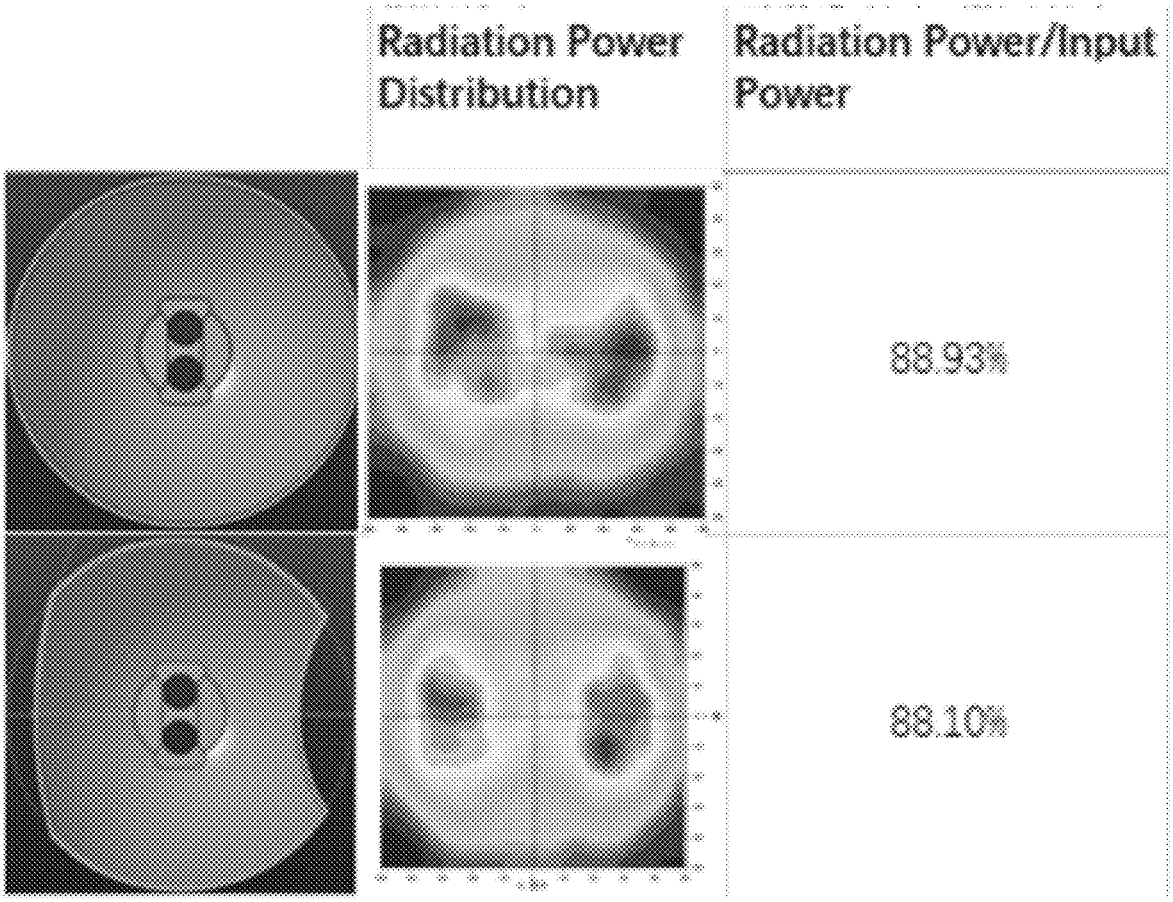
FIG. 22 is simulation result showing relation between a diameter of opening of the reflector, an output power at the opening of the reflector and a power received at a predetermined distance in front of the apparatus, in accordance with some embodiments of the disclosure.

The experiments and simulation, as illustrated in FIG. 22, show a comparison of a radiation power distribution pattern and a radiation efficiency (e.g., a ratio between the output radiation power at the opening of the reflector and an input power of the radiation energy source) of a radiation energy source having a cut-away shaped reflector against a radiation energy source having an intact cone-shaped reflector which has a same size (e.g., diameter) at the opening. The radiation efficiency of a radiation energy source having a cut-away shaped reflector is 88.1%, which is comparably high with the radiation efficiency 88.93% of a radiation energy source having an intact cone-shaped reflector, while keeping the contour of the cutaway reflector smaller.

Figure 23:
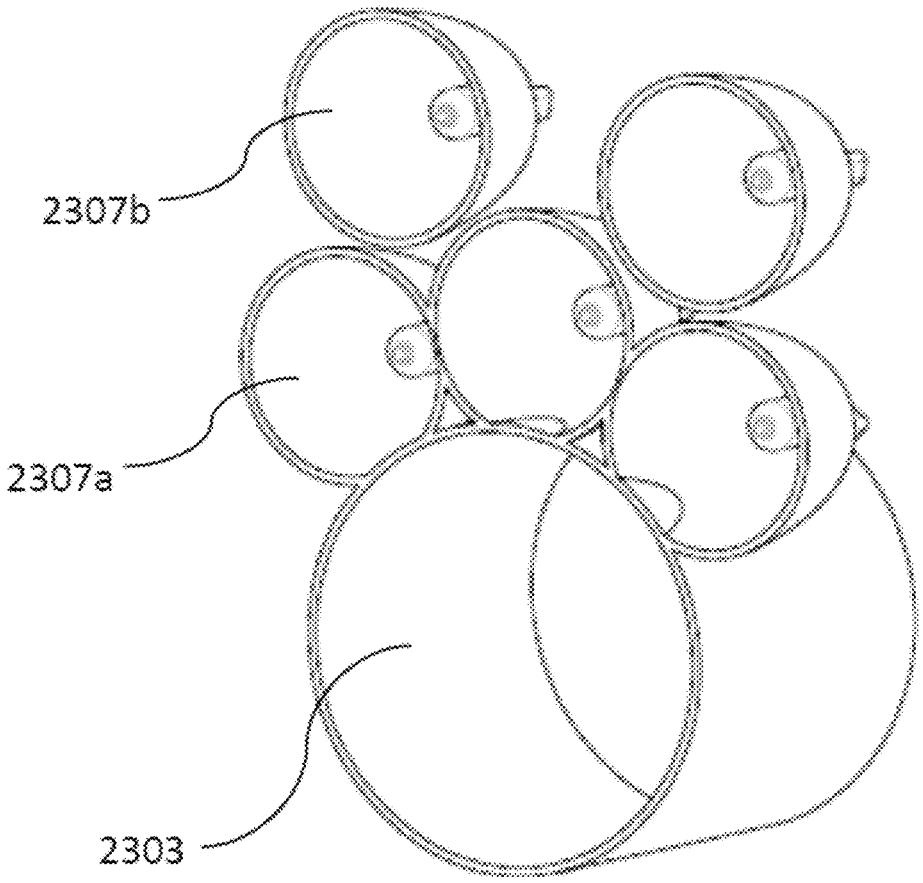
FIG. 23 and FIG. 24 are schematic views showing exemplary configuration of an apparatus for drying an object in accordance with still other embodiments of the disclosure.

FIG. 23 shows another exemplary configuration of an apparatus for drying an object. Among a plurality of radiation energy sources positioned between the housing of the apparatus and the airflow channel 2303, at least one radiation energy source comprise a first portion that is positioned to not contact the airflow channel. For instance, radiation energy source 2307*a* can comprise a first portion that is positioned opposing to the airflow channel, though the radiation energy source 2307*a* can further comprise a second portion that is positioned to contact the airflow channel. For instance, the radiation energy source 2307*b* can be positioned away from the airflow channel thus comprising no portion contacting the airflow channel. In an exemplary embodiment, a thermal coupling can be coupled to the radiation energy source 2307*b* and configured to dissipate heat from the radiation energy source 2307*b*. As discussed elsewhere in the disclosure, the thermal coupling can comprise a thermal coupling member or a cooling member that is connected with the airflow channel or the housing of the apparatus. The thermal coupling can comprise a first through-hole that is in communication with an interior of the radiation energy source 2307*b*. The first through-hole can be configured to introduce air into the interior of the radiation energy source 2307*b*. The thermal coupling can comprise a third through-hole that is in communication with the airflow in the airflow channel. The third through-hole can be configured to direct air from the airflow channel to an exterior surface or an interior of the radiation energy source 2307*b*. The radiation energy source 2307*a* can be positioned to be adjacent to the airflow channel. A second portion of the radiation energy source 2307*a* can contact the airflow channel. As discussed elsewhere in the disclosure, the reflector of the radiation energy source 2307*a* can have a cut-away shape. The cut-away shaped reflector can comprise at least a first part that is coupled to the airflow channel. The first part can follow the contour of the airflow channel.

Figure 24:
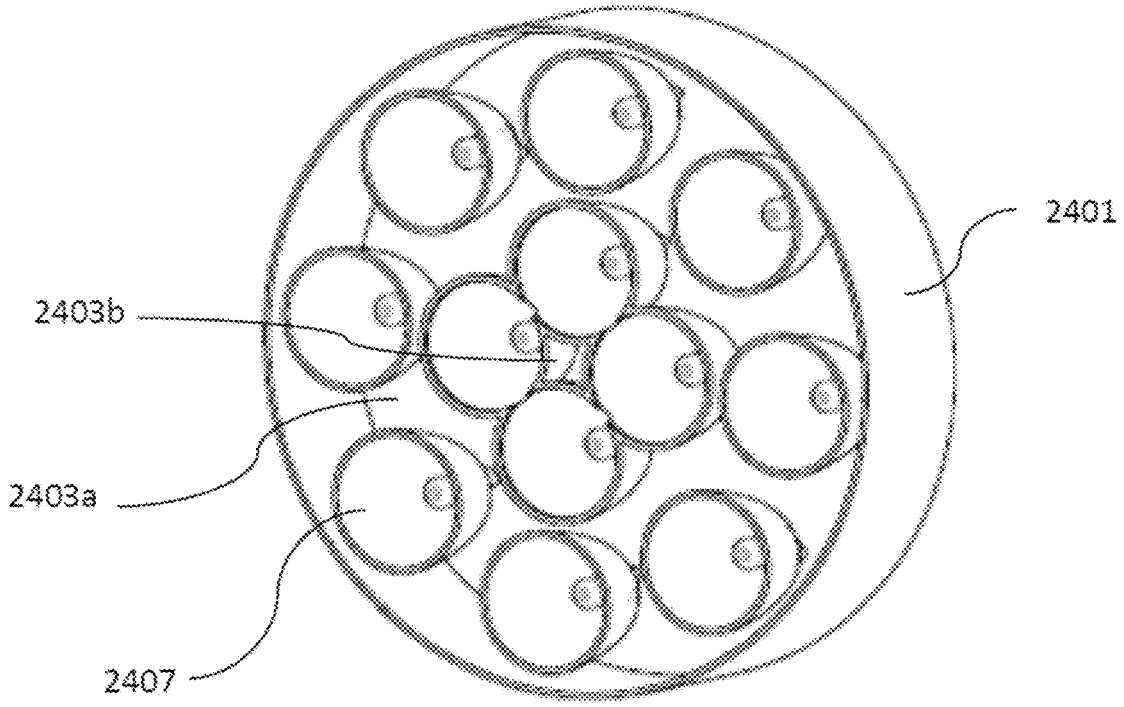

FIG. 24 shows yet another exemplary configuration of an apparatus for drying an object. A plurality of radiation energy sources 2407 can be positioned within the housing 2401 of the apparatus. The airflow channel can be provided in a space defined between the radiation energy sources. For instance, a first airflow channel 2403*a* can be provided in the space between any two or more radiation energy sources. For instance, a second airflow channel 2403*b* can be additionally or alternatively provided in the space enclosed by the radiation energy sources which are positioned in proximity to a geometrical center of the housing. In an example, a thermal coupling can be coupled to at least one of the radiation energy sources and configured to dissipate heat from the radiation energy source, as discussed elsewhere in the disclosure. In an example, the reflector of at least one of the radiation energy source (e.g., the radiation energy source abutting the airflow channel or the apparatus housing) can have a cut-away shape, as discussed elsewhere in the disclosure. The axis of the respective parabolic reflector in the plurality of radiation energy sources can intersect with each other, thereby radiation exiting the plurality of radiation energy sources can at least partially overlap at a predetermined distance in front of the apparatus.

Figure 25:
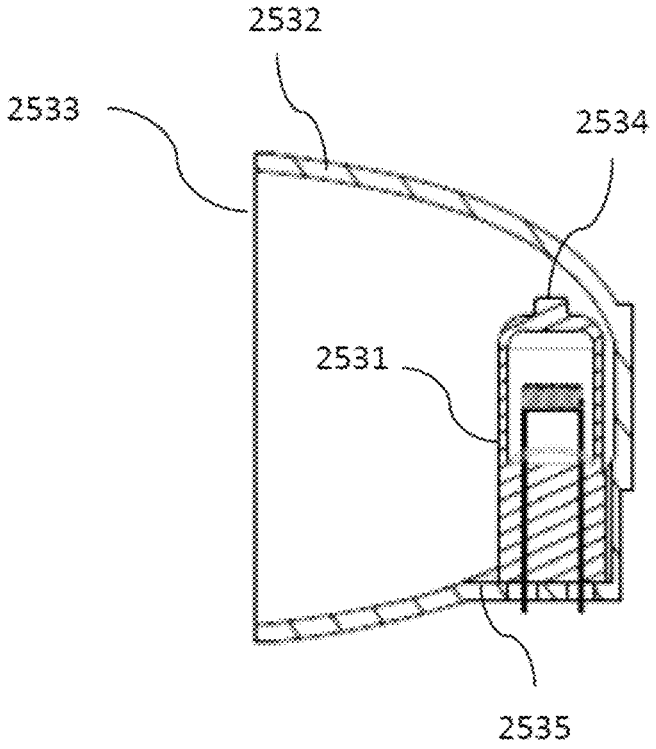
FIG. 25 and FIG. 26 are schematic views showing exemplary configuration of radiation energy source in accordance with some embodiments of the disclosure.

The disclosure further provides a radiation energy source (e.g., radiation bulb) in which the generated radiation can be efficiently reflected. The radiation energy source can be used in the apparatus for drying an object of the disclosure. FIG. 25 shows exemplary configuration of radiation energy source of the disclosure. The radiation energy source can comprise a radiation emitter 2531 and a reflector 2532. The radiation emitter can be configured to generate an infrared radiation when powered. The reflector can have a parabolic or polynomial cross-section with at least one vertex and an opening toward an exterior of the radiation energy source. The reflector can be configured to direct the infrared radiation toward the exterior of the radiation energy source. The opening of the reflector can be covered by an optical element 2533. In a configuration where a plurality of radiation energy sources are provided, the opening of the plurality of reflectors can be covered by one optical element. For instance, the optical element can be a lens, a lens coated with a coating film, or an optic other than a lens.

The radiation emitter can be positioned and oriented such that a distal end 2534 (e.g., the tip portion) of the radiation emitter does not point to the opening. In the exemplary radiation energy source of FIG. 25, the radiation emitter can be oriented such that its longitudinal axis (e.g., from the leads to the tip) is substantially perpendicular relative to the opening of the reflector. For instance, the radiation emitter can be supported at or near a side portion 2535 of the reflector or in proximity to the vertex of the reflector, which side portion is a portion of the reflector that does not include the vertex. The reflector can have at least one through hole to accommodate a coupling (e.g., a wire) between the power source and the emitter. The at least one through hole can be sealed by a sealing member capable of insulating at least one of electricity, radiation or water.

Figure 26:
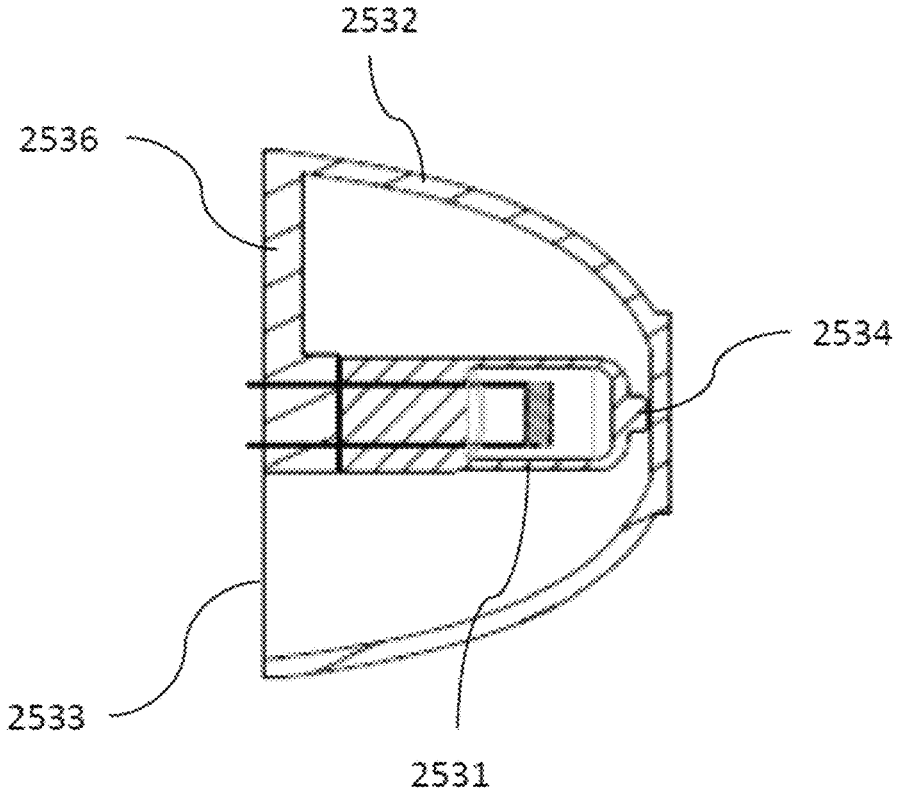

In the exemplary radiation energy source shown in FIG. 26, the radiation emitter can be oriented in a substantially opposite direction relative to the opening of the radiation energy source. For instance, the distal portion 2534 of the radiation bulb can point to the vertex of the reflector, while the base portion of the radiation bulb points to the opening of the reflector. The radiation emitter 2531 can be supported by a support 2536 which extends into the opening of the radiation energy source, such that the radiation emitter is oriented to direct radiation toward the vertex of the reflector. The support can include a groove to accommodate a coupling (e.g., a wire) between a power source and power leads of the radiation emitter. Benefit of the radiation energy source as shown in FIG. 25 and FIG. 26 can include improved reflection efficiency and optical properties. For instance, by virtue of the configuration of the embodiments of the disclosure, the radiation emitter (e.g., the filament) can be positioned substantially at or in proximity to a focal point of the parabolic reflector or polynomial reflector, resulting in the reflected beam of radiation being a substantially parallel.

Figure 27:
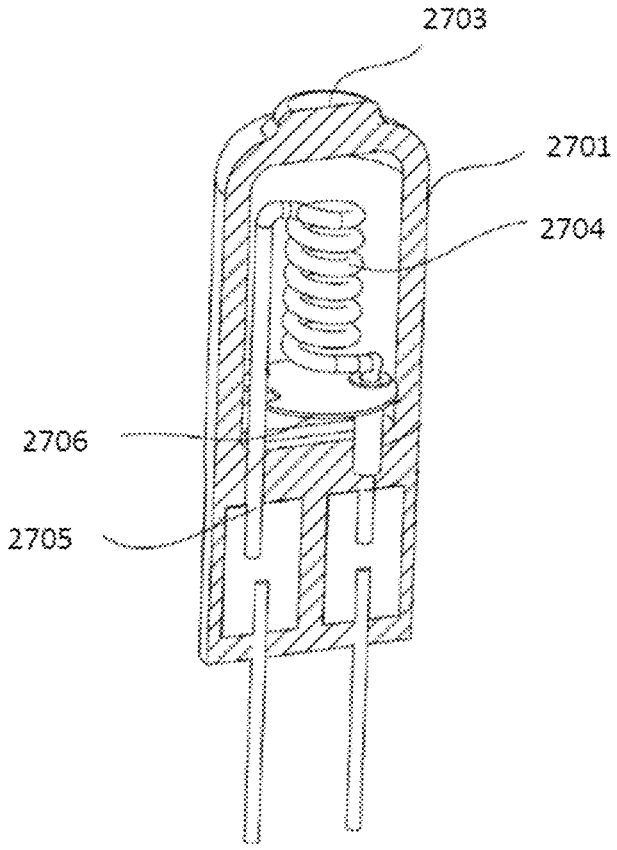
FIG. 27 and FIG. 28 are cross-sectional views showing exemplary configuration of radiation emitter in accordance with some embodiments of the disclosure.

The disclosure also provides a radiation emitter (e.g., such as an infrared lamp) which has improved radiation emission. The radiation emitter can be used in the radiation energy source for the apparatus for drying an object of the disclosure. FIG. 27 shows an exemplary embodiment of an radiation emitter of the disclosure. The radiation emitter can comprise a radiation generating element 2704 which is sealed in a bulb 2701 and configured to generate a radiation when powered. A tip portion of the bulb can include a lens 2703 which modulate a divergency and/or direction of radiation exiting the radiation emitter. The radiation generating element 2704 can be a filament (e.g., Tungsten wire filament) having a predetermined width and height. Leads or pins 2705 can support the filament and couple between the filament and the power element. The radiation emitter can include a first radiation reflecting element 2706 which is positioned beneath the radiation generating element 2704 and configured to reflect at least a portion of the radiation toward an exterior of the radiation emitter.

The first radiation reflecting element can have a reflecting surface facing the radiation generating element. The reflecting surface can be substantially parabolic having a focal point, the radiation generating element being positioned in proximity to or at the focal point. In some instances, the reflecting surface can have a coating that reflects an infrared radiation. The first radiation reflecting element can be made from a heat-resistant metal. Examples of the heat-resistant metal can include molybdenum, tantalum, niobium, copper and steel.

Figure 28:
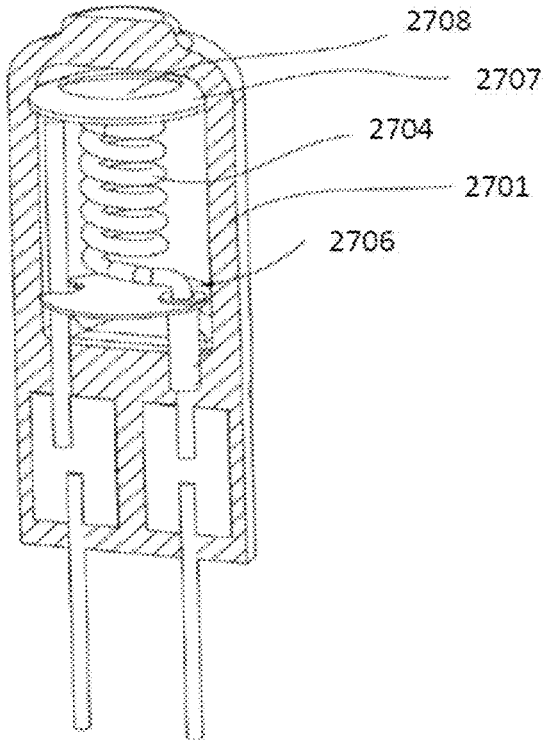

In the exemplary embodiment in FIG. 28, the radiation emitter can further comprise a second reflecting element 2707 which is located at an opposite side of the radiation generating element 2704 with respect to the first reflecting element 2706. The second reflecting element can have a reflecting surface facing the emitting element to reflect at least a portion of the radiation to the first reflecting element. The reflecting surface can be substantially parabolic having a focal point, the radiation generating element being positioned in proximity to or at the focal point. The second reflecting element can have a hole 2708 in its geometric center. The second reflecting element is provided to regulate an angle of divergence of the radiation exiting the radiation emitter. For instance, only the radiation having an angle of divergence equal to or smaller than a predetermined angle of divergence can pass the hole in the second reflecting element and exit the radiation emitter. Any radiation, which is emitted from the filament or reflected by the first radiation reflecting element but has an angle of divergence larger than the predetermined angle of divergence, can be reflected back to the first reflecting element by the second radiation reflecting element. In some instances, a portion of the radiation emitted from the filament can be reflected between the first reflecting element, the second reflecting element and/or the inner surface of the reflector multiple times prior it exits the radiation emitter and/or opening of the reflector, resulting in the radiation exiting the radiation emitter and/or opening of the reflector in a collimated manner.

The first and/or second radiation reflecting element can be supported by a supporting member. The supporting member can be insulated. The supporting member can made of a non-conductive material. In some instances, the supporting member can be separate and different from a support which supports the radiation generating element. In some instances, the supporting member can also support and transmit power to the radiation generating element. In the latter case, an insulation can be provided to the portion where the supporting member contacts the first and/or second radiation reflecting element.

The disclosure also provides an apparatus for drying an object which generates a low noise. The apparatus can comprise a housing configured to provide an airflow channel having an airflow inlet and an airflow outlet, an airflow generating element contained in the housing and configured to effect an airflow through the airflow channel, a radiation energy source contained in the housing and configured to generate infrared radiation and direct the infrared radiation toward an exterior of the housing, and a power element configured to provide power at least to the radiation energy source and the airflow generating element. The airflow generating element can be positioned at a downstream of the airflow with respect to at least a portion of the power element. At least a portion of the radiation energy source can be located at a downstream of the airflow with respect to the airflow generating element. At least a portion of the radiation energy source can be coupled to at least a portion of the airflow channel.

The airflow generating element can comprise at least a low noise motor. The airflow generating element can comprise a fan driven by the motor, and when actuated, a rotation of the fan effects the airflow through the airflow channel. The fan can comprises a plurality of blades. A rotating speed of the motor can be determined based on the number of the blades, such that a blade-passing frequency, which is correlated to a product of a rotating speed of the motor and the number of blades, is substantially within a frequency range of ultrasonic. A noise of the motor can thus be suppressed since humans are not sensitive to a sound having frequency in the range of ultrasonic. The motor can be a high-speed motor. In some instances, the rotating speed of the motor can exceed at least 10,000, 20,000, 30,000, 40,000, 50,000, 60,000, 70,000, 80,000, 90,000, 100,000 or even more revolutions per minute (rpm). The number of the blades can be a prime number other than 2. In an example, the number of the blades can be equal or exceed 3, 5, 7, 9, 11 or 13 or 17.

The high-speed motor can be combined with any other aspect(s) of the disclosure in an apparatus for drying an object. For instance, in an apparatus for drying an object having a high-speed motor, at least one of the one or more radiation energy sources can comprise a first portion that is positioned not contacting the airflow channel. This configuration can be effected since a large volume of airflow is generated within the airflow channel by the high-speed motor, which large volume of airflow lowers an increase in the temperature of the airflow channel and the airflow even if heat is transferred from the radiation energy source. For example, the volume of airflow generated by the motor can be at least 5, 10, 15, 20, 25 or 30 cubic feet per minute (CFM) as measure at the output opening of the apparatus. A heat dissipation efficiency of the radiation energy source can be determined from the volume of airflow generated at the motor and the temperature required for black body radiation of the radiation emitter, and an area of the radiation energy source that is required for heat dissipation can be determined based on the heat dissipation efficiency. The area required for heat dissipation can be a portion of the entire area of the external wall of the radiation energy source to maintain the operating temperature of the radiation energy source within a predetermined temperature range (e.g., the temperature range required for maintaining the radiation emitter at a black body radiation status). Therefore, it can be sufficient to contact a portion of the external surface of the radiation energy source with the airflow channel, to couple a thermal coupling to the radiation energy source, and/or to extend a relatively short protruding member (e.g., a fin) from the radiation energy source into an interior of the airflow channel, to maintain the operating temperature of the radiation energy source within a predetermined temperature range. Due to the large volume of airflow generated by the high-speed motor, heat transferred from the radiation energy source to the airflow channel or the airflow can be efficiently removed without substantially increasing the temperature of the airflow channel or the airflow. In some instances, an increase in the temperature of the airflow in the airflow channel due to the heat transferred from the radiation energy source can be less than 1, 2, 3, 4, or 5 degrees.

The motor can be coupled in the housing by a mounting element, which mounting element can be a part of the airflow generating element. The motor can be received in a chamber of the mounting element. The mounting element can prevent or reduce a vibration and/or noise, which is generated by the motor, from transmitting to the housing. The mounting element can include, for example, a support member of an elastomeric material. In an example, the mounting element can comprise a portion coupled to at least one of the housing, the airflow channel or the radiation energy source.

The disclosure also provides a method for drying an object. The method can comprise providing an airflow channel, via a housing, the airflow channel having an airflow inlet and an airflow outlet; effecting airflow, via an airflow generating element contained in the housing, through the airflow channel, the airflow generating element comprising at least a low noise motor; generating infrared radiation, via a radiation energy source contained in the housing, and directing the infrared radiation toward an exterior of the housing; and providing power, via a power element to at least the radiation energy source and the airflow generating element.

Though the apparatus for drying an object of the disclosure is descried with reference to drawings where a hair dryer is illustrated, those skilled in the art can appreciate that the apparatus for drying an object is not limited to a hair dryer as long as an radiation energy source (e.g., one or more infrared lamps) is utilized as the source of heat energy. In some embodiments, the apparatus for drying an object of the disclosure can be implemented as a clothes dryer or a hand dryer. The clothes dryer can utilize one or more infrared lamps as heat source in association with an airflow generating element to facilitate an evaporation of water from various fabric such as clothes, bed sheets, curtains, and plush toys. The housing of the clothes dryer can comprise a support or a stand. A height of the support or stand can be adjusted.

Figure 29:
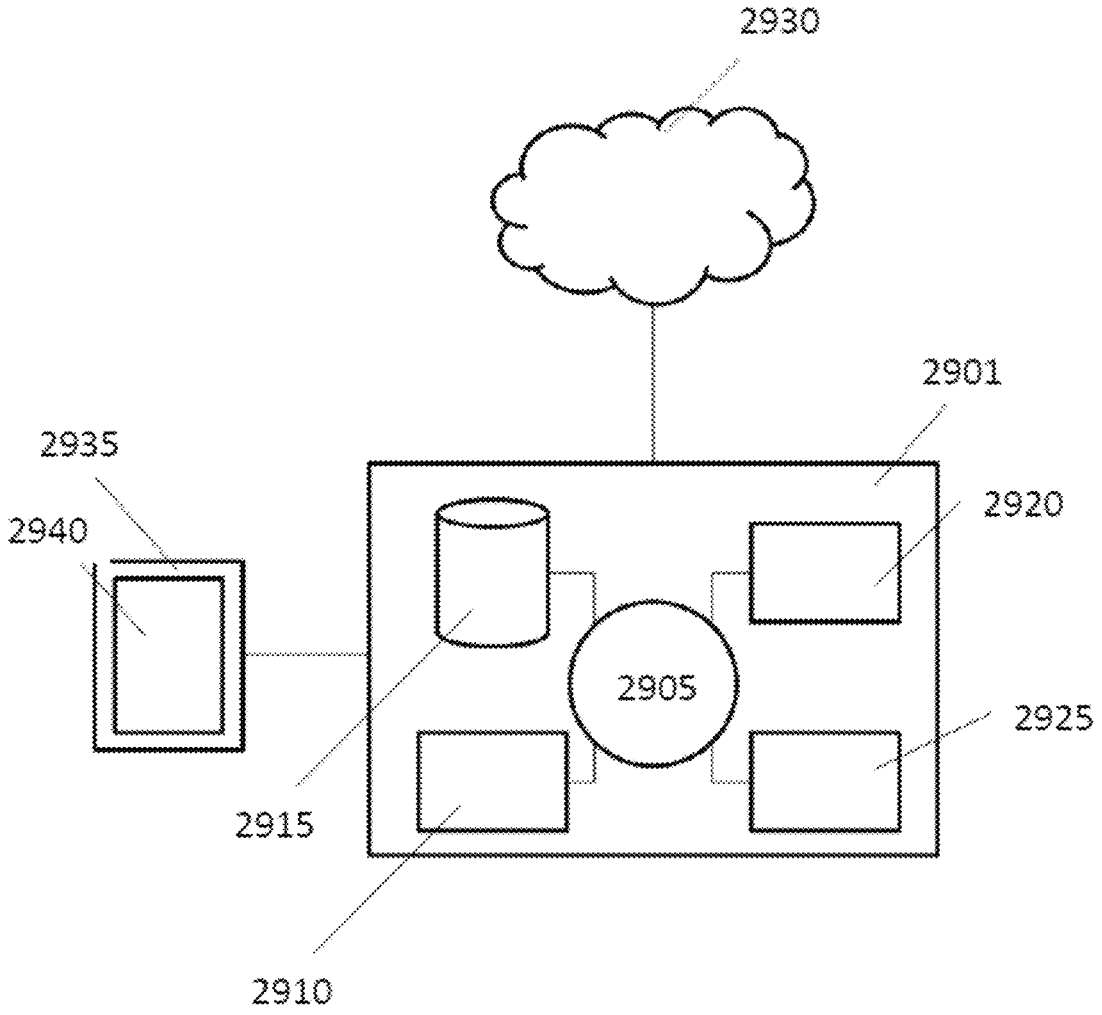
FIG. 29 shows an example of a device control system, in accordance with embodiments of the invention.

FIG. 29 shows an example of a device control system, in accordance with embodiments of the invention. The device control system can be programmed to implement methods and devices of the disclosure.

The device control system includes a central processing unit (CPU, also "processor" and "computer processor" herein) 2905, which can be a single core or multi core processor, or a plurality of processors for parallel processing. The device control system also includes memory or memory location 2910 (e.g., random-access memory, read-only memory, flash memory), electronic storage unit 2915 (e.g., hard disk), communication interface 2920 (e.g., network adapter) for communicating with one or more other systems, and peripheral devices 2925, such as cache, other memory, data storage and/or electronic display adapters. The memory 2910, storage unit 2915, interface 2920 and peripheral devices 2925 are in communication with the CPU 2905 through a communication bus (solid lines), such as a motherboard. The storage unit 2915 can be a data storage unit (or data repository) for storing data. The device control system can be operatively coupled to a computer network ("network") 2930 with the aid of the communication interface 2920. The network 2930 can be the Internet, an internet and/or extranet, or an intranet and/or extranet that is in communication with the Internet.

The network 2930 in some cases is a telecommunication and/or data network. The network 2930 can include one or more computer servers, which can enable distributed computing, such as cloud computing. For example, one or more computer servers may enable cloud computing over the network 2930 ("the cloud") to perform various aspects of analysis, calculation, and generation of the present disclosure, such as, for example, capturing a configuration of one or more experimental environments; performing usage analyses of products (e.g., applications); and providing outputs of statistics of projects. Such cloud computing may be provided by cloud computing platforms such as, for example, Amazon Web Services (AWS), Microsoft Azure, Google Cloud Platform, and IBM cloud. The network 2930, in some cases with the aid of the device control system, can implement a peer-to-peer network, which may enable devices coupled to the device control system to behave as a client or a server.

The CPU 2905 can execute a sequence of machine-readable instructions, which can be embodied in a program or software. The instructions may be stored in a memory location, such as the memory 2910. The instructions can be directed to the CPU 2905, which can subsequently program or otherwise configure the CPU 2905 to implement methods of the present disclosure. Examples of operations performed by the CPU 2905 can include fetch, decode, execute, and writeback.

The CPU 2905 can be part of a circuit, such as an integrated circuit. One or more other components of the system can be included in the circuit. In some cases, the circuit is an application specific integrated circuit (ASIC).

The storage unit 2915 can store files, such as drivers, libraries and saved programs. The storage unit 2915 can store user preference data, e.g., user preferences and user programs. The device control system in some cases can include one or more additional data storage units that are external to the device control system, such as located on a remote server that is in communication with the device control system through an intranet or the Internet.

The device control system can communicate with one or more remote device control systems through the network 2930. For instance, the device control system can communicate with a remote device control system of a user (e.g., a user of an experimental environment). Examples of remote device control systems include personal computers (e.g., portable PC), slate or tablet PC's (e.g., Apple® iPad, Samsung® Galaxy Tab), telephones, Smart phones (e.g., Apple® iPhone, Android-enabled device, Blackberry®), or personal digital assistants. The user can access the device control system via the network 2930.

Methods as described in the disclosure can be implemented by way of machine (e.g., computer processor) executable code stored on an electronic storage location of the device control system, such as, for example, on the memory 2910 or electronic storage unit 2915. The machine executable or machine readable code can be provided in the form of software. During use, the code can be executed by the processor 2905. In some cases, the code can be retrieved from the storage unit 2915 and stored on the memory 2910 for ready access by the processor 2905. In some situations, the electronic storage unit 2915 can be precluded, and machine-executable instructions are stored on memory 2910.

The code can be pre-compiled and configured for use with a machine having a processer adapted to execute the code, or can be compiled during runtime. The code can be supplied in a programming language that can be selected to enable the code to execute in a pre-compiled or as-compiled fashion.

Aspects of the systems and methods provided herein, such as the device control system 1401, can be embodied in programming. Various aspects of the technology may be thought of as "products" or "articles of manufacture" typically in the form of machine (or processor) executable code and/or associated data that is carried on or embodied in a type of machine readable medium. Machine-executable code can be stored on an electronic storage unit, such as memory (e.g., read-only memory, random-access memory, flash memory) or a hard disk. "Storage" type media can include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the software from one computer or processor into another, for example, from a management server or host computer into the computer platform of an application server. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium, such as computer-executable code, may take many forms, including but not limited to, a tangible storage medium, a carrier wave medium or physical transmission medium. Non-volatile storage media include, for example, optical or magnetic disks, such as any of the storage devices in any computer(s) or the like, such as may be used to implement the databases, etc. shown in the drawings. Volatile storage media include dynamic memory, such as main memory of such a computer platform. Tangible transmission media include coaxial cables; copper wire and fiber optics, including the wires that comprise a bus within a device control system. Carrier-wave transmission media may take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards, paper tape, any other physical storage medium with patterns of holes, a RAM, a ROM, a PROM and EPROM, a FLASH-EPROM, any other memory chip or cartridge, a carrier wave transporting data or instructions, cables or links transporting such a carrier wave, or any other medium from which a computer may read programming code and/or data. Many of these forms of computer readable media may be involved in carrying one or more sequences of one or more instructions to a processor for execution.

The device control system can include or be in communication with an electronic display 2935 that comprises a user interface (UI) 2940 for providing, for example, the various components (e.g., lab, launch pad, control center, knowledge center, etc) of the model management system. Examples of UI's include, without limitation, a graphical user interface (GUI) and web-based user interface. The electronic display can be a display of a user equipment such as a smartphone.

Methods and devices of the disclosure can be implemented by way of one or more algorithms. An algorithm can be implemented by way of software upon execution by the central processing unit 2905. The algorithm can, for example, generate instructions to operate one or more component of a sample transport system.

It should be understood from the foregoing that, while particular implementations have been illustrated and described, various modifications can be made thereto and are contemplated herein. It is also not intended that the invention be limited by the specific examples provided within the specification. While the invention has been described with reference to the disclosure, the descriptions and illustrations of the preferable embodiments herein are not meant to be construed in a limiting sense. Aspects of the preferable embodiments can be combined in other embodiments. For instance, the one or more radiation energy sources having a first portion that is positioned not contacting the airflow channel, the thermal coupling coupled to at least one of the one or more radiation energy sources, the reflector of the one or more radiation energy sources having a cut-away shape, the radiation energy source in which the radiation emitter being positioned and oriented such that a distal end of the radiation emitter does not point to the opening of the reflector, the radiation emitter having one or more radiation reflecting elements, and the high-speed motor, can be arbitrarily combine in other embodiments that are not particularly described in the disclosure. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A drying apparatus, comprising:

a housing that provides an airflow channel having an airflow inlet and an airflow outlet;

an airflow generating element that is contained in the housing and effects an airflow through the airflow channel;

one or more radiation energy sources that generate infrared radiation, wherein at least one of the one or more radiation energy sources is equipped with a reflector that directs at least a portion of the infrared radiation toward an exterior of the housing; and a power element configured to provide power at least to the radiation energy source and the airflow generating element, wherein at least one of at least one reflector has a cut-away shape that is formed by cutting a three-dimensional shape with at least one axial cross-section.

2. The drying apparatus of claim 1, wherein at least one of at least one reflector comprises at least a first part that is coupled to the airflow channel.

3. The drying apparatus of claim 2, wherein the first part follows contour of the airflow channel.

4. The drying apparatus of claim 2, wherein the first part contacts the airflow within the airflow channel.

5. The drying apparatus of claim 2, wherein the first part is coupled to, being integral with, or form at least a part of the airflow channel.

6. The drying apparatus of claim 2, wherein the first part is configured to dissipate heat of the one or more radiation energy source to the airflow channel.

7. The drying apparatus of claim 2, wherein a shape of the first part has a curvature.

8. The drying apparatus of claim 7, wherein the curvature is concave relative to a geometric center of the drying apparatus.

9. The drying apparatus of claim 2, wherein at least one of at least one reflector further comprises a second part that is located at a side of the reflector opposing the first part.

10. The drying apparatus of claim 9, wherein the second part does not contact the airflow channel.

11. The drying apparatus of claim 9, wherein the second part has a different curvature from that of the first part.

12. The drying apparatus of claim 9, wherein the second part comprises a portion that is coupled to the housing.

13. The drying apparatus of claim 9, wherein at least one of at least one reflector further comprises a third part connecting the first part and the second part.

14. The drying apparatus of claim 13, wherein the third part of at least one of at least one reflector is coupled to the third part of an adjacent reflector.

15. The drying apparatus of claim 1, wherein a profile of an axial cross-section and/or a radial cross-section of at least one reflector is a polynomial.

16. The drying apparatus of claim 15, wherein the polynomial has multiple segments.

17. The drying apparatus of claim 1, wherein at least one of the one or more radiation energy sources is positioned between the airflow channel and the housing.

18. The drying apparatus of claim 17, wherein the one or more radiation energy sources are positioned along a peripheral of the airflow channel.

19. The drying apparatus of claim 17, wherein the one or more radiation energy sources are positioned in juxtaposition to the airflow channel.

20. The drying apparatus of claim 17, wherein the one or more radiation energy sources are arranged along a ring.

* * * * *